US007226153B2

(12) United States Patent
Sasaki

(10) Patent No.: US 7,226,153 B2
(45) **Date of Patent: *Jun. 5, 2007**

(54) INK CARTRIDGE

(75) Inventor: Toyonori Sasaki, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/255,646

(22) Filed: Sep. 27, 2002

(65) Prior Publication Data

US 2003/0184628 A1 Oct. 2, 2003

(30) Foreign Application Priority Data

| | | |
|---|---|---|
| Mar. 28, 2002 | (JP) | 2002-090322 |
| Jul. 10, 2002 | (JP) | 2002-018535 |
| Jul. 10, 2002 | (JP) | 2002-018536 |
| Jul. 10, 2002 | (JP) | 2002-018537 |
| Jul. 10, 2002 | (JP) | 2002-018538 |
| Jul. 10, 2002 | (JP) | 2002-018539 |
| Jul. 10, 2002 | (JP) | 2002-018540 |
| Jul. 10, 2002 | (JP) | 2002-018541 |
| Jul. 10, 2002 | (JP) | 2002-018542 |
| Jul. 10, 2002 | (JP) | 2002-018543 |
| Jul. 10, 2002 | (JP) | 2002-018544 |
| Jul. 23, 2002 | (JP) | 2002-019748 |
| Jul. 23, 2002 | (JP) | 2002-019749 |
| Jul. 23, 2002 | (JP) | 2002-019750 |
| Jul. 23, 2002 | (JP) | 2002-019751 |
| Jul. 23, 2002 | (JP) | 2002-019752 |
| Jul. 23, 2002 | (JP) | 2002-019753 |
| Jul. 23, 2002 | (JP) | 2002-019754 |
| Jul. 23, 2002 | (JP) | 2002-019755 |
| Jul. 23, 2002 | (JP) | 2002-019756 |
| Jul. 23, 2002 | (JP) | 2002-019757 |
| Jul. 23, 2002 | (JP) | 2002-019758 |
| Jul. 23, 2002 | (JP) | 2002-019759 |
| Jul. 23, 2002 | (JP) | 2002-019760 |
| Jul. 23, 2002 | (JP) | 2002-019761 |
| Jul. 23, 2002 | (JP) | 2002-019762 |
| Jul. 23, 2002 | (JP) | 2002-019763 |
| Jul. 23, 2002 | (JP) | 2002-214079 |
| Jul. 26, 2002 | (JP) | 2002-218192 |
| Aug. 1, 2002 | (JP) | 2002-225292 |

(51) Int. Cl.
*B41J 2/175* (2006.01)

(52) U.S. Cl. ..... 347/86

(58) Field of Classification Search ..... 347/86, 347/87; 222/206, 528; 220/350, 629
See application file for complete search history.

(56) References Cited

U.S. PATENT DOCUMENTS 4,074,284 A 2/1978 Dexter et al.

(Continued)

FOREIGN PATENT DOCUMENTS

CN 1189415 A 8/1998

(Continued)

OTHER PUBLICATIONS

U.S. Appl. No. 10/255,617, filed Sep. 27, 2002, Sasaki et al.

(Continued)

*Primary Examiner*—Anh T. N. Vo
(74) *Attorney, Agent, or Firm*—Oliff & Berridge, PLC

(57) ABSTRACT

An ink cartridge includes an ink-holding portion and a rigid upper surface. The ink-holding portion includes a rigid indented surface portion and a flexible film. The indented surface portion has an open side at one side thereof that is covered by the flexible film. Ink is accommodated between the indented surface portion and the flexible film. The upper surface is positioned opposite from the indented surface portion with respect to the flexible film. The upper surface is formed with a substantial semispherical shape that bulges in a direction away from the indented surface portion.

14 Claims, 38 Drawing Sheets

U.S. PATENT DOCUMENTS

| | | | | |
|---|---|---|---|---|
| 4,183,031 | A | 1/1980 | Kyser et al. | |
| 4,342,042 | A | 7/1982 | Cruz-Uribe et al. | |
| 4,509,062 | A | 4/1985 | Low et al. | |
| 4,604,633 | A | 8/1986 | Kimura et al. | |
| 4,673,955 | A * | 6/1987 | Ameyama et al. | 347/86 |
| 4,777,497 | A | 10/1988 | Nozu et al. | |
| 5,283,593 | A | 2/1994 | Wehl | |
| 5,473,350 | A | 12/1995 | Mader et al. | |
| 5,623,290 | A | 4/1997 | Iida et al. | |
| 5,729,256 | A | 3/1998 | Yamanaka et al. | |
| 5,896,151 | A * | 4/1999 | Miyazawa et al. | 347/86 |
| 6,142,617 | A | 11/2000 | Barinaga et al. | |
| 6,168,262 | B1 | 1/2001 | Clark et al. | |
| 6,170,937 | B1 | 1/2001 | Childers et al. | |
| 6,338,552 | B1 | 1/2002 | Sato et al. | |
| 6,481,837 | B1 * | 11/2002 | Askren et al. | 347/85 |
| 6,554,402 | B2 * | 4/2003 | Trafton et al. | 347/49 |
| 6,609,461 | B2 | 8/2003 | Horii et al. | |
| 6,886,928 | B2 * | 5/2005 | Sasaki et al. | 347/86 |
| 2002/0047882 | A1 | 4/2002 | Karlinski et al. | |

FOREIGN PATENT DOCUMENTS

| | | | |
|---|---|---|---|
| EP | 0 689 936 | A2 | 1/1996 |
| EP | 0 742 102 | A2 | 11/1996 |
| EP | 0834402 | A2 | 4/1998 |
| JP | A 58-53473 | | 3/1983 |
| JP | A-59-143646 | | 8/1984 |
| JP | A-59-192573 | | 8/1984 |
| JP | 59 204564 | | 11/1984 |
| JP | A-59-204566 | | 11/1984 |
| JP | A-59-209878 | | 11/1984 |
| JP | A-61-054942 | | 3/1986 |
| JP | A-61-158460 | | 7/1986 |
| JP | A-61-277459 | | 12/1986 |
| JP | A-61-277460 | | 12/1986 |
| JP | 63-207652 | | 8/1988 |
| JP | A-64-20149 | | 1/1989 |
| JP | A-1-120354 | | 5/1989 |
| JP | A-3-213349 | | 9/1990 |
| JP | A-3-184873 | | 8/1991 |
| JP | B2 3-60670 | | 9/1991 |
| JP | A 3-505999 | | 12/1991 |
| JP | A-3-506000 | | 12/1991 |
| JP | A-4-70350 | | 3/1992 |
| JP | 0 4344250 | | 11/1992 |
| JP | A-5-261935 | | 10/1993 |
| JP | 06 099588 | | 4/1994 |
| JP | A-7-214791 | | 8/1995 |
| JP | A-8-230204 | | 9/1996 |
| JP | A-9-20014 | | 1/1997 |
| JP | 10 202896 | | 4/1998 |
| JP | B2 2768817 | | 4/1998 |
| JP | A-10-193708 | | 7/1998 |
| JP | 2002 086753 | | 3/2002 |
| WO | WO 90/08564 | | 8/1990 |

OTHER PUBLICATIONS

U.S. Appl. No. 10/255,606, Sep. 27, 2002, Sasaki et al.
U.S. Appl. No. 10/255,618, Sep. 27, 2002, Sasaki et al.
U.S. Appl. No. 10/255,604, filed Sep. 27, 2002, Sasaki et al.
U.S. Appl. No. 10/758,098, filed Jan. 16, 2004, Sasaki et al.

* cited by examiner

INK CARTRIDGE

BACKGROUND OF THE INVENTION

1. Field of the Invention

The present invention relates to an ink cartridge that can be mounted in a recording device.

2. Description of the Related Art

Ink cartridges for supplying ink to recording devices are broadly used. One type has a case that holds a porous member impregnated with ink. Another type includes a flexible bag filled with ink. Japanese Patent-Application Publication No. 58-53473, Japanese Patent Publication No. 3-505999, and U.S. Pat. No. 4,509,062 each disclose an ink cartridge including a case with one side open. A flexible film is attached to cover the open side of the case. Ink is accommodated in between the case and the film.

SUMMARY OF THE INVENTION

Recently, consumers have desired ever more compact and slim recording devices. In association with this desire, is a desire for ever more compact and slim ink cartridge that enable the recording devices to be compact and slim. It is also desirable for ink cartridges to include a strong case that can withstand bending and warping.

A compact or slim recording device has only a limited area for mounting ink cartridges. If an ink cartridge is deformed, it might be impossible to mount the ink cartridge in the limited space. The ink cartridge might apply pressure to the ink in the ink cartridge in an unpredictable manner so that recording operations are undesirably affected. Also, air dissolved in the ink can accumulate into bubbles over time. The bubbles are the source of defective ink ejection. Sometimes ink cartridges are sealed in vacuum packages in order to prevent the amount of ink dissolved in the ink from increasing and to prevent defective ink ejection. However, the ink cartridge can deform when a vacuum is generated inside the packaging material, resulting in ink leaks.

The flexible film that is attached to cover the open side of the case can deform when the ink cartridge case deforms. This can greatly influence the ink inside the ink cartridge.

There has been a problem with conventional ink cartridges in that attempts to strengthen the case lower the amount of ink that can be accommodated in the ink cartridges, so that it is difficult to produce a compact and slim ink cartridge.

It is an objective of the present invention to provide a compact ink cartridge with sufficient strength, while at the same time being capable of accommodating a large amount of ink.

In order to achieve the above-described objectives, an ink cartridge according to the present invention includes an ink-holding portion and a rigid upper surface. The ink-holding portion includes a rigid indented surface portion and a flexible film. The indented surface portion has an open side at one side thereof that is covered by the flexible film. Ink is accommodated between the indented surface portion and the flexible film. The upper surface is positioned opposite from the indented surface portion with respect to the flexible film. The upper surface is formed with a substantial semispherical shape that bulges in a direction away from the indented surface portion.

With this configuration, the upper surface of the ink cartridge curves in a direction away from the indented surface portion in correspondence with the bulge in the flexible film from ink filling between the indented surface portion and the flexible film. Therefore, a large volume of ink can be accommodated even if the ink cartridge has a compact size. Also, the upper surface is sufficiently strong because the upper surface is formed with a substantial semispherical shape that bulges in a direction away from the indented surface portion. Therefore, the ink cartridge will be sufficiently durable with respect to bending and warping and will not be crushed.

It is desirable to further provide a main case and a lid. The main case includes the indented surface portion of the ink-holding portion and is attached with the flexible film so that the open side of the indented surface portion is covered. The lid is provided as a separate member from the main case and includes the upper surface. The upper surface has a curved portion at a position that confronts the indented surface portion of the main case, with the flexible film located therebetween. The curved portion is curved in the substantial semispherical shape in a direction extending away from the indented surface portion. With this configuration, the ink cartridge can be easily produced by merely coupling the lid with the main case so that the curved portion confronts the indented surface portion with the flexible film located therebetween.

It is desirable that the indented surface portion of the main case be formed from a wall that is curved in a substantial semispherical shape in a direction away from the curved portion of the lid with this configuration, the wall that forms the indented surface portion curves in a substantial semispherical shape in a direction away from the curved portion of the lid so that the wall has sufficient strength. Therefore, the ink cartridge will be sufficiently durable with respect to bending and warping and will not be crushed.

It is desirable that the ink-holding portion include an encompassing edge that defines the open side of the indented surface portion. The flexible film is attached to the encompassing edge. The main case has a peripheral wall that extends from an upper edge thereof in a depthwise direction of the ink-holding portion to a lower edge thereof to encompass the ink-holding portion. The lower edge of the peripheral wall substantially defines an outer peripheral edge portion of a lower surface of the main case. The lid has an outer peripheral portion that confronts the peripheral wall and that is coupled with the upper edge of the peripheral wall.

With this configuration, even though the lower surface of the ink-holding portion has a substantially semispherical shape, the ink cartridge is stabilized by the lower edge of the peripheral wall of the main case when the ink cartridge is placed on a table top, for example. Also, the ink cartridge can be easily mounted in and removed from the recording device. Because the flexible film is attached to the encompassing edge of the ink-holding portion and the lid is coupled to the upper edge of the peripheral wall, ink can be reliably sealed in the ink cartridge without the lid interfering with the portion of the flexible film that is attached.

It is desirable that the main case have a main case open side peripheral edge portion that encompasses the open side of the ink-holding portion. The main case opening peripheral edge portion has an inner edge that defines a boundary between the open side and the indented surface portion of the ink-holding portion. The flexible film is attached to the main case open side peripheral edge portion so as to cover the open side of the ink-holding portion. The lid has a lid opening peripheral portion that encompasses the curved portion. The lid opening peripheral portion is formed at a position confronting a region to the outside of the inner edge of the main case open side peripheral edge portion.

With this configuration, the flexible film is attached to the main case open side peripheral edge portion. Also, the main case open side peripheral edge portion confronts the curved portion of the lid because it is positioned to the inside of the lid opening peripheral portion. Accordingly, the lid opening peripheral portion will not contact the flexible film where it is attached to the main case open side peripheral edge portion even if the main case and the lid are pressed so as to approach each other. Therefore, the edge of the flexible film will not be damaged. Ink will not leak.

It is desirable that the main case has a plurality of ribs that connect the peripheral wall of the main case to a lower surface of the wall. The plurality of ribs connect the peripheral wall of the main case to the lower surface. With this configuration, the ribs prevent the substantially hemispherical shaped wall from deforming.

It is desirable that the peripheral wall of the main case include a first peripheral wall, a second peripheral wall, and plurality of walls that connected the first and second peripheral walls together. The first peripheral wall extends in the depthwise direction of the ink-holding portion and is formed integrally with the encompassing edge that defines the open side of the indented surface portion. The second peripheral wall is positioned on an opposite side of the first peripheral wall than the ink-holding portion with a space interposed between the first and second peripheral walls. With this configuration, the peripheral wall of the main case has a two-layer configuration so that the peripheral wall can be prevented from deforming.

It is desirable that the main case be formed with an ink supply hole and an atmosphere connection pathway. The ink supply hole is for drawing ink from the ink-holding portion to outside of the ink cartridge. The atmosphere connection pathway connects a space between the lid and the flexible film with outside of the ink cartridge in order to apply atmospheric pressure from outside of the ink-holding portion to the flexible film. With this configuration, the ink in the ink-holding portion can be drawn out through the ink supply hole because the flexible film is applied with atmospheric pressure through the atmosphere connection pathway.

It is desirable that the main case includes a wall portion that defines an ink supply hole and an atmosphere connection hole. The ink supply hole is for removing ink from the indented surface portion of the ink-holding portion to outside of the ink cartridge. The atmosphere connection hole connects a space between the lid and the flexible film with outside of the ink cartridge in order to apply atmospheric pressure from outside of the ink-holding portion to the flexible film. The lid is formed with, at least at one position that confronts the main case open side peripheral edge portion, a groove for bringing the space defined between the curved portion of the lid and the flexible film into fluid communication with the atmosphere connection hole.

With this configuration, the ink in the indented surface portion can be supplied to outside of the ink cartridge because the air that enters through the atmosphere connection hole applies pressure to the flexible film in a direction toward the indented surface portion of the ink-holding portion. It should be noted that there is a danger that upper surface of the main case open side peripheral edge portion will come into intimate contact with the flexible film when the main case open side peripheral edge portion plastically deforms, so that a sealed space is formed between the flexible film and the outer peripheral portion that encompasses the curved portion of the lid. In such a situation, ink could not be supplied properly outside the ink cartridge because the sealed space is not in fluid communication with the atmosphere connection hole so that pressure could not be applied to the flexible film. However, because the groove is formed where the lid confronts the main case open side peripheral edge portion, the space in between the curved portion and the flexible film can be maintained in fluid communication with the atmosphere connection hole even if the main case open side peripheral edge portion comes into intimate contact with the flexible film. Therefore, the ink supplying function can be properly maintained.

It is desirable that the flexible film be formed from an inner layer and an outer layer. The inner layer has heat fusing properties and contacts the upper edge of the peripheral wall of the main case. The outer layer has heat resistance and shock resistance and confronts the curved portion of the lid. Only the inner layer, which has heat fusing properties, is thermally fused and attached to the peripheral wall of the main case. On the other hand, the outer layer has shock resistance so the flexible film does not easily tear, so that ink leaks can be prevented.

It is desirable that the outer layer be formed from an additive type polypropylene that has heat resistance and that shock resistance and the inner layer be formed from a non-additive type polypropylene. With this configuration, the flexible film can be easily attached to the main case and is difficult to tear.

It is desirable that a main case and a lid be further provided. The main case includes the indented surface portion of the ink-holding portion and is formed from a resin. The lid includes the upper surface and is formed from a resin that is different from the resin of the main case. Because the ink-holding portion of the main case directly contacts the ink, the ink-holding portion can be formed from, for example, an additive type polypropylene. On the other hand, the upper surface of the lid does not directly contact the ink, so can be made from a non-additive type polypropylene with no additives added for maintaining strength. By making the main case and the lid from a resin material, for example, the same resin material, the ink cartridge can be easily produced by fusing the engaging portions of the main case and the lid integrally together using ultrasonic welding.

It is desirable that at least the main case be formed from a resin having high resistance to ink. The ink-holding portion directly contacts ink. However, the ink-holding portion can be prevented from being corroded by the ink because it is formed from a resin that has a high resistance to ink.

It is desirable that the flexible film have gas permeability. When the ink cartridge is packaged in a vacuum pack, then the air or other gases that are dissolved in the ink can be exhausted out through the flexible film. Accordingly, the ink will include a low level of dissolved gas so that only small amounts of bubbles will be generated.

BRIEF DESCRIPTION OF THE DRAWINGS

The above and other objects, features and advantages of the invention will become more apparent from reading the following description of the embodiment taken in connection with the accompanying drawings in which:

FIG. 37(*b*) is a side view showing processes of a method for producing the bulging shape in the flexible film;

FIG. 39(*b*) shows a plug peak portion of the ink rubber plug for ink injection fitted to the edge of the ink injection hole;

FIG. 43(*b*) is a perspective view showing the ink cartridge of FIG. 43(*a*);

FIG. 44(*b*) is a perspective view showing the ink cartridge of FIG. 44(*a*);

FIG. 45(*b*) is a perspective view showing the ink cartridge of FIG. 45(*a*);

FIG. 46(*b*) is a perspective view showing the ink cartridge of FIG. 46(*a*);

FIG. 47(*b*) is a side view showing the ink cartridge of FIG. 47(*a*);

FIG. 48(*b*) is a side view showing the ink cartridge of FIG. 48(*a*);

FIG. 49(*b*) is a side view showing the ink cartridge of FIG. 49(*a*);

FIG. 50(*b*) is a side view showing the ink cartridge of FIG. 50(*a*);

FIG. 51(*b*) is a side view showing the ink cartridge of FIG. 51(*a*);

FIG. 52(*b*) is a side view showing the ink cartridge of FIG. 52(*a*);

FIG. 53(*b*) is a side view showing the ink cartridge of FIG. 53(*a*).

DETAILED DESCRIPTION OF THE EMBODIMENT

Next, an ink cartridge 200 according to an embodiment of the present invention and a multifunction device 1 that uses the ink cartridge 200 will be described while referring to FIGS. 1 to 40.

Figure 1:
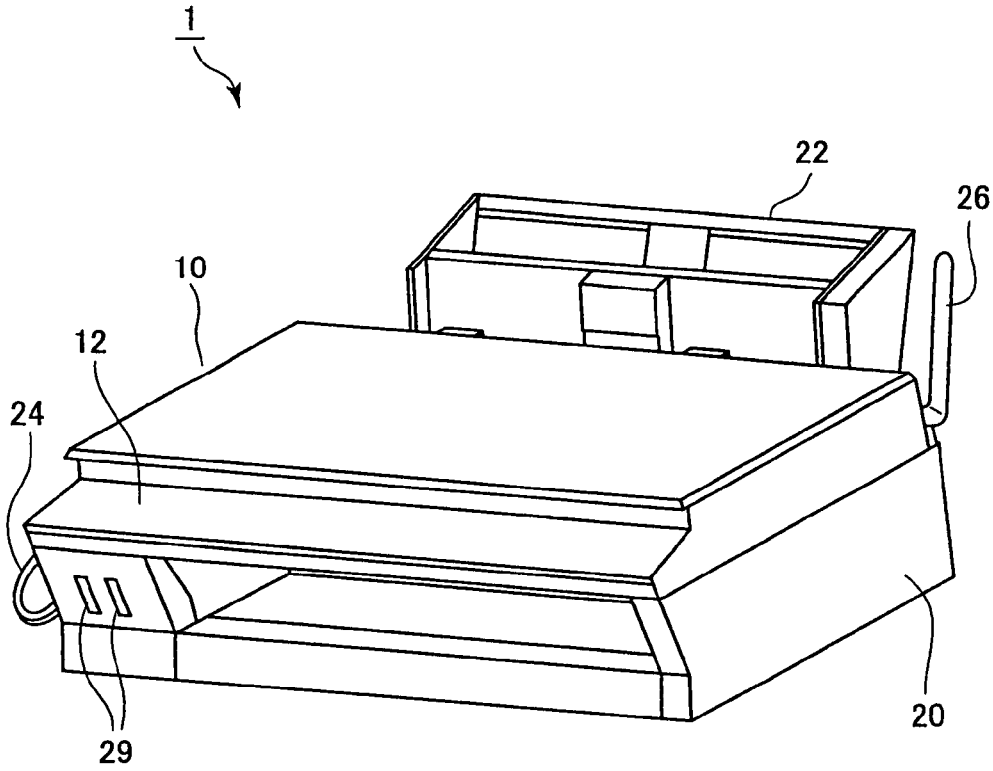
FIG. 1 is a perspective view showing overall configuration of a multifunction device mounted with an ink cartridge according to an embodiment of the present invention.

First, the multifunction device 1 that uses the ink cartridge 200 will be described with reference to FIGS. 1 to 11. FIG. 1 shows the multifunction device 1 according to the present embodiment. The multifunction device 1 includes a scanner function, a copy function, and a facsimile function. The multifunction device 1 has a slim and compact configuration including a retrieval unit 10 and an ink jet recording unit 20. The ink jet recording unit 20 is disposed on the retrieval unit 10. A control panel 12 is provided on the retrieval unit 10. The ink jet recording unit 20 is provided with a sheet-supply tray 22. The multifunction device 1 is provided with a telephone 24 and an antennae 26. The telephone 24 is capable of wireless transmission with a cordless handset (not shown) using the antennae 26. The telephone 24 is capable of connecting with a public telephone circuit and serving as a transfer point for the cordless handset (not shown) while the cordless handset is used for a telephone call.

Figure 7:
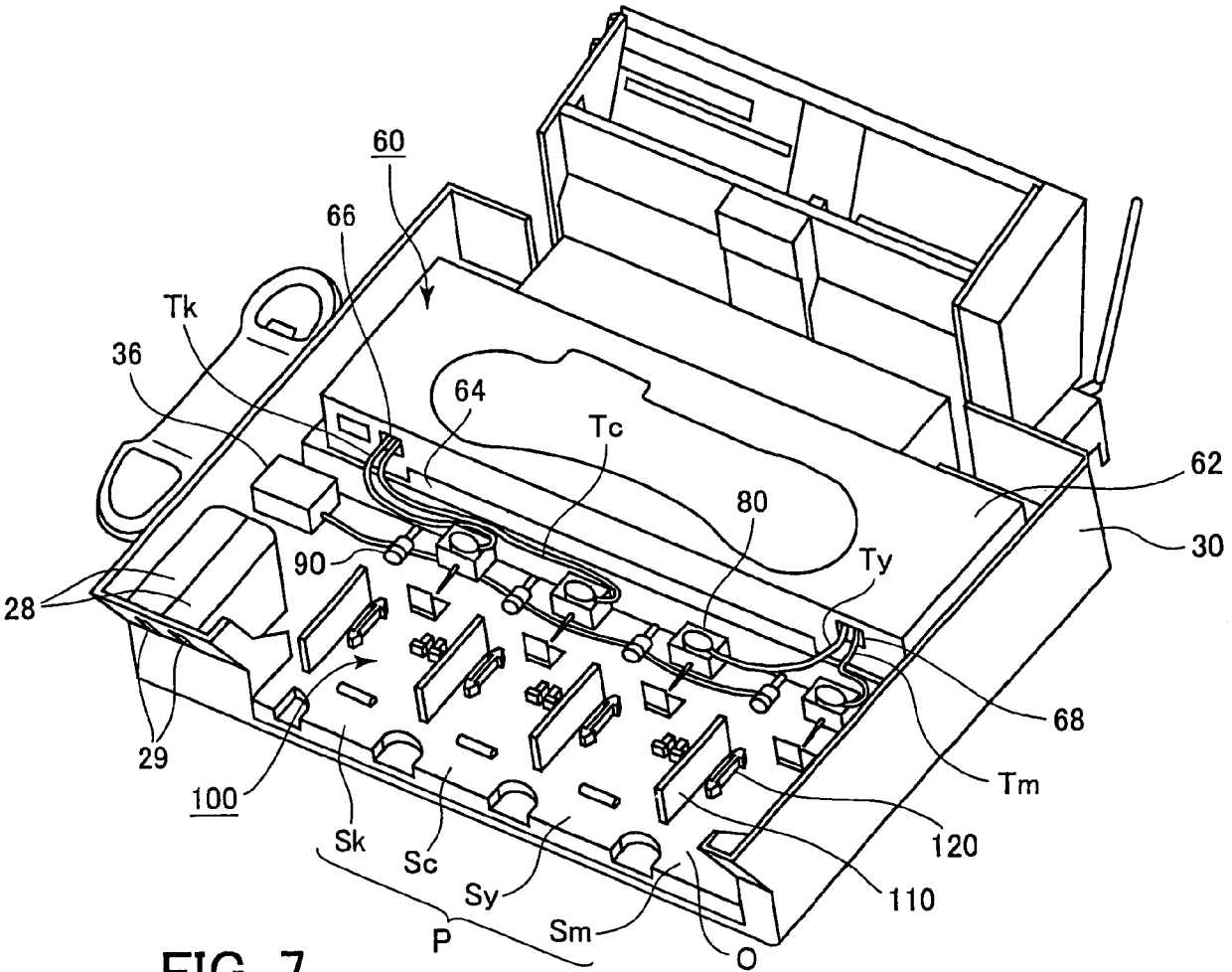
FIG. 7 is a perspective view showing the multifunction device with the flat bed type retrieval unit and also the cover body removed.

It should be noted that a power source, a main substrate, an NCU substrate, and two media board devices 28 shown in FIG. 7 are provided in the ink jet recording unit 20 in addition to recording mechanisms for performing recording operations. The main substrate is for controlling operations of the multifunction device 1. The NCU substrate is for controlling connection with the public telephone circuit for the facsimile function and the telephone function. Two media slots 29 are provided at the front surface of the ink jet recording unit 20. By inserting an external memory medium into either of the media slots 29, the external medium can be freely detachably mounted in the corresponding one of the media board devices 28. The media board devices 28 retrieve data, such as data taken by a digital camera, from the external memory medium, whereupon the data is used for printing and the like.

Figure 2:
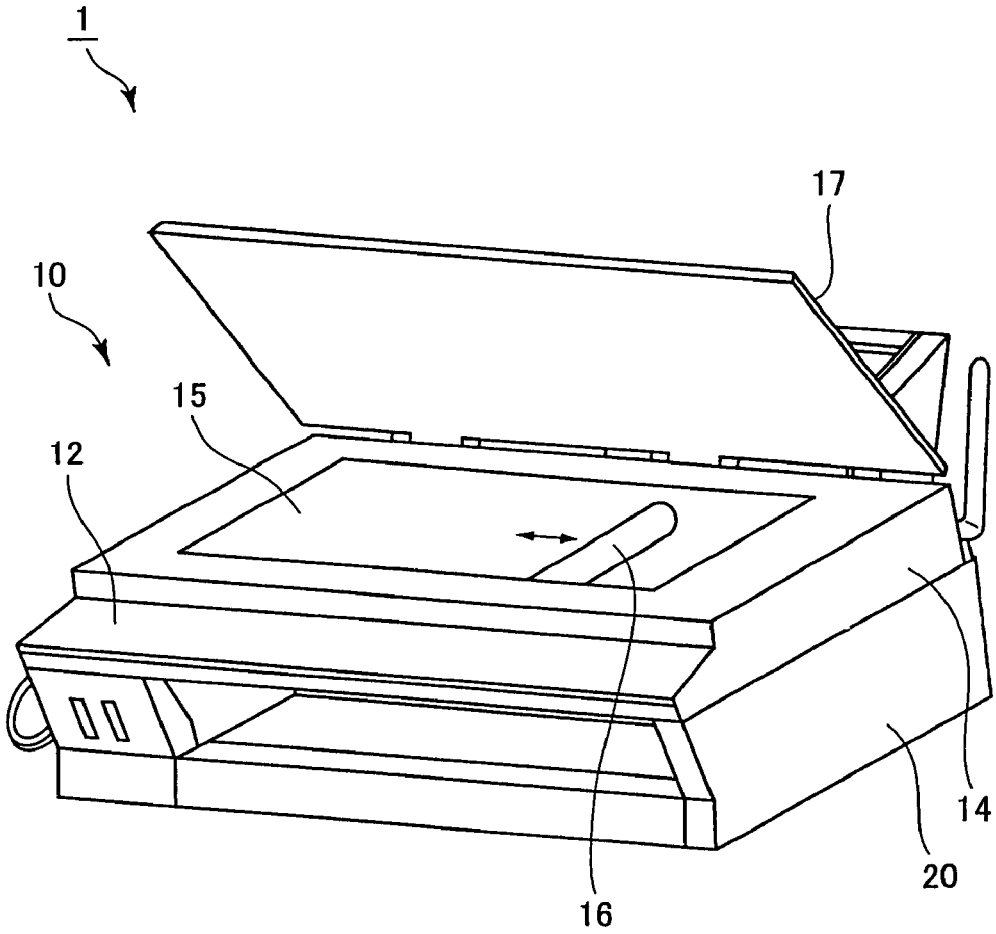
FIG. 2 is a perspective view showing the multifunction device of FIG. 1 with an upper cover of a flat bed type retrieval device opened up.

As shown in FIG. 2, the retrieval unit 10 is a flat head type retrieval unit and includes a retrieval unit case 14. The retrieval unit case 14 includes a document glass 15 on which a document to be scanned is placed. A contact image sensor 16 is disposed below the document glass 15. Configuration is provided for generating scanning movements of the contact image sensor 16. An upper cover 17 for covering the upper surface of the document glass 15 is provided openable and closable with respect to the retrieval unit case 14.

The control panel 12 is provided on the upper surface to the front of the retrieval unit case 14. An operator inputs commands for operations, such as a copy operation, a facsimile operation, or a scanner operation, of the multifunction device 1 through the control panel 12.

It should be noted that an attachment means (not shown) is provided for enabling the flat head type retrieval unit 10 to be disconnected from the ink jet recording unit 20.

Figure 3:
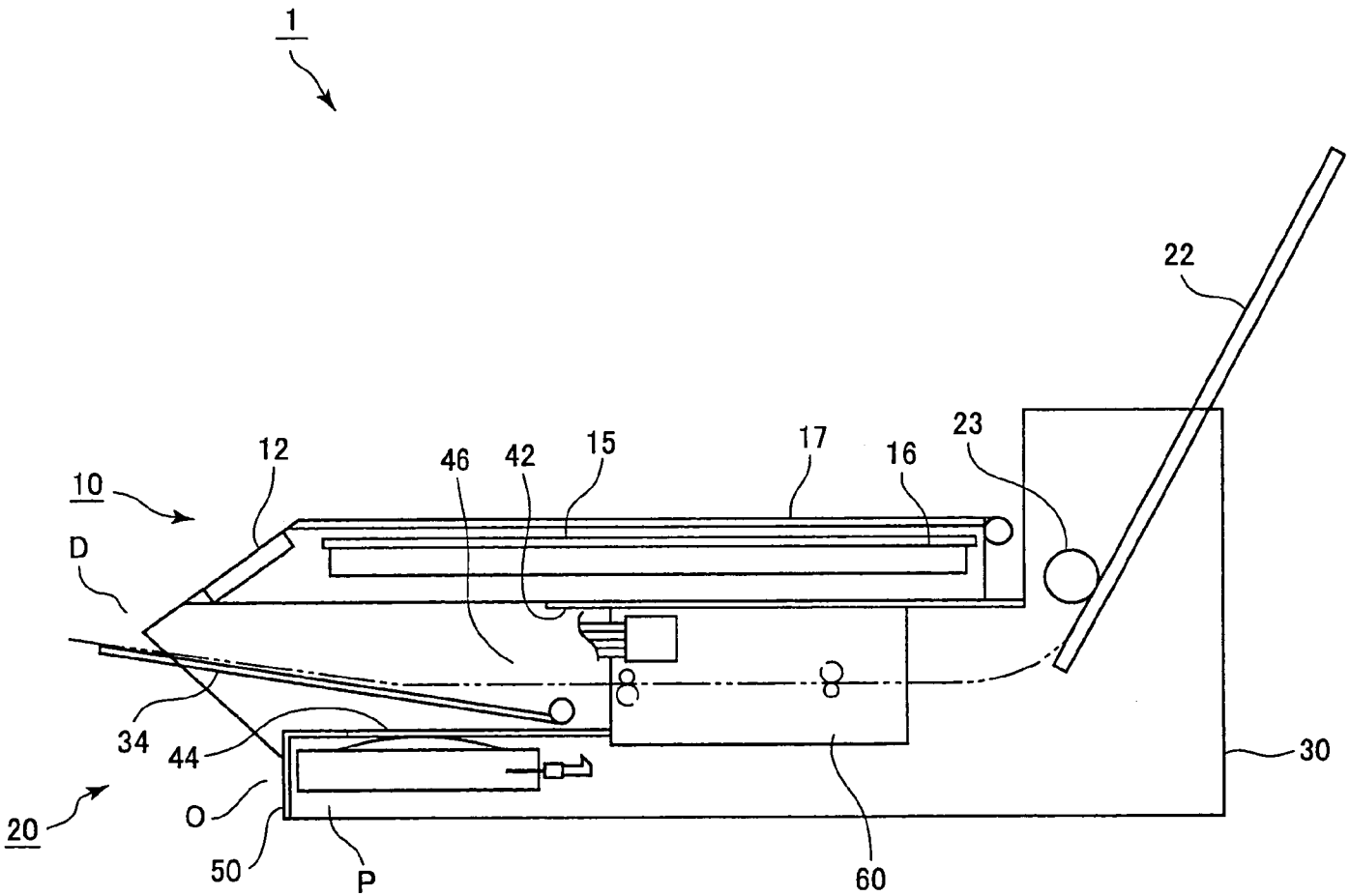
FIG. 3 is a cross-sectional schematic view showing the multifunction device of FIG. 1.

As shown in FIG. 3, the ink jet recording unit 20, which is below the retrieval unit 10, includes a housing 30. The sheet-supply tray 22 protrudes from inside the housing 30 to above the rear portion of the housing 30. A sheet-supply roller 23 is provided in the sheet-supply tray 22 so that one sheet of time can be supplied. A printer engine 60 is provided as a recording portion at a position where sheets are received from the sheet-supply tray 22. A sheet-discharge portion D is provided to the front of the printer engine 60. Sheets recorded on by the printer engine 60 are discharged from the sheet-discharge portion D. It should be noted that a sheet-discharge tray 34 is freely detachably mounted on the sheet-discharge portion D. The sheet-discharge tray 34 serves as a portion of a sheet transport pathway. An ink cartridge holding portion P into which the ink cartridges 200 (FIG. 12) are mounted is disposed between the sheet-discharge portion D and the base of the housing 30. In this way, the ink cartridge holding portion P is disposed at a position lower than the printer engine 60.

Figure 4:
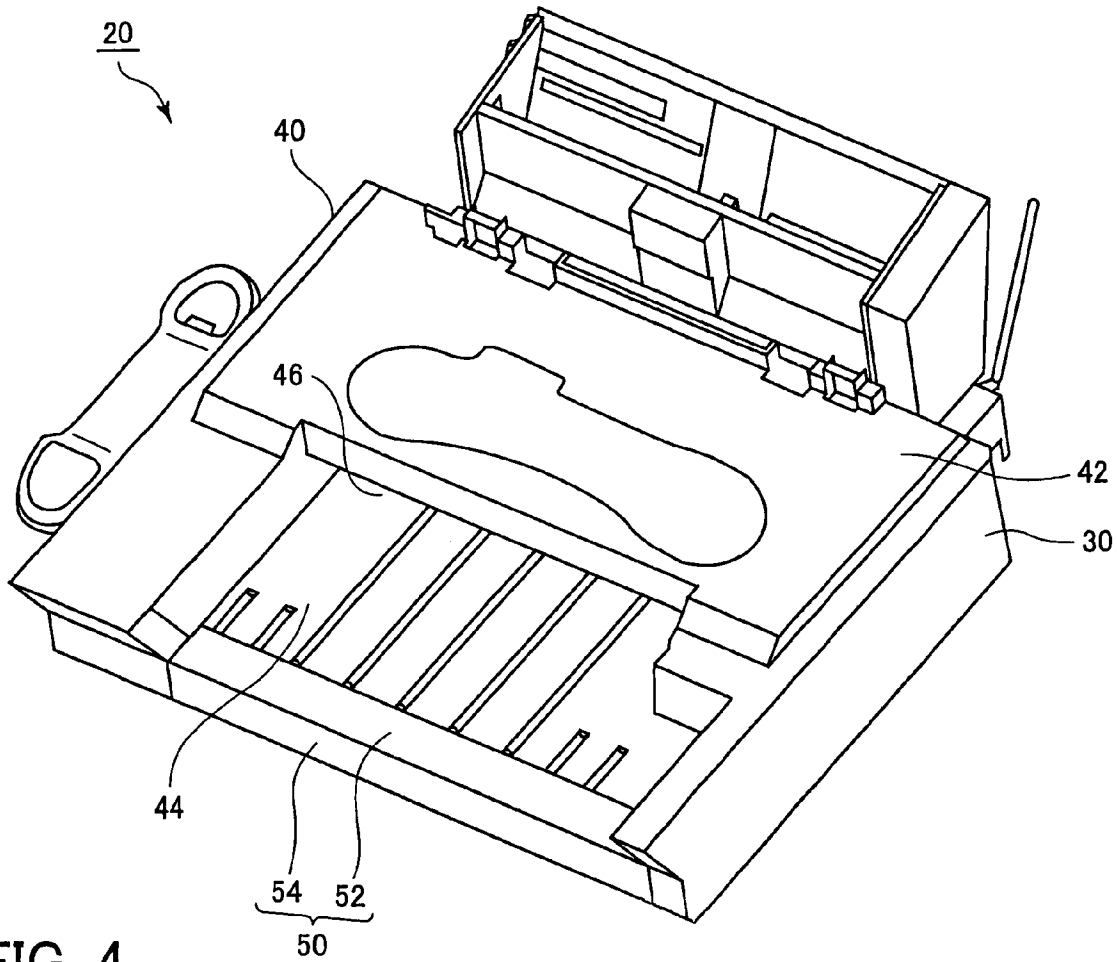
FIG. 4 is a perspective view showing the multifunction device of FIG. 1 with the flat bed type retrieval device removed.

As shown in FIG. 4, the housing 30 is covered from above by a cover 40. The cover 40 has an engine cover portion 42 and a cartridge holding cover portion 44. The engine cover portion 42 covers the printer engine 60 from above. The cartridge holding cover portion 44 is provided below the sheet-discharge portion D and covers the ink cartridge holding portion P from above. The front surface of the engine cover portion 42 is opened to form a sheet-discharge port 46. The cartridge holding cover portion 44 is positioned below the pathway along which sheets recorded by the printer engine 60 are transported, that is, below the sheet-discharge tray 34.

As shown in FIG. 3, the cartridge holding cover portion 44 functions as a ceiling surface of the ink cartridge holding portion P. As will be described later, the ink cartridge holding portion P is formed between the cartridge holding cover portion 44 and a cartridge holding portion base wall 32 so that the ink cartridges 200 can be inserted to the rear side of the ink cartridge holding portion P from a front surface opening portion O. A front surface cover 50 is provided to selectively cover (FIG. 4) and open (FIG. 6) the front surface opening portion O. The front surface cover 50 includes an upper surface wall 52 and a front surface wall 54. When the front surface cover 50 is closed as shown in FIG. 4, the upper surface wall 52 is aligned on the same imaginary plane as the cartridge holding cover portion 44 and the front surface wall 54 extends vertically downward from the upper surface wall 52.

Figure 5:
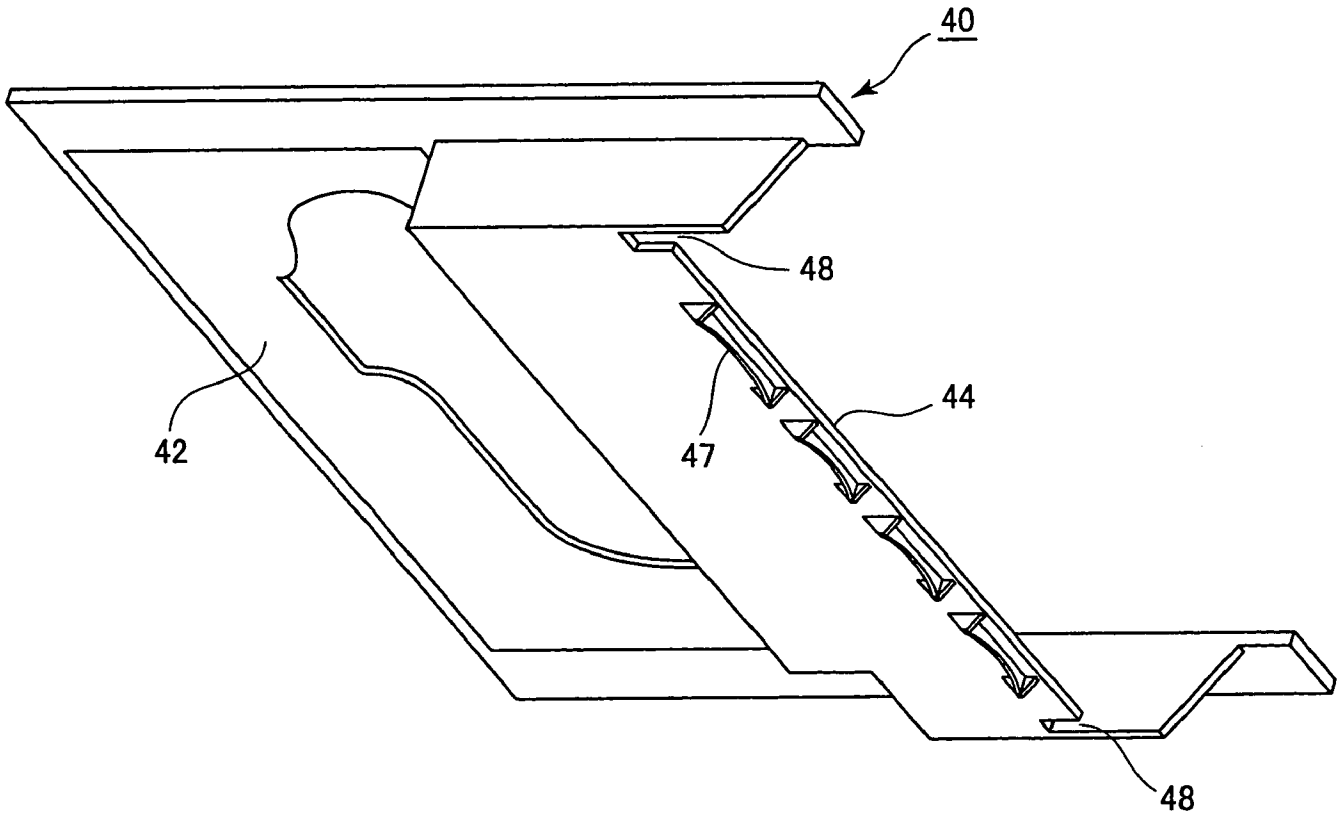
FIG. 5 is a perspective view showing a lower surface of a cover body of the multifunction device.

As shown in FIG. 5, four curve-shaped protruding ribs 47 are formed on the lower surface of the cartridge holding cover portion 44. The curved shape of the curve-shaped protruding ribs 47 is formed to follow the shape of the upper surface of the four ink cartridges 200 mounted in the ink cartridge holding portion P. Also, a pair of notches 48 are formed in left and right ends of the cartridge holding cover portion 44.

Figure 6:
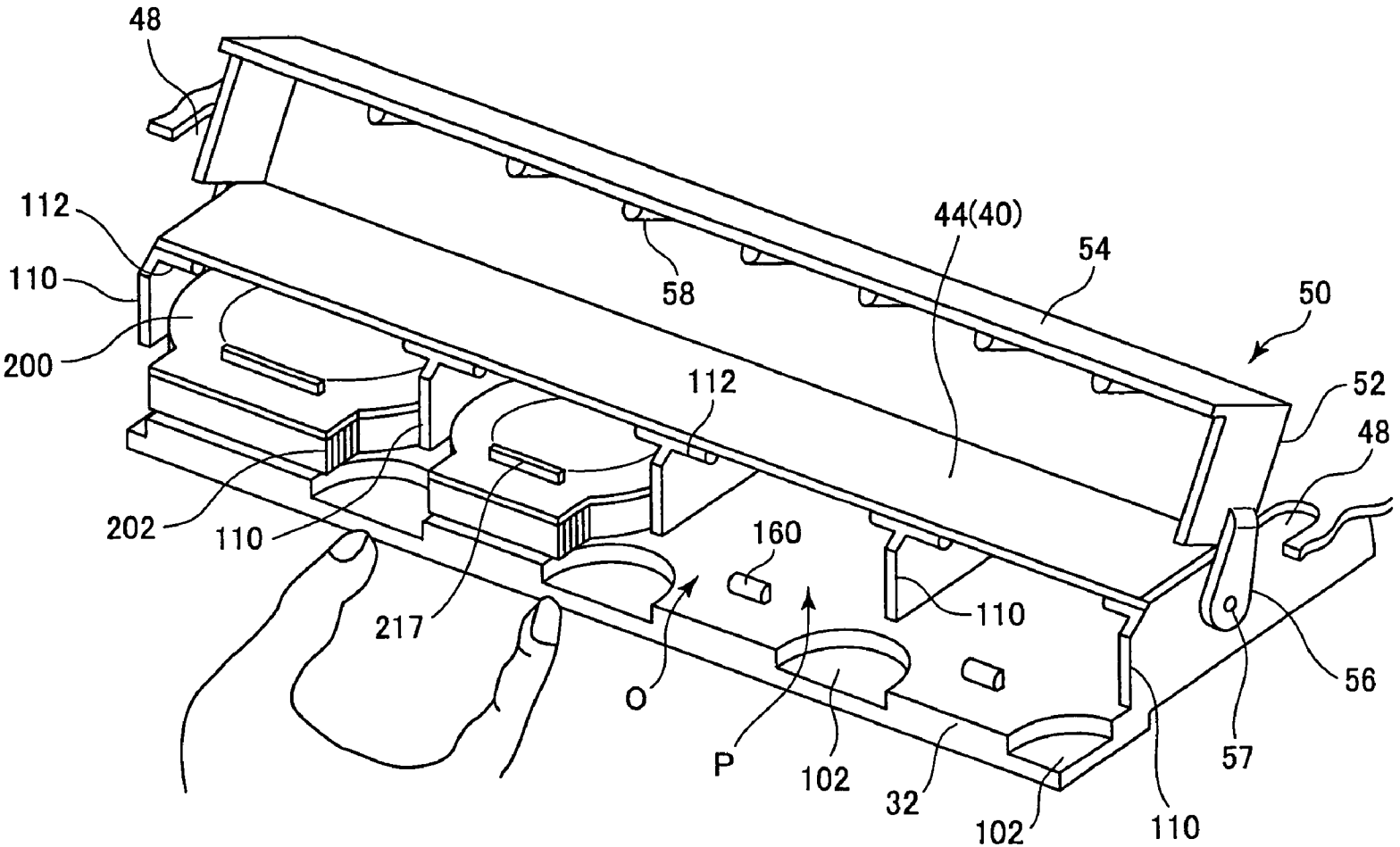
FIG. 6 is a perspective view showing the multifunction device with the cover body opened up.

As shown in FIG. 6, a pair of arms 56 provided to the front surface cover 50 are received by the notches 48 when the front surface cover 50 is opened up. As will be described later, five partition walls 110 are aligned on the base wall 32 in the ink cartridge holding portion P. A pivot shaft 57 protrudes from the two end position partition walls 110. The pair of arms 56 of the front surface cover 50 are pivotably attached to the pivot shaft 57 so that the user can freely open and close the front surface cover 50.

Seven vertical ribs 58 are formed to the rear side of the front surface cover 50 so as to extend vertically when the cover 50 is closed. The vertical ribs 58 extend from the front surface wall 54 of the front surface cover 50 to a portion of the upper surface wall 52. Four of the seven vertical ribs 58 are formed at positions that correspond to the widthwise center of the mounted ink cartridges 200. Accordingly, when the front surface cover 50 is closed from the open condition shown in FIG. 6, the corresponding vertical ribs 58 automatically press any partially inserted ink cartridges 200 deep into the ink cartridge holding portion recording sheet recording sheet P, so that the ink cartridges 200 are accurately inserted even when one of the ink cartridges 200 is incompletely inserted into the ink cartridge holding portion P. Although not shown in the drawings, a plurality of lateral ribs is also formed at the rear surface of the front surface cover 50. The lateral ribs extend in the horizontal direction in intersection with the seven vertical ribs 58 and are for reinforcing the seven vertical ribs 58.

The cartridge holding portion base wall 32 extends further forward than the cartridge holding cover portion 44 in order to guide the ink cartridges 200 into the front surface opening portion O. The portion of the cartridge holding portion base wall 32 that extends further forward than the cartridge holding cover portion 44 is formed with indentations 102 at positions that correspond to the partition walls 110. The indentations 102 have either a quarter or half circle shape when viewed in plan. The indentations 102 have a narrower width than grasping portions 202 of the ink cartridges 200 housed in the ink cartridge holding portion P so that the user can more easily grasp the ink cartridges 200 housed in the ink cartridge holding portion P using his or her fingers.

FIG. 7 shows the multifunction device 1 with the cover 40 and the front surface cover 50 removed from the ink jet recording unit 20. As can be seen in FIG. 7, the housing 30 has an open upper side and the front surface opening portion O of the ink cartridge holding portion P is the front side of the housing 30. The two media board devices 28 are disposed at positions that correspond to the media slots 29. Also, a positive pressure pump 36 to be described later is disposed behind the media board devices 28.

A black (K) ink cartridge mounting portion Sk, a cyan (C) ink cartridge mounting portion Sc, a yellow (Y) ink cartridge mounting portion Sy, and a magenta (M) ink cartridge mounting portion Sm are aligned in the left-right direction in the ink cartridge holding portion P. The black (K) ink cartridge mounting portion Sk is for mounting a black (K) ink cartridge 200*k*, the cyan (C) ink cartridge mounting portion Sc is for mounting a cyan (C) ink cartridge 200*c*, the yellow (Y) ink cartridge mounting portion Sy is for mounting a yellow (Y) ink cartridge 200*y*, and the magenta (M) ink cartridge mounting portion Sm is for mounting a magenta (M) ink cartridge 200*m*.

The black (K) ink cartridge 200*k*, the cyan (C) ink cartridge 200*c*, the yellow (Y) ink cartridge 200*y*, and the magenta (M) ink cartridge 200*m* will be referred to collectively as the ink cartridges 200 hereinafter. Further, the black (K) ink cartridge mounting portion Sk, the cyan (C) ink cartridge mounting portion Sc, the yellow (Y) ink cartridge mounting portion Sy, and the magenta (M) ink cartridge mounting portion Sm will be referred to collectively as the ink cartridge mounting portions S hereinafter.

The ink cartridge holding portion P is configured from the ink cartridge mounting portions S, which are aligned in the left-right direction on the same imaginary plane (on the base wall 32) below the ceiling plate, which configures the cartridge holding cover portion 44 of the cover 40, and below the sheet-discharge tray 34, which serves as a portion of a sheet transport pathway. Accordingly, the ink cartridge holding portion P overall has a flat and substantially parallelepiped shape. Accordingly, the overall configuration of the multifunction device 1 can be formed thin and compact.

Ink supply mechanisms 80, a positive pressure application mechanism 90, and cartridge mounting mechanisms 100 are provided in the ink cartridge mounting portions S. Each cartridge mounting mechanism 100 is for mounting the corresponding ink cartridges 200 as will be described later. The positive pressure application mechanism 90 is for applying a positive pressure from the positive pressure pump 36 to ink in the mounted ink cartridges 200. The ink supply mechanisms 80 are for supplying ink in the mounted ink cartridges 200 to the printer engine 60. Ink-supply tubes T for supplying ink into the printer engine 60 extend from the ink supply mechanisms 80. That is, a black (K) ink-supply tube Tk extends from the black (K) ink cartridge mounting portion Sk, a cyan (C) ink-supply tube Tc extends from the cyan (C) ink cartridge mounting portion Sc, a yellow (Y) ink-supply tube Ty extends from the yellow (Y) ink cartridge mounting portion Sy, and a magenta (M) ink-supply tube Tn extends from the magenta (M) ink cartridge mounting portion Sm. The black (K) ink-supply tube Tk, the cyan (C) ink-supply tube Tc, the yellow (Y) ink-supply tube Ty, and the magenta (M) ink-supply tube Tm will be referred to collectively as the ink-supply tubes T hereinafter.

Although not shown in the drawings, a waste ink absorbing material is disposed on the housing 30 behind the ink cartridge holding portion P and below the printer engine 60. The printer engine 60 includes an engine housing 62. Although not shown in the drawings, a sheet transport slot is formed in the rear surface of the engine housing 62. The sheet transport slot is for receiving sheets supplied from the sheet-supply tray 22. An engine-side sheet-discharge slot 64 is formed in the front surface of the engine housing 62. The engine-side sheet-discharge slot 64 is for discharging sheets that were recorded on by the printer engine 60 toward the sheet-discharge portion D. The sheet-transport pathway is further defined in the engine housing 62 from the sheet transport slot to the engine-side sheet-discharge slot 64. Printed sheets are discharged onto the sheet-discharge portion D because the engine-side sheet-discharge slot 64 confronts the sheet-discharge port 46 (FIG. 4) while the cover 40 covers the housing 30. A KC tube opening 66 and a YM tube opening 68 are formed in the front surface of the engine housing 62. The KC tube opening 66 is for introducing the black (K) ink-supply tube Tk and the cyan (C) ink-supply tube Tc into the printer engine 60. The YM tube opening 68 is for introducing the yellow (Y) ink-supply tube Ty and the magenta (M) ink-supply tube Tm into the printer engine 60. Although not shown in the drawings, a cable opening for introducing cables connected to the main circuit board into the printer engine 60 is also formed in the front surface of the engine housing 62.

Figure 8:
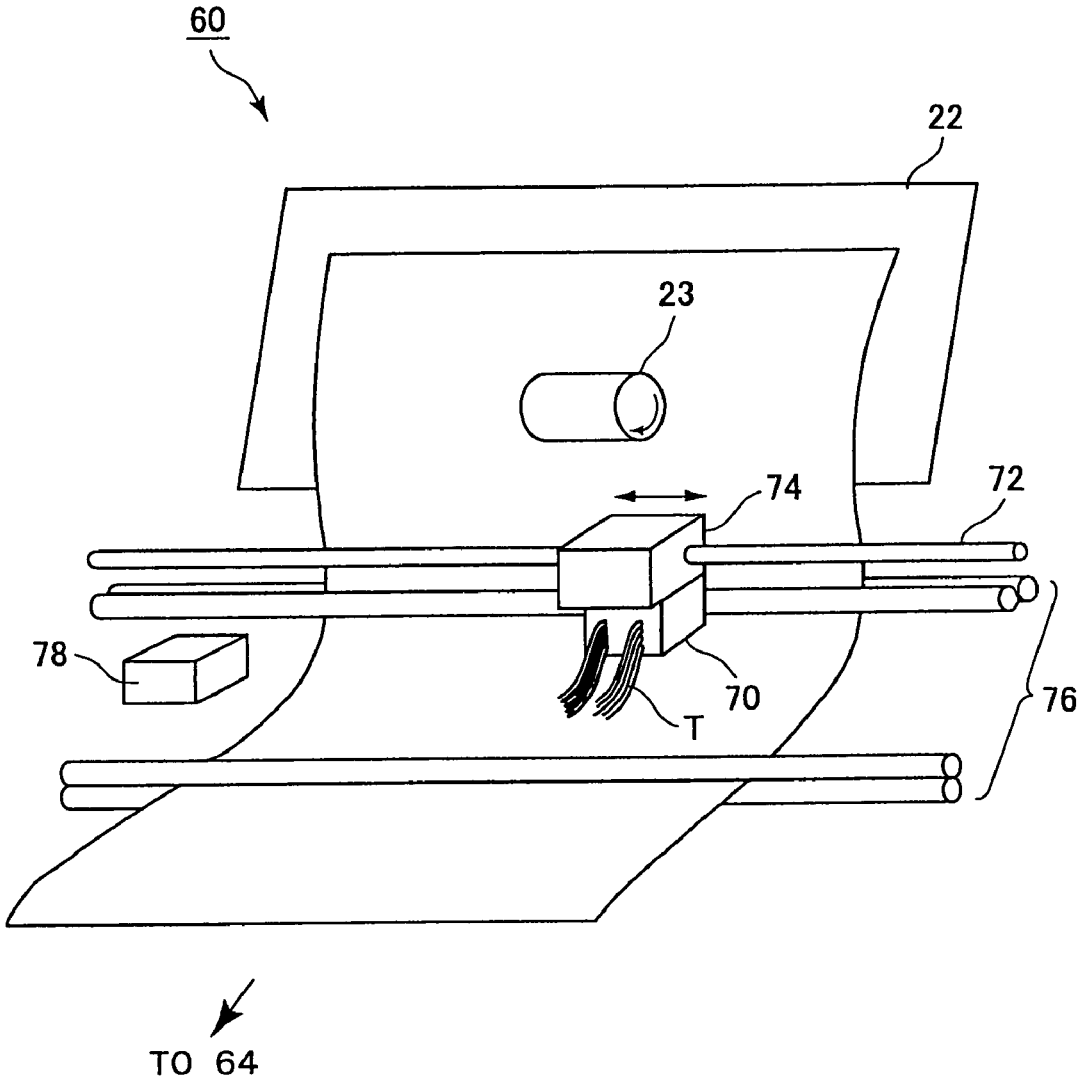
FIG. 8 is a perspective view schematically showing configuration of a printer engine of the multifunction device.

As shown in FIG. 8, a sheet-transport mechanism 76 is provided to the inside to the engine housing 62. The sheet-transport mechanism 76 is made from plural pairs of rollers that transport sheets from the sheet-supply roller 23 along the sheet transport pathway to the engine-side sheet-discharge slot 64. A carriage scan shaft 72 extends above and in a direction that intersects with the sheet transport direction. A carriage 74 is provided on the carriage scan shaft 72 so as to be capable of reciprocal movement following the carriage scan shaft 72. A piezoelectric ink jet head 70 is mounted to the under surface of the carriage 74. Although not shown in the drawings, a group of nozzles is formed for each of the above-described plurality of ink colors. Each nozzle faces downward so it ejects ink downward onto the recording sheet. The four ink-supply tubes T (Tk, Tc, Ty, Tm) and cables are connected to the corresponding nozzle groups to supply the four colors of ink (black, cyan, yellow, and magenta) and drive signals to the piezoelectric ink jet head 70. The carriage 74 scans following the carriage scan shaft 72 and the piezoelectric ink jet head 70 and records in bands with a width that corresponds to the width of the nozzle groups. Each time one scan is completed, the sheet-transport mechanism 76 feeds the sheet by a distance that corresponds to the width of the recording band. A purge unit 78 is provided at a position that is above the carriage scan shaft 72 and that is shifted from the sheet transport pathway. Although not shown in the drawings, the purge unit 78 includes a well-known cap and pump. In certain situations, such as when the nozzles of the piezoelectric ink jet head 70 are clogged, the piezoelectric ink jet head 70 is transported to a position in confrontation with the purge unit 78 and a purge operation is performed wherein the cap covers the nozzles and the pump sucks ink from the nozzles through the cap.

Only the piezoelectric ink jet head 70 is mounted on the carriage 74. Ink from the ink cartridges 200 housed in the ink cartridge holding portion P is supplied to the piezoelectric ink jet head 70 through the tubes T. Also, a pressure head difference is developed between the piezoelectric ink jet head 70 and the ink cartridges 200 because the piezoelectric ink jet head 70 is disposed vertically above the ink cartridge holding portion P. Therefore, a negative pressure, that is, a back pressure operates on the ink in the nozzles of the piezoelectric ink jet head 70 that prevents ink (not shown) from dripping out from the nozzle in the piezoelectric ink jet head 70.

Figure 9:
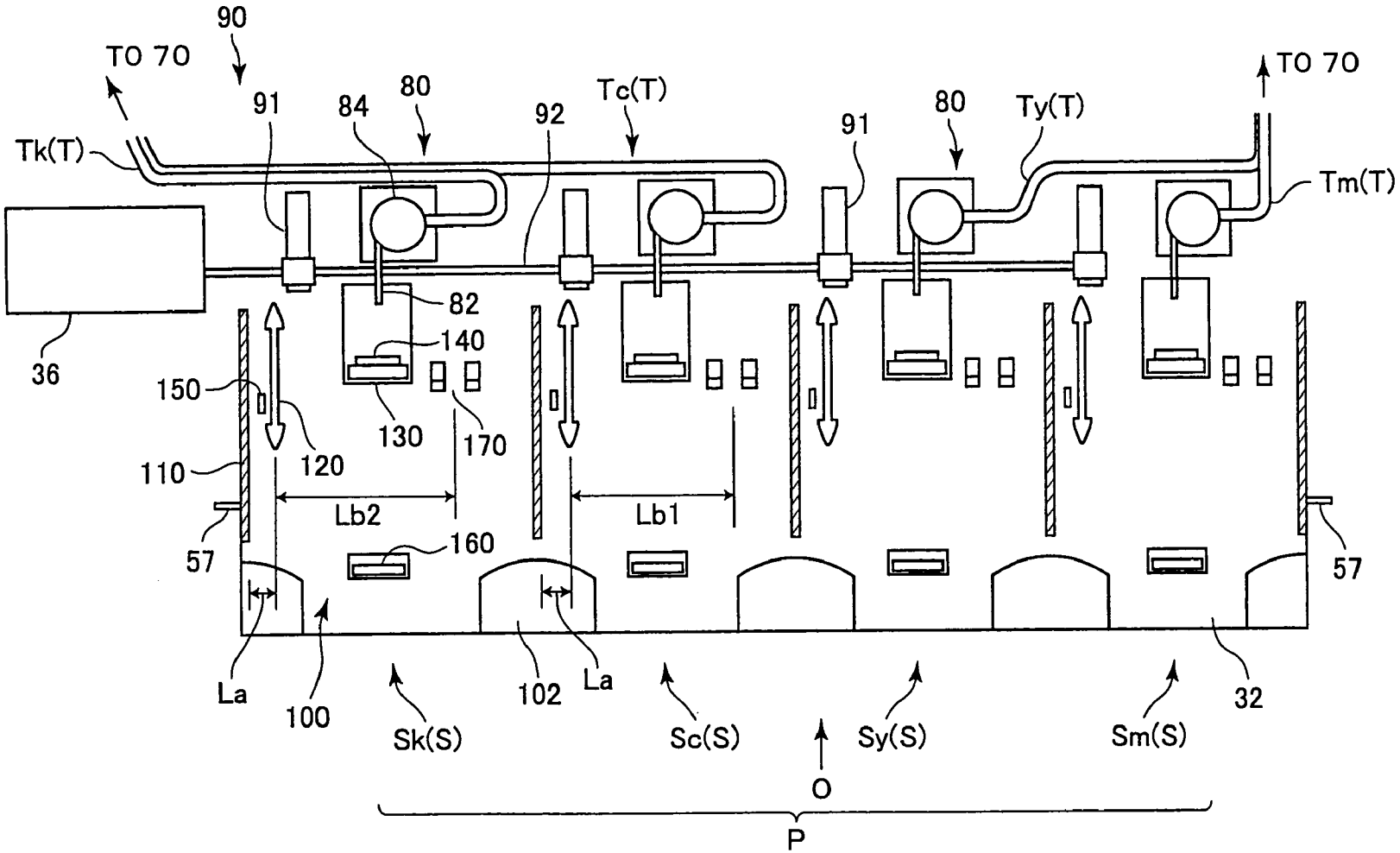
FIG. 9 is a plan view showing configuration of an ink cartridge accommodation portion of the multifunction device.

As shown in FIG. 9, the ink supply mechanisms 80, the positive pressure application mechanism 90, and the cartridge mounting mechanisms 100 have the same configuration for each of the four ink cartridge mounting portions S.

Figure 10:
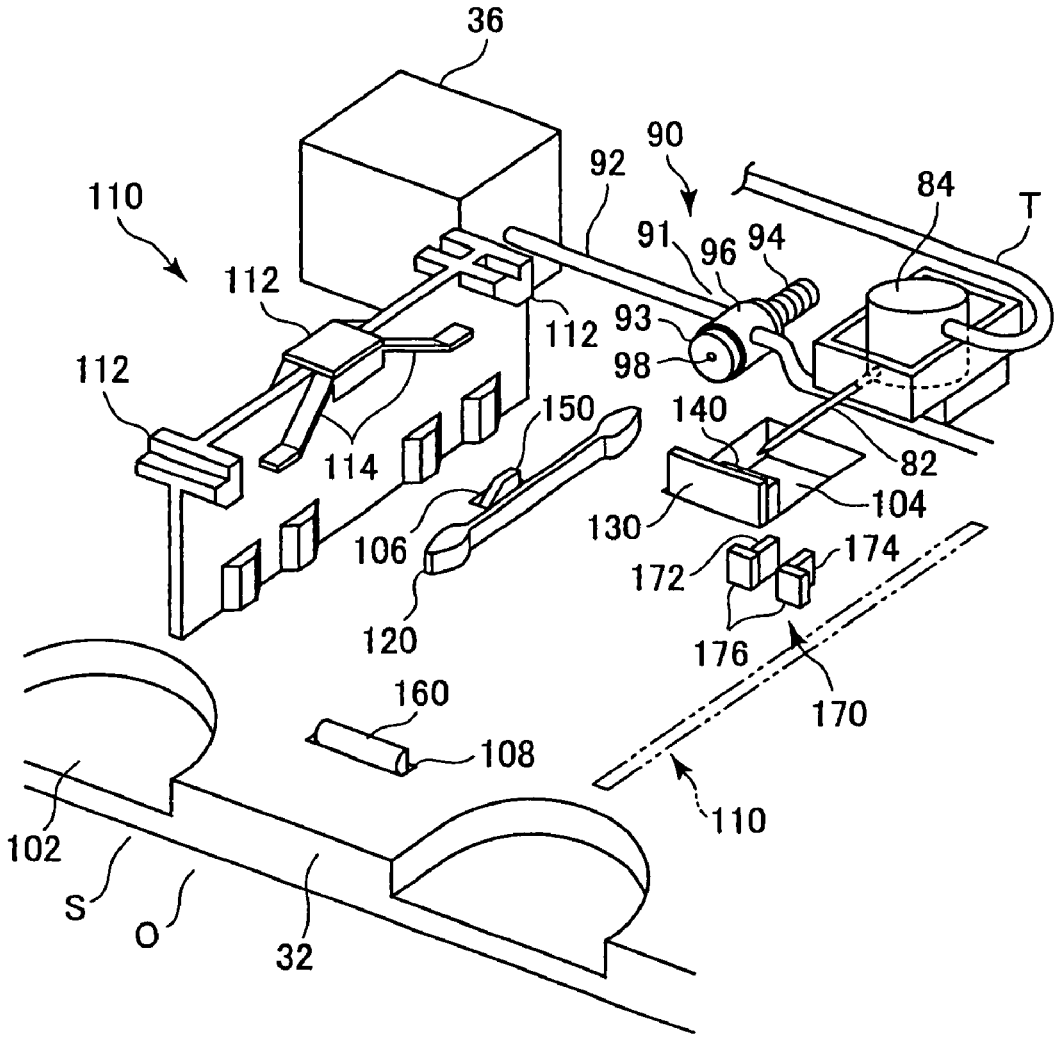
FIG. 10 is a perspective view showing configuration of one ink cartridge mounting portion in the ink cartridge accommodation portion.

As shown in FIGS. 9 and 10, each of the ink supply mechanisms 80 is configured from a buffer tank 84 connected to an ink introducing hollow needle 82 and the ink-supply tube T. The ink introducing hollow needle 82 extends toward the front surface opening portion O. The hollow needle 82 is hollow and formed on the sides of its tip end with a pair of holes connected to the inside in the manner of a well-known hollow needle when an ink cartridge 200 is mounted in the corresponding ink cartridge mounting portion S, the ink introducing hollow needle 82 is inserted into the ink cartridge 200 so that ink is supplied to the buffer tank 84. The buffer tank 84 temporarily holds ink supplied by the ink introducing hollow needle 82 and filters foreign objects out from the ink. Ink that has been filtered in this manner is then supplied to the piezoelectric ink jet head 70 through the corresponding ink-supply tube T.

The positive pressure application mechanism 90 is for applying a positive air pressure to the ink in the ink cartridges 200. The positive pressure application mechanism 90 is configured from positive pressure application members 91 that are connected to the positive pressure pump 36. It should be noted that the total of four positive pressure application members 91 provided to the four ink cartridge mounting portions S are directly connected to the positive pressure pump 36 through positive pressure application tubes 92. There is a relief valve (not shown) between the positive pressure pump 36 and the positive pressure application tubes 92. Drive of the positive pressure pump 36 forces air flow with substantially equal pressure from the four positive pressure application members 91 toward the ink cartridges 200 through the positive pressure application tubes 92.

As shown in FIG. 10, each of the positive pressure application members 91 is made from a ring-shaped resilient seal member 93 and a support member 96. The support member 96 supports the ring-shaped resilient seal member 93 while a spring 94 urges the ring-shaped resilient seal member 93 toward the front surface opening portion O. The ring-shaped resilient seal member 93 includes a centrally located positive pressure hole 98 in fluid connection with the positive pressure application tubes 92 from the positive pressure pump 36. The positive pressure hole 98 faces the front surface opening portion O.

The cartridge mounting mechanisms 100 include the partition walls 110, the indentations 102 on the cartridge holding portion base wall 32, guide protrusion walls 120, needle protection plates 130, lock members 180 (FIG. 11) of the needle protection plates 130, lock releasing operation ribs 150, pull-out-lock protrusions 160, and residual ink detecting photo sensors 170.

The partition walls 110 are formed at either side of each ink cartridge mounting portion S so as to protrude upward from the cartridge holding portion base wall 32 and so as to extend from the front surface opening portion O into the ink cartridge holding portion P. The partition walls 110 define the width of the ink cartridge mounting portions S. It should be noted that the partition walls 110 positioned in between adjacent ink cartridge mounting portions S also serve to partition the adjacent ink cartridge mounting portions S.

The width of each of the ink cartridge mounting portions S is the size suitable for the width of the corresponding ink cartridge 200 to enable the corresponding ink cartridge 200 to be mounted therein. As will be described later, the widths of the cyan (C) ink cartridge 200*c*, the yellow (Y) ink cartridge 200*y*, and the magenta (M) ink cartridge 200*m* are equivalent. The width of the black (K) ink cartridge 200*k*, the black ink of which is more frequency used during printing, is larger than the widths of the cyan (C) ink cartridge 200*c*, the yellow (Y) ink cartridge 200*y*, and the magenta (M) ink cartridge 200*m* in order to provide the black (K) ink cartridge 200*k* with a larger internal capacity. For this reason, the widths of cyan (C) ink cartridge mounting portion Sc, the yellow (Y) ink cartridge mounting portion Sy, and the magenta (M) ink cartridge mounting portion Sm are equivalent and the width of the black (K) ink cartridge mounting portion Sk is larger than the width of the other ink cartridge mounting portions.

The cartridge holding portion base wall 32 of the ink cartridge mounting portions S extends away from the hollow needle 82 farther forward than the front surface opening portion O. Because the ceiling surface, that is, the cartridge holding cover portion 44, has a length to the position of the front surface opening portion O, the portion of the cartridge holding portion base wall 32 that extends farther forward than the cartridge holding portion base wall 32 is opened from above while the front surface cover 50 is in an open condition and serves to guide the ink cartridges 200 toward the front surface opening portion O while the ink cartridges 200 are being mounted.

All of the cartridge mounting mechanisms 100 have substantially the same configuration, so configuration of a representative cartridge mounting mechanism 100 will be described with reference to FIG. 10 in order to facilitate explanation. The needle protection plate 130, the residual ink detecting photo sensor 170, the lock releasing operation rib 150, and the pull-out-lock protrusion 160 are positioned in this order from the side of the ink introducing hollow needle 82 to the front of the ink introducing hollow needle 82 with respect to the lengthwise extending axis of the ink introducing hollow needle 82. The guide protrusion wall 120, the lock releasing operation rib 150, and the residual ink detecting photo sensor 170 sandwich the lengthwise extending axis of the ink introducing hollow needle 82, wherein the guide protrusion wall 120 and the lock releasing operation rib 150 are on one widthwise side and the residual ink detecting photo sensor 170 is on the other widthwise side. The guide protrusion wall 120 extends in the front-rear direction. The lock releasing operation rib 150 is positioned between the front end and the rear end of the guide protrusion wall 120 in the front-rear direction. The needle protection plate 130 is between the front end and the rear end of the guide protrusion wall 120 in the front-rear direction and is positioned further to the rear than the lock releasing operation rib 150. The residual ink detecting photo sensor 170 is also between the front end and the deep end of the guide protrusion walls 120 in the front-rear direction and is positioned deeper in than the lock releasing operation rib 150.

Referring to FIG. 9, the guide protrusion wall 120 and nearest partition wall 110 are separated by same distance La in the left-right direction in all of the cartridge mounting portions Sc, Sy, Sm, and Sk. Further, the guide protrusion wall 120 and the residual ink detecting photo sensor 170 are separated by the same distance Lb1 in the cyan (C) ink cartridge mounting portion Sc, the yellow (Y) ink cartridge mounting portion Sy, and the magenta (M) ink cartridge in the left-right direction. However, the guide protrusion wall 120 and the residual ink detecting photo sensor 170 are separated by a larger distance Lb2 in the black (K) ink cartridge mounting portion Sk than the guide-sensor intervening distance Lb1 for the other ink cartridge mounting portions.

Returning to FIG. 6, the partition walls 110 extend upward from the cartridge holding portion base wall 32 to the under surface of the cover 40. As shown more clearly in FIG. 10, three enlarged portions 112 are formed at the upper portion of each partition wall 110. As can be seen in FIG. 112, the enlarged portions 112 protrude away from the cartridge holding cover portion 44 toward the cartridge holding portion base wall 32. The enlarged portions 112 regulate vertical tilt and position of the ink cartridge after the ink cartridge 200 is inserted. The enlarged portion 112 at the front surface opening portion O side end of each partition wall 110 is formed at the lower side with a taper shape for facilitating insertion of the ink cartridge. The enlarged portion 112 formed at the front-rear center of each partition wall 110 includes a spring 114 for urging the ink cartridge 200 downward and regulating vertical movement of the inserted ink cartridge 200.

Again using the representative example of FIG. 10, the guide protrusion wall 120 protrudes upward from the cartridge holding portion base wall 32 at a position adjacent to the lock releasing operation rib 150. The distance La between the guide protrusion walls 120 and the adjacent partition walls 110 is sufficiently smaller than the thickness of the average user's finger to prevent the user from contacting the lock releasing operation rib 150. Also, the guide protrusion wall 120 serves to guide the ink cartridge 200 inserted from the front surface opening portion O side to the ink cartridge mounting portions S in the front-rear direction while positioning the ink cartridge 200 in the left-right direction. The guide protrusion wall 120 is formed with its front- and rear-side ends thicker than its center so that the guide protrusion wall 120 contacts the ink cartridge 200 substantially at two points that correspond to the thick portions. Positioning in the left-right direction can be precisely performed. It should be noted that guiding and positioning of the ink cartridge 200 can also be performed by the partition walls 110 or could be performed by cooperative operation of the partition walls 110 and the guide protrusion wall 120.

The residual ink detecting photo sensor 170 is made from an infrared light emitting portion 172 and an infrared light receiving portion 174 and is for detecting the amount of residual ink in the ink cartridge 200. The residual ink detecting photo sensor 170 is connected to a circuit board disposed beneath the cartridge holding portion base wall 32. The residual ink detecting photo sensor 170 protrudes above the cartridge holding portion base wall 32 from the circuit board. Sensor guards 176 for protecting the infrared light emitting portion 172 and the infrared light receiving portion 174 protrude upward from the cartridge holding portion base wall 32 from the sides of the infrared light emitting portion 172 and the infrared light receiving portion 174 that are nearer to the front surface opening portion O.

Figure 11:
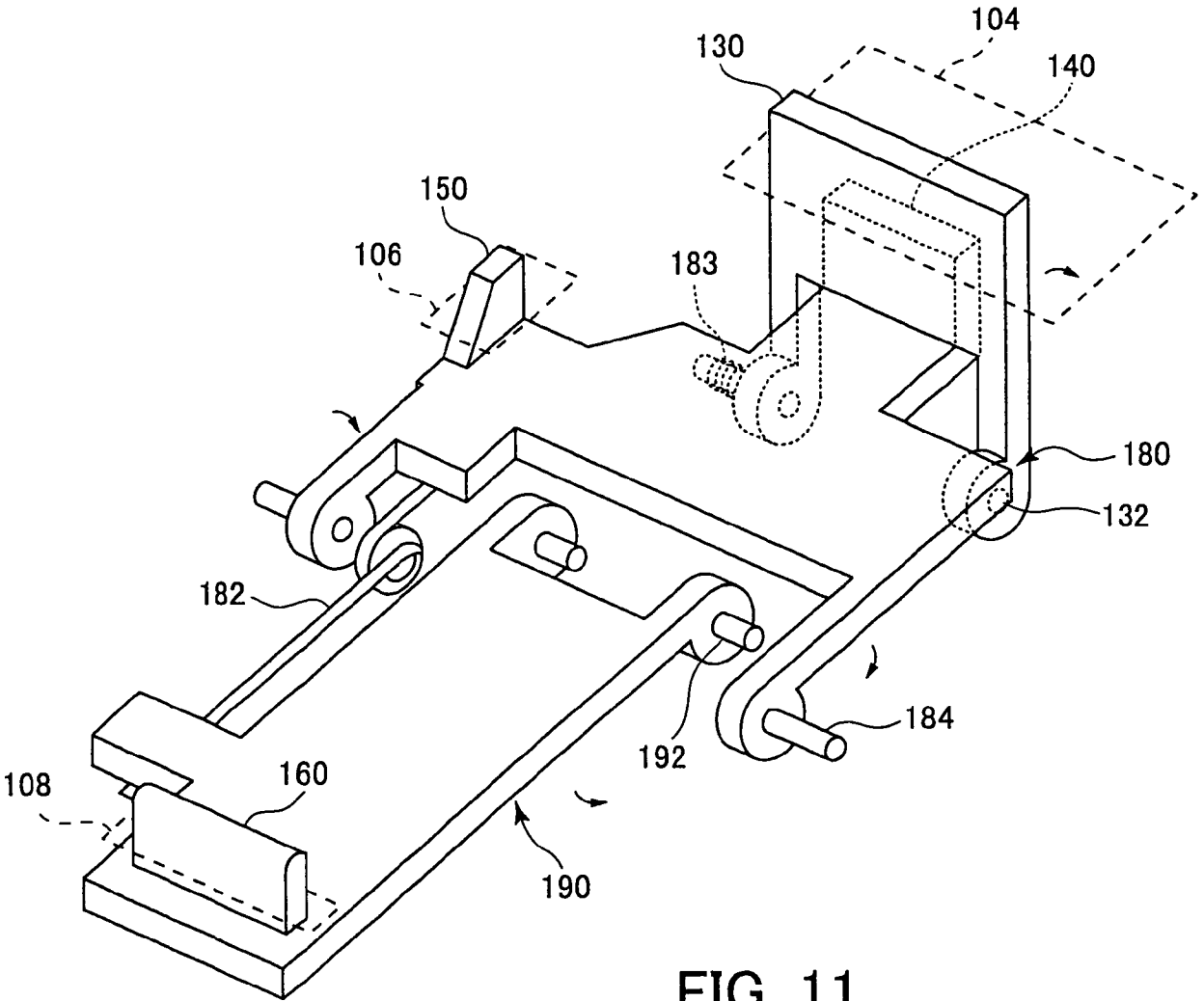
FIG. 11 is a perspective view showing configuration of a mechanism that is provided below the floor surface of the ink cartridge mounting portion and that is for protecting needles, for locking the condition where the needles are protected, and for preventing ink cartridges from falling out of the ink cartridge mounting portion.

The needle protection plate 130 is positioned at the front surface opening portion O side of the ink introducing hollow needle 82 with a space between itself and the ink introducing hollow needle 82. The needle protection plate 130 is for covering the tip of the ink introducing hollow needle 82 from the side confronting the front surface opening portion O. FIG. 11 shows configuration relating to the needle protection plate 130, the lock releasing operation rib 150, and the pull-out-lock protrusion 160 of the representative cartridge mounting mechanism 100 of FIG. 10. The needle protection plate 130 is supported below the cartridge holding portion base wall 32 so as to be pivotable around a needle protection pivot shaft 132 that intersects the front-rear direction. The needle protection plate 130 is movable between a cover position and a release position. In the cover position, the needle protection plate 130 protrudes from an opening 104 formed in the cartridge holding portion base wall 32 to above the cartridge holding portion base wall 32. In the release position, the needle protection plate 130 is retracted within the opening 104. The needle protection plate 130 is constantly urged by a spring 183 into the cover position. The lock member 180 is supported pivotable around a shaft 184 below the cartridge holding portion base wall 32. A pressing plate 140 rises up from one end of the lock member 180. The lock member 180 is urged by a spring 182 in a direction to move the pressing plate 140 into confrontation with the ink introducing hollow needle 82 side surface of the needle protection plate 130. The lock member 180 integrally includes the lock releasing operation rib 150 in between the shaft 184 and the pressing plate 140. The urging force of the spring 182 protrudes the lock releasing operation rib 150 from an opening 106 formed in the cartridge holding portion base wall 32 between the guide protrusion walls 120 and the partition walls 110.

In this condition, when the ink cartridge 200 is inserted from the front surface opening portion O, as will be described later the lower side of the ink cartridge 200 first presses the lock releasing operation rib 150 so that the lock member 180 pivots and the pressing plate 140 retracts downward from the back surface of the needle protection plate 130. When the ink cartridge 200 is moved further in the front-rear direction of the mounting portion the front surface of the ink cartridge 200 presses the needle protection plate 130. However, because the pressing plate 140 was retracted below the back surface of the needle protection plate 130, the needle protection plate 130 is not block from pivoting and so drops into the opening 104 so that the ink cartridge 200 can connect with the ink introducing hollow needle 82.

In the reverse operation of removing the ink cartridge 200 from the ink cartridge mounting portion S, the spring 183 moves the needle protection plates 130 upright at the position covering the ink introducing hollow needle 82. Then the spring 182 returns the pressing plate 140 to the back surface of the needle protection plate 130.

Unless the lock releasing operation rib 150 is being pressed down, the back surface of the needle protection plate 130 will abut the pressing plate 140 so the ink introducing hollow needle 82 will not be exposed to the front surface opening portion O, even if an external force is applied from the front surface opening portion O side of the needle protection plate 130.

A leak preventing lock member 190 is provided for applying resistance against the urging force by the spring 94 of the positive pressure application members 91, which urges the mounted ink cartridge 200 in a direction to pull out of the ink cartridge mounting portion S. The leak preventing lock member 190 includes the pull-out-lock protrusion 160, which is capable of protruding above the cartridge holding portion base wall 32 from an opening 108 formed in the cartridge holding portion base wall 32. The leak preventing lock member 190 is supported pivotable around a shaft 192 below the cartridge holding portion base wall 32. The leak preventing lock member 190 is urged upward by the spring 182. Normally, the protrusion 160 protrudes upward above the cartridge holding portion base wall 32 from the opening 108 and fits in a leak preventing lock indentation 246 (FIG. 18) to be described later of the ink cartridges 200 that is in its mounted position. However, as will be described later, when the ink cartridge 200 abuts the protrusion 160 by force generated when the ink cartridge 200 is attached or detached, the leak preventing lock member 190 pivots around the shaft 192 so that the protrusion 160 retracts downward and the ink cartridge 200 can be attached or detached.

Figure 12:
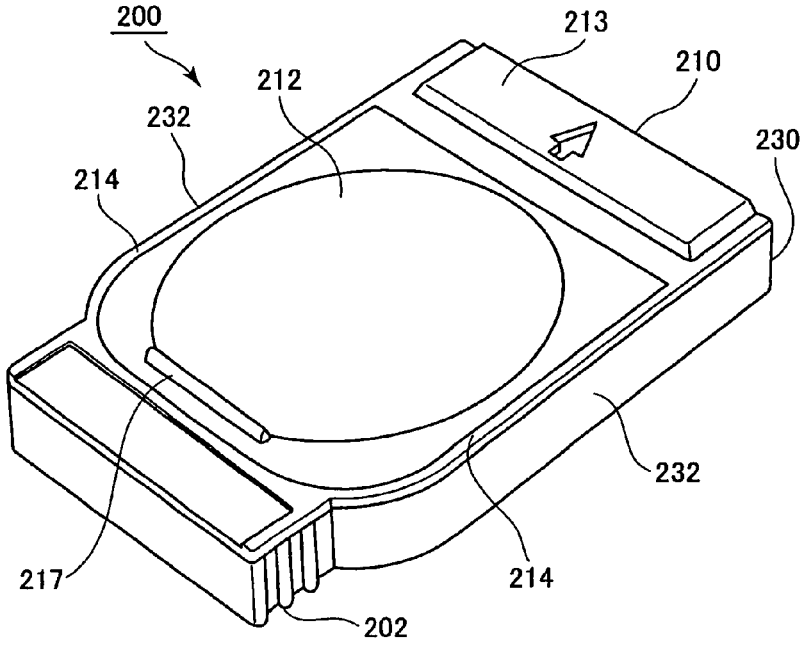
FIG. 12 is a perspective view showing an ink cartridge according to the present embodiment from the rear end.

The cyan, yellow, magenta, and black ink cartridges 200 of the present embodiment all have the shape shown in FIG. 12. That is, all are made from a main case 230 and a lid 210 made from a substantially transparent resin. Overall the ink cartridge 200 has a flat and substantially parallelepiped shape. It should be noted that the cyan, yellow, and magenta ink cartridges 200 (color ink cartridges) have substantially the same size. The black ink cartridge 200 has substantially the same length as the color ink cartridges 200. However, the width of the black ink cartridge is wider than that of the color ink cartridges.

Next, an explanation will be provided for the ink cartridges 200 of the present embodiment while referring to the representative example shown in FIGS. 12 to 39. The main case 230 includes flat side walls 232 on both sides in the left-right direction. The distance between the side walls 232, that is, the width of the main case 230, corresponds to the distance between the partition walls 110 provided to both sides of the ink cartridge mounting portion S.

The lid 210 has a substantially flat shape with a spherical outward curved portion 212, which is curved outward in a spherical shape, provided at its substantial center portion. A flat-shaped protrusion portion 213 is formed from a raised up front end of the lid 210 except at left and right ends. A flat portion 214 is formed at the left and right sides of the protrusion portion 213 and around the spherical outward curved portion 212 of the lid 210. The portion of the flat portion 214 positioned to the left and right of the protrusion portion 213 and of the spherical outward curved portion 212 extends in the lengthwise (front-rear) direction of the ink cartridges 200. When the ink cartridge 200 is inserted into the ink cartridge mounting portion S, the front-rear extending portion of the flat portion 214 slides against the spring 114 in confrontation with the underside of the enlarged portions 112. The curved portion 212 and the protrusion portion 213 protrude toward and are closer to the lower surface of the cartridge holding cover portion 44, that is, the ceiling surface, than are the lower surfaces of the enlarged portions 112, which are positioned on either side of the curved portion 212 and the protrusion portion 213. The curved portion 212 and the protrusion portion 213 extend higher toward the cartridge holding cover portion 44 than the flat portion 214. When the ink cartridge 200 is mounted in the recording device, the curved portion 212 and the protrusion portion 213 regulate height wise position of the ink cartridge 200 when the ink cartridge 200 is inserted through the front surface opening portion O.

The ink cartridge 200 is formed sufficiently longer than the length in the front-rear direction of the cartridge holding cover portion 44 so that the rear end portion protrudes from the cartridge holding cover portion 44 when the ink cartridge 200 is in a mounted condition in the mounting portion S. The rear end portion of the ink cartridge 200 is a grasping portion 202 that is slightly narrower width that the other areas. As shown in FIG. 6, a desired single ink cartridge 200 can be easily grasped and taken out when plural ink cartridges 200 are housed in the ink cartridge holding portion P. Contrarily, an ink cartridge 200 can be grasped and easily mounted even when an ink cartridge 200 is housed adjacent thereto in ink cartridge holding portion P. A rib 217 is formed near the rear end of the lid 210 so as to extend linearly in the left-right direction. Accordingly, by snagging his or her finger on the rib 217 and pulling the ink cartridge 200 forward, the user can pull the ink cartridge 200 out of the ink cartridge holding portion P using a single finger.

Figure 13:
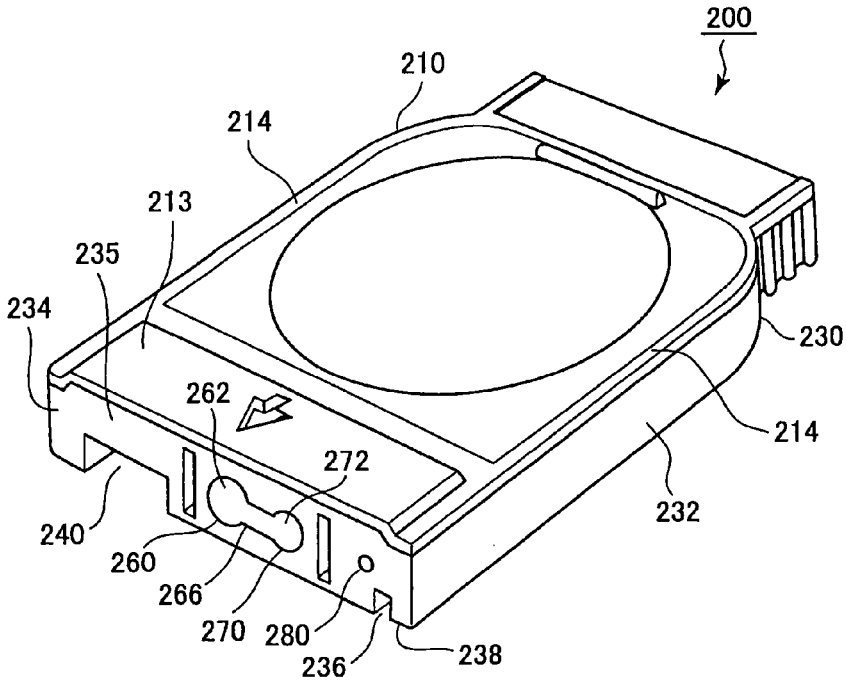
FIG. 13 is a perspective view of the ink cartridge according to the present embodiment from the front end.

As shown in FIG. 13, a protrusion portion 235 is formed on a front surface wall 234 of the main case 230. The protrusion portion 235 protrudes upward at the left-right central region of the front surface wall 234. An ink supply hole 260 is formed in the substantial center of the front surface wall 234. The ink supply hole 260 is a hole for supplying ink from an ink accommodation portion 300 (FIG. 14) provided in the main case 230 to outside. An ink supply rubber plug 262 (FIG. 39(*a*)) is press-fit mounted in the ink supply hole 260. An ink injection hole 270 is opened next to the ink supply hole 260. An ink injection rubber plug 272 (FIG. 39(*a*)) is press-fit mounted in the ink injection hole 270. Further, an atmosphere connection hole 280 is also opened in the front surface wall 234. The atmosphere connection hole 280 is a small-diameter, long and thin hole that is in fluid communication with the positive pressure hole 98 of the positive pressure application members 91 when the ink cartridge 200 is mounted in the ink cartridge mounting portion S. Further, a guide groove 236 and a sensor accommodation groove 240 are formed in the front surface wall 234 and across the lower wall of the main case 230 so as to be open in the front surface and the lower surface. The guide groove 236 is an indented portion for engaging with the guide protrusion wall 120 when the ink cartridge 200 is mounted in the ink cartridge mounting portion S. A lock release portion 238 is defined by the lower rear surface of the ink cartridge 200 that is between the guide groove 236 and the nearby side wall 232. The guide groove 236 and the lock release portion 238 are provided near the portions of the ink cartridge 200 that correspond to the enlarged portions 112 of the recording device. The lock release portion 238 functions to press the lock releasing operation rib 150 when the ink cartridge 200 is mounted in the ink cartridge mounting portion S. The sensor accommodation groove 240 is an indented portion in a contour of the outer shape of the ink cartridge 200 and accommodates the residual ink detecting photo sensor 170 when the ink cartridge 200 is mounted in the ink cartridge mounting portion S.

Figure 14:
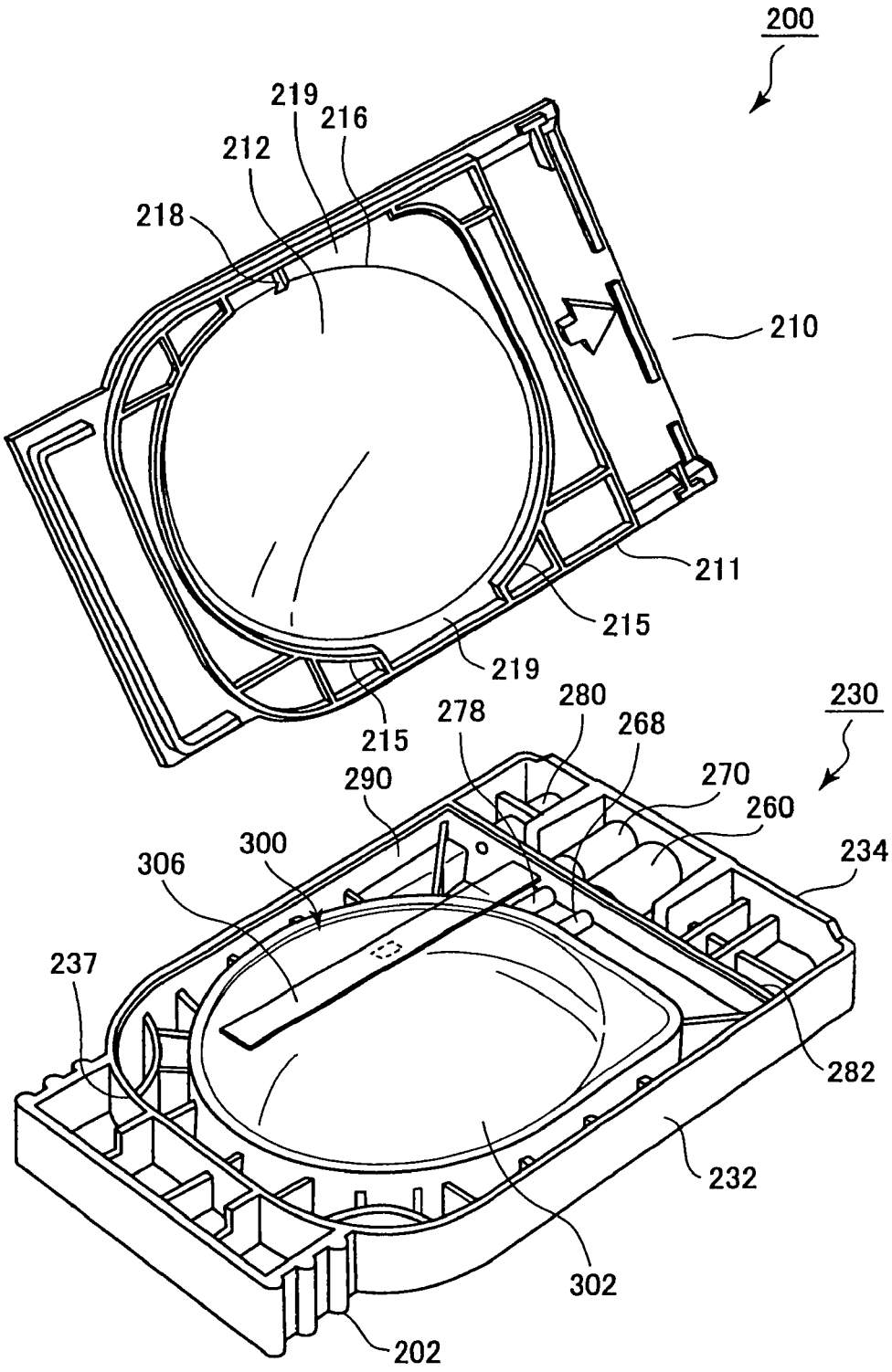
FIG. 14 is a perspective view showing the ink cartridge with its lid separated from its main case.

As shown in FIG. 14, the main case 230 includes an ink accommodation portion 300 at its inside and is open at its upper side. Described in more detail, the main case 230 includes the front surface wall 234, the side walls 232, and a rear surface wall 237. The side walls 232 are on left and right sides of the main case 230. The side walls 232 are connected to the front surface wall 234 and the rear surface wall 237. The grasping portions 202 are formed to the rear of the rear surface wall 237. The ink accommodation portion 300 is surrounded by the front surface wall 234, the side walls 232, and the rear surface wall 237. The ink accommodation portion 300 is configured with a flexible film 302 at an ink-holding portion 310 (FIG. 15) to be described later. The ink-holding portion 310 is formed at the inside of the main case 230. The flexible film 302 is welded onto an opening peripheral edge 312 of the ink-holding portion 310. Ink is held in between the flexible film 302 and the ink-holding portion 310. While the ink cartridge 200 is filled with ink, the flexible film 302 expands upward into a curved surface. The ink supply hole 260 and the ink injection hole 270 are in fluid communication with the inside of the ink accommodation portion 300. Described in more detail, the ink supply hole 260 is in fluid communication with the ink accommodation portion 300 through a small-diameter ink supply connection pathway 268. The ink injection hole 270 is in fluid communication with the ink accommodation portion 300 by the through a small-diameter ink injection connection pathway 278 from the ink injection hole 270.

A substantially rectangular plate shaped tension plate 306 is provided on the flexible film 302 so that its lengthwise direction extends in parallel with the lengthwise (front-rear) direction of the ink cartridge 200. The tension plate 306 is adhered at its lengthwise center portion to the substantial center portion of the flexible film 302 by two-sided adhesive tape.

It should be noted that the lengthwise direction cross sectional shape (FIG. 21) of the case body is the same whether for black or color ink cartridges. Because the tension plate 306 is adhered in the lengthwise direction, an equal tension can be applied by preparing and adhering tension plates 306 with the same length for all color ink cartridges. The length of the tension plate 306 is formed slightly shorter than the dimension of the ink accommodation portion 300 in the lengthwise direction. The material of the tension plate is a film made from resin such as PET film. It should be noted that detailed operation of the tension plate 306 will be described later.

An atmosphere chamber 290 in fluid communication with the atmosphere connection hole 280 is formed in the periphery of the ink accommodation portion 300. Described in more detail, a partition wall 282 is formed at the rear side of the front surface wall 234. The partition wall 282 connects the side walls 232. Also, an outside protrusion wall 211 is formed from the flat portion 214 of the lid 210. The outside protrusion wall 211 is for coupling with the partition wall 282, the side walls 232, and the rear surface wall 237 of the main case 230. When the lid 210 is attached to the main case 230 and the outside protrusion wall 211 is coupled with the partition wall 282, the side walls 232, and the rear surface wall 237, then the atmosphere chamber 290 will be encompassed by the partition wall 282, the side walls 232, and the rear surface wall 237 and moreover defines a region (covered by the lid 210) that surrounds the ink accommodation portion 300. The atmosphere chamber 290 is in a substantially sealed condition in communication with the outside only through the atmosphere connection hole 280. Here, the atmosphere connection hole 280 is a through hole that extends between the front surface wall 234 and the partition wall 282 and that is opened to the front surface wall 234 and the partition wall 282. Also, the ink supply connection pathway 268 and the ink injection connection pathway 278 penetrate through the partition wall 282 and are in fluid communication with the ink accommodation portion 300. When the lid 210 is attached on the main case 230 and covers the opening of the main case 230, the atmosphere chamber 290 is in fluid communication with atmosphere through only the atmosphere connection hole 280. By applying atmospheric or positive pressure to the atmosphere chamber 290, pressure can be applied to the flexible film 302 of the ink accommodation portion 300 from the external side of the ink accommodation portion 300 so that ink in the ink accommodation portion 300 can be supplied to outside of the ink cartridge 200 through the ink supply hole 260.

It should be noted that a plurality of ribs 292 (FIG. 15) are formed in the inside of the atmosphere chamber 290 so that the strength of the main case 230 is increased.

FIG. 14 shows the inner surface of the lid 210 that is attached to the ink cartridge 200. As is clear from the drawing, the lid 210 is substantially flat. The spherical outward curved portion 212 that is formed in the central portion of the lid 210 has a shape that encompasses the bulge of the flexible film 302. An annular portion of the flat portion 214 has a predetermined width (in the left-right direction) that encompasses the spherical outward curved portion 212 and defines an ink accommodation periphery portion 216 to be described later. A groove-shaped notch 218 is formed so as to cut through the ink accommodation periphery portion 216. When the lid 210 is coupled to the main case 230, a space develops between the ink accommodation periphery portion 216 and the flexible film 302 that is adhered to the opening peripheral edge 312. When the ink cartridge is vacuum packaged in a manner to be described later, the lid 210 and the main case 230 flexibly deform toward each other. Even if the lid side of the ink accommodation periphery portion 216 comes into intimate contact with the flexible film 302, the groove-shaped notch 218 and protrusion wall notches 219 to be described later serve to bring the space between the spherical outward curved portion 212 and the flexible film 302 into fluid communication with the atmosphere chamber 290. Also, a protruding wall 215 is formed at the inner side of the outside protrusion wall 211, which is the outer side of the ink accommodation periphery portion 216 The protruding wall 215 extends and protrudes from the flat portion 214 so as to encompass the ink accommodation periphery portion 216. The protruding wall 215 is located so as to, when the lid 210 is mounted on the main case 230, encompass the outer periphery of the opening peripheral edge 312 to be described later with reference to FIG. 27. The protruding wall 215 is discontinuous at portions that follow the side walls 232 and that approach and connect to the outside protrusion wall 211. These discontinuous portions of the protruding wall 215 define the protrusion wall notches 219. One protrusion wall notch 219 is located adjacent the groove-shaped notch 218 and the other protrusion wall notch 219 is located opposite from the groove-shaped notch 218 in the left-right direction. The protrusion wall notches 219 also function to bring the space between the spherical outward curved portion 212 and the flexible film 302 into fluid communication with the atmosphere chamber 290 and to prevent positive pressure from the atmosphere connection hole 280 from being blocked by the protruding wall 215.

Figure 15:
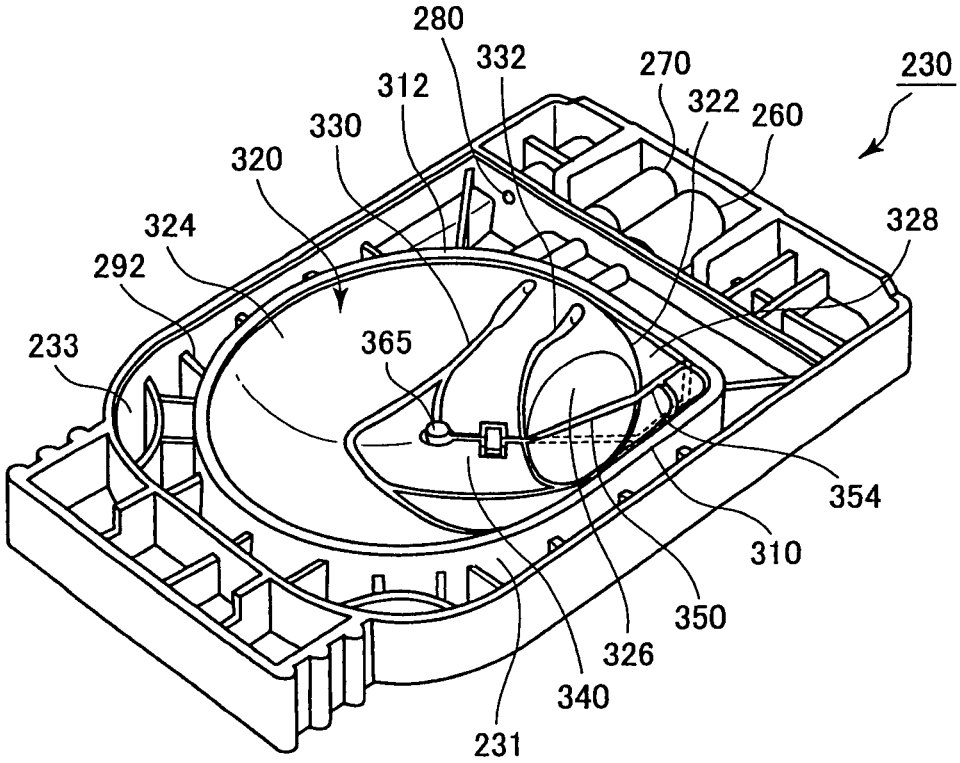
FIG. 15 is a perspective view showing the main case before a flexible film is attached thereto.

As shown in FIG. 15, the ink-holding portion 310 is encompassed by the opening peripheral edge 312 and includes an tub portion 320. The tub portion 320 is open at the upper surface. The opening peripheral edge 312 has a circular or ellipsoidal shape that bulges outward at one portion 328. The tub portion 320 includes a curved surface portion 324 that curves downward in a substantial curved shape from a circular (or ellipsoidal) shaped encompassing edge 322. The encompassing edge 322 is positioned at the same height as the opening peripheral edge 312. The substantial center of the curved surface portion 324 is the lowest position. The curved surface portion 324 includes a slanted surface portion 326 that is flat (not curved). The horizontally-extending flat shoulder portion 328, which bulges to the outside of the opening peripheral edge 312, is formed between the opening peripheral edge 312 and the circular (or ellipsoidal) encompassing edge 322. Because the flexible film 302 is attached to the opening peripheral edge 312 so as to cover the tub portion 320, ink is stored between the flexible film 302, the curved surface portion 324 including the slanted surface portion 326, and the flat shoulder portion 328.

The height of the flat shoulder portion 328 substantially matches the height of the opening peripheral edge 312 so that the flexible film 302 bulges only a small amount above the flat shoulder portion 328. With this configuration, while the lid 210 is mounted on the main case 230 the user can visually confirm the color of the ink from above the lid 210 by viewing the color of the ink accumulated between the flat shoulder portion 328 and the flexible film 302. Said differently, when the tub portion 320 is full of ink, the color of the ink in the tub portion 320 appears substantially black because the layer of ink is thick. However, the actual color of the ink can be viewed at the thin ink layer between the flat shoulder portion 328 and the flexible film 302.

The flexible film 302 is preformed into a curved shape that intimately contacts the inner surface of the ink-holding portion 310 when almost no ink is in the ink-holding portion 310. The method for manufacturing the flexible film 302 in this shape will be described later. Because the flexible film 302 is shaped in this manner, the flexible film can softly and gradually deform following the amount of ink from when ink completely fills between the flexible film 302 and the ink-holding portion 310 to when almost no ink is in the ink-holding portion 310. Almost no pressure operates on the ink from the flexible film itself, for example, by resilient contraction.

An air removing/ink supply groove 332 is formed in the base surface of the tub portion 320. The air removing/ink supply groove 332 is in fluid communication with an ink injection groove 330, which is in fluid communication with the ink injection hole 270 (the ink injection connection pathway 278), and the ink supply hole 260 (the ink supply connection pathway 268). A sensing mechanism 340 is further provided to the base surface of the tub portion 320. The sensing mechanism 340 is for detecting the residual amount of ink remaining on the tub portion 320.

Figure 16:
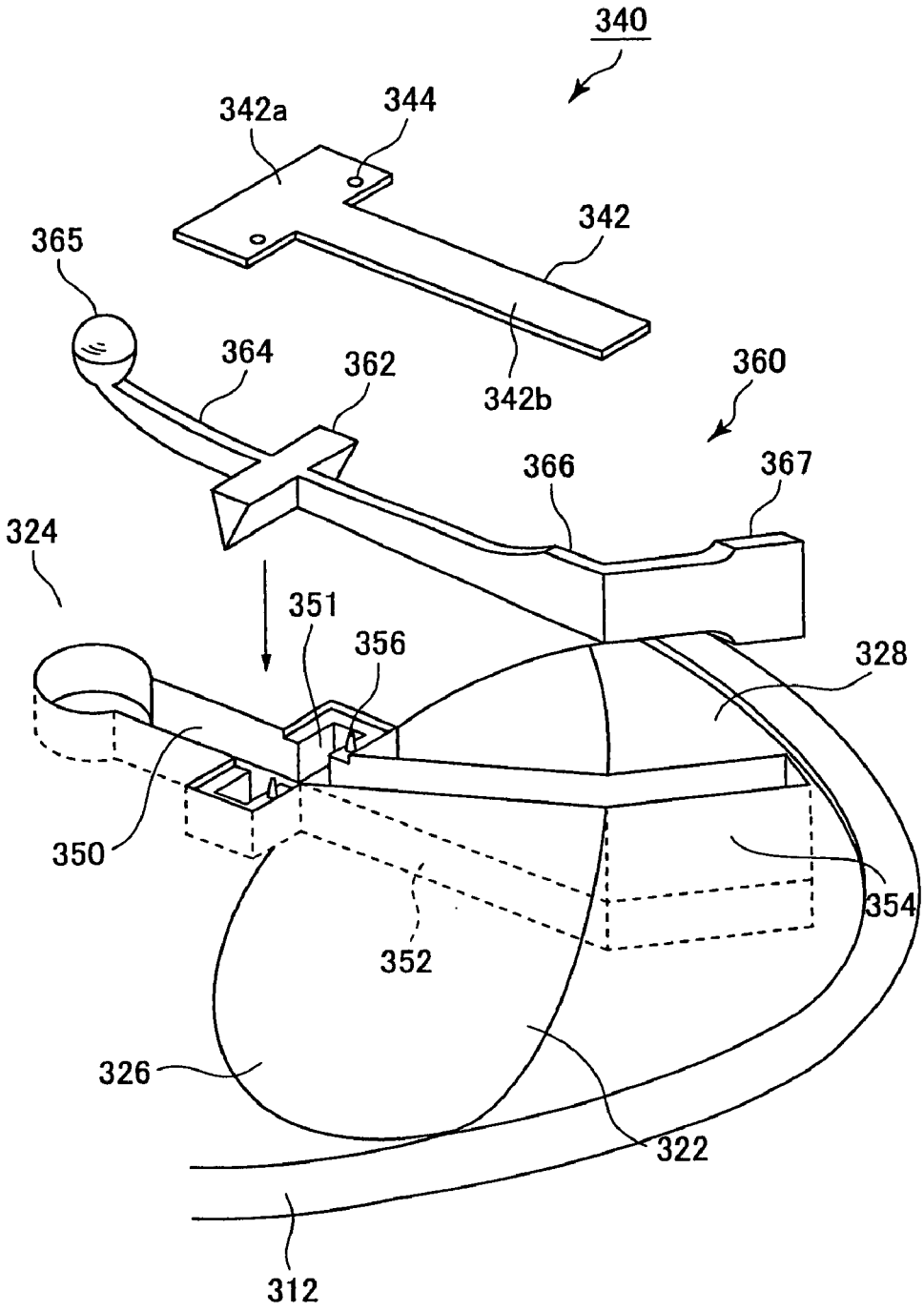
FIG. 16 is an exploded perspective view showing a sensing mechanism provided in an indentation portion of the main case.
Figure 17:
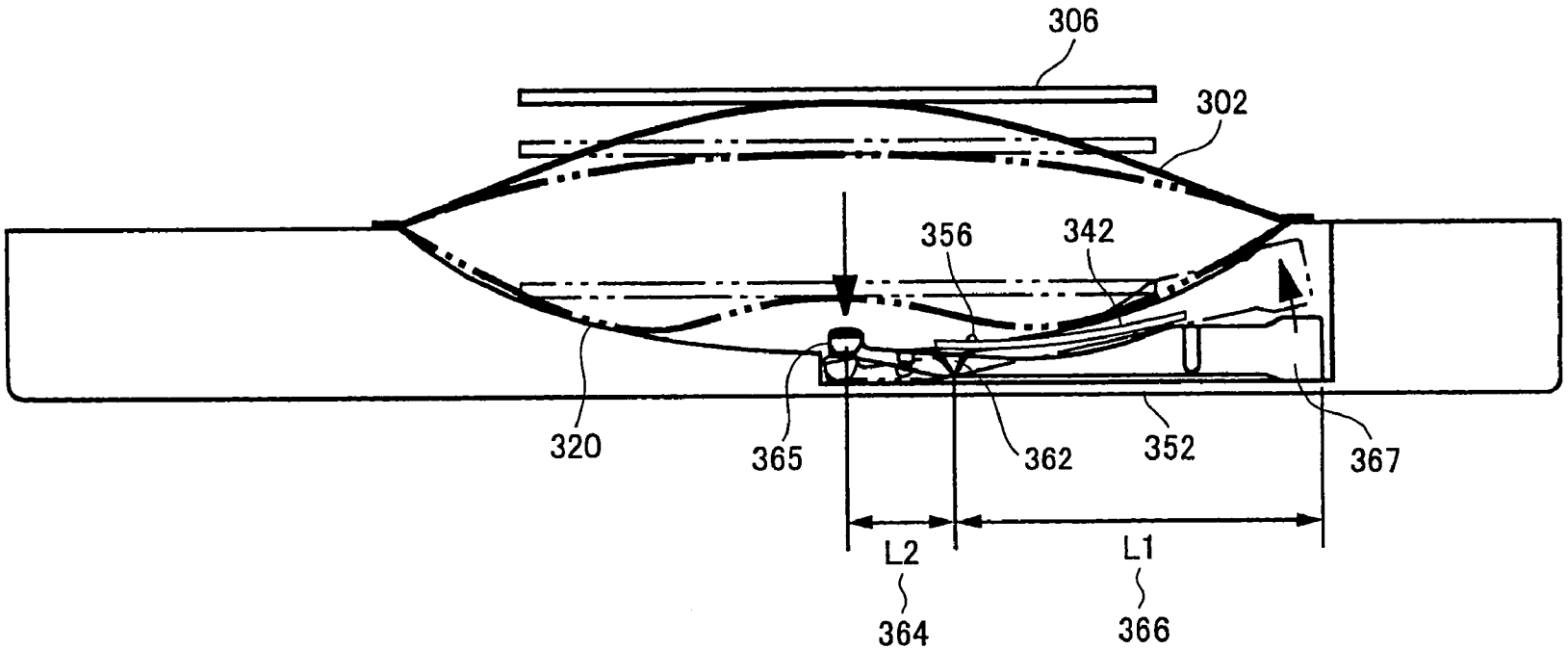
FIG. 17 is an operational diagram indicating operation of the sensing mechanism of FIG. 16.

As shown in FIG. 16, the sensing mechanism 340 is made from a sensor lever accommodation groove 350, a sensor lever 360, and a suppressing film 342. The sensor lever 360 is disposed within the sensor lever accommodation groove 350. The suppressing film 342 has a T shape. The sensor lever accommodation groove 350 is opened in the base surface of the tub portion 320. The sensor lever accommodation groove 350 has a base surface 352 that follows the lower surface (FIG. 18) of the main case 230. The sensor lever accommodation groove 350 is formed so as to extend in a direction that is shifted 45 degrees with respect to the lengthwise (front-rear) direction of the case body from the central position of the curved surface portion 324 of the tub portion 320, to bend 45 degrees where it reaches the circular (or ellipsoidal) encompassing edge 322 of the tub portion 320, and then to extend parallel with the lengthwise direction of the case body. The portion of the sensor lever accommodation groove 350 that extends in parallel with the lengthwise direction of the case body is called the groove portion 354 and is open upward at the flat shoulder portion 328. In this way, the sensor lever accommodation groove 350 is open so as to extend in a direction shifted 45 degrees from the lengthwise direction of the case body at positions from the center portion of the curved surface portion 324 of the tub portion 320 to the slanted surface portion 326 and is open so as to extend parallel with the lengthwise direction of the case body at the upper surface of the flat shoulder portion 328. The depth of the sensor lever accommodation groove 350 is substantially fixed at the curved surface portion 324, rapidly increases at the slanted surface portion 326, and again is substantially fixed at the flat shoulder portion 328. The groove portion 354 of the sensor lever accommodation groove 350 extends outside of the tub portion 320, follows the wall that protrudes to the inside of the sensor accommodation groove 240 and reaches the Inside of the sensor accommodation groove 240, thereby forming a protrusion portion 372 shown in FIG. 18. Also, the sensor lever accommodation groove 350 has a groove 351 that intersects the lengthwise direction.

The sensor lever 360 has a specific gravity that is higher than the specific gravity of ink and is formed from a black colored resin that can block infrared light. The sensor lever 360 is disposed within the sensor lever accommodation groove 350. The sensor lever 360 is an elongated plate-shaped member having a pivot fulcrum portion 362, an operation arm portion 364, and a sensing arm portion 366. The pivot fulcrum portion 362 has the shape of a triangular prism. The operation arm portion 364 and the sensing arm portion 366 extend from on opposite sides of the pivot fulcrum portion 362. A semispherical pivot 365 (an ink residual amount detection point) is provided at the end portion of the operation arm portion 364. The sensor lever 360 is disposed within the sensor lever accommodation groove 350 so that the semispherical pivot 365 is disposed in the center position of the curved surface portion 324 of the tub portion 320. As a result, the semispherical pivot 365 is disposed at the lowest position of the curved surface portion 324. The sensing arm portion 366 is bent at a 45 degree angle near its end, thereby forming a bent end portion 367, which is positioned in the groove portion 354 of the sensor lever accommodation groove 350 (the portion opened at the flat shoulder portion 328) and functions as a sensing point. The pivot fulcrum portion 362 is disposed inside the intersecting groove 351 of the sensor lever accommodation groove 350. The apex of the triangular cross section of the pivot fulcrum portion 362 sinks in the ink so as to contact the bottom of the intersecting groove 351. As a result, the sensor lever 360 can pivot with the pivot fulcrum portion 362 as a fulcrum. Here, the weight of the sensing arm portion 366 is greater than the weight of the operation arm portion 364. In this example, the weight of the sensing arm portion 366 is five times or greater than the weight of the operation arm portion 364. For this reason, when sufficient ink remains, the sensing point 367 of the sensor lever 360 is positioned on the base surface 352 of the sensor lever accommodation groove 350 as indicated by solid line in FIG. 17. The semispherical pivot 365 (ink residual amount detection point) ink floats up from the base surface 352 and protrudes over the bottom of the tub portion 320. On the other hand, when ink is used up so that the flexible film 302 moves down toward the tub portion 320, the flexible film 302 presses down the semispherical pivot 365 (ink residual amount detection point) as shown by two-dot chain line in FIG. 17 so that the bent end portion 367 (sensing point) rises up. Because the sensor lever 360 is accommodated in this way in the sensor lever accommodation groove 350, which extends out from the tub portion 320 from under the tub portion 320, the sensor lever 360 does not block the flexible film 302 as the flexible film 302 deforms toward the tub portion 320. Therefore, detection of residual ink can be more reliably performed.

Also, the length L1 of the sensing arm portion 366 of the sensor lever 360 is longer than the length L2 of the operation arm portion 364. In this example, the length L1 of the sensing arm portion 366 is about four times the length L2 of the operation arm portion 364. Accordingly, even if the flexible film 302 lowers the semispherical pivot 365 (ink residual amount detection point) only a slight bit, the bent end portion 367 will rise up a great deal so that detection using a residual amount detection sensor 70 to be described later can be reliably performed.

The PET film tension plate 306 insures that the sensor lever 360 will reliably operate when almost no ink remains unused so that ink can be used up to the maximum. That is, if the tension plate 306 were not provided, then wrinkles could develop in one portion of the flexible film 302 as the flexible film 302 lowers down in association with reduction in ink and the flexible film 302 comes into intimate contact with the tub portion 320. In this case, the sensor lever 360 would be activated while ink remains between the wrinkled portion and the tub portion 320 so that ink is not used up.

However, in the present embodiment, only the center portion of the tension plate 306, that is, the portion that confronts the semispherical pivot 365 of the sensor lever 360, is connected to the center portion of the flexible film 302. The tension plate 306 rides on top of the bulging flexible film 302 as indicated by solid line in FIG. 17 when there is a great deal of ink in the tub portion 320. The tension plate 306 moves downward in association with reduction in ink. However, when a small amount of ink remains, both ends of the tension plate 306 abut against the inner peripheral surface of the tub portion 320 at a position lower than the opening peripheral edge 312 and higher than the lowest position of the tub portion 320 so that the tension plate 306 is restricted from moving further downward. As a result, although the peripheral portion of the flexible film 302 is in intimate contact following the inner peripheral surface of the tub portion 320, the center portion of the flexible film 302 is raised up because of the tension plate 306. At this time, the center portion of the raised-up flexible film 302 confronts the semispherical pivot 365 of the sensor lever 360 with a spaced opened up therebetween.

When the amount of ink is further reduced, the center portion of the flexible film 302 moves further down against the resilience of the tension plate 306. However, once the amount of ink in the tub portion is reduced to less than a predetermined amount range so that hardly any ink remains, the flexible film 302 overcomes the urging force of the tension plate 306 so that the center portion of the flexible film 302 presses against the semispherical pivot 365 of the sensor lever 360. At this time, the surface area of the peripheral portion of the flexible film 302 that is in intimate contact following the inner peripheral surface of the tub portion 320 gradually increases until the center of the flexible film 302 presses the sensor lever 360. That is, the tension plate 306 prevents wrinkles from being generated in the flexible film 302 along the way. Also, the flexible film 302 moves down while ink is collected in the center portion of the tub portion 320. Therefore, the sensor lever 360 will reliably operate in the condition wherein almost no ink remains unused.

The tension plate 306 need not be formed in the substantial rectangular shape described above, but could be triangular shaped, star shaped, circular shaped, or any optional shape as long as its shape enables opening a space between the flexible film 302 and the semispherical pivot 365 of the sensor lever 360 when downward movement is restricted as described above. Further, the outer peripheral portion of these different shaped members need not abut the inner peripheral surface of the tub portion 320, but could be placed on the opening peripheral edge 312.

It is desirable that the tension plate 306 have resilience and weight that does not apply influence to the pressure in the ink accommodation portion 300. However, pressure in the ink accommodation portion 300 can be adjusted by appropriately setting the resilience and weight. When there is a great deal of ink, the weight of the tension plate 306 applies positive pressure to the inside of the ink accommodation portion 300 because the tension plate 306 contacts only the center of the flexible film 302. When only a little ink remains, then the tension plate 306 functions as a beam to lift up the central portion of the flexible film 302. As a result, a negative pressure is applied to the ink accommodation portion 300. By adjusting the spring force (which relates to negative pressure when little ink remains), weight (which relates to positive pressure when a great deal of ink remains), and length (which relates to timing of the switch from application of positive pressure to the application of negative pressure) of the tension plate 306, a pressure that is appropriate with the consumption condition of ink can be applied to the ink accommodation portion 300.

In the embodiment, the tension plate 306 is connected to the flexible film 302 so as to move following the flexible film 302 until only a slight amount of ink remains. On the other hand, the tension plate 306 is restricted from moving downward by the tub portion 320 when only a little ink remains and has resilience that urges the flexible film 302 in a direction away from the pivot (ink residual amount, detection point) 365. The tension plate 306 allows portions of the flexible film 302 other than portions in confrontation with the pivot (ink residual amount detection point) 365 to follow the tub portion 320 at least after a slight amount of ink remains. However, the tension plate 306 urges portions of the flexible film 302 that confront the pivot (ink residual amount detection point) 365 in the direction away from the pivot (ink residual amount detection point) 365. Moreover, in association with reduction in ink after a slight amount of ink remains, the tension plate 306 approaches toward the pivot (ink residual amount detection point) 365 against the urging of the tension plate 306. In this way, ink can be reliably used up.

As shown in FIG. 16, the T-shaped suppressing film 342 is made from PET and is provided to press the sensor lever 360 downward into the sensor lever accommodation groove from above the sensor lever 360. Explained in more detail, the suppressing film 342 has an integral fixed portion 342*a* and resilient plate portion 342*b*. The resilient plate portion 342*b* presses the sensing arm portion 366. Of the sensor lever accommodation groove 350, the groove 351 which accommodates the pivot fulcrum portion 362 is formed with a level difference. A pair of holes 344 are formed in the fixed portion 342*a*. By fitting a pair of protrusions 356 into the pair of holes 344 and crushing the pair of protrusions 356, the fixed portion 342*a* can be fixed to the tub portion 320. By this, the pivot fulcrum portion 362 is supported in the intersecting groove 351 with a space opened between itself and the T-shaped suppressing film 342. The sensor lever 360 can be freely pivoted with the pivot fulcrum portion 362 as a fulcrum. The resilient plate portion 342*b* is disposed inserted inside the sensor lever accommodation groove 350 so as to extend toward to the sensing arm portion 366 from the fixed portion 342*a*. By this, the sensing arm portion 366 moves down by the resilient plate portion 342*b*. That is, because the semispherical pivot 365 is urged to protrude above the bottom surface of the tub portion 320, the semispherical pivot 365 can be reliably protruded above the base surface of the tub portion 320 even if the ink cartridge is turned upside down during transport of the ink cartridge. It should be noted that the resilience of the resilient plate portion 342*b* is large enough to block further rising movement of the sensing arm portion 366 in association with reduction in ink.

It should be noted that the portion of the sensor lever accommodation groove 350 that accommodates the sensing arm portion 366 is formed in the slanted surface portion 326. Because the slant of the slanted surface portion 326 is greater than the slant of the spherical surface portion, the sensing arm portion 366 can move upward by a sufficient amount without contacting and being obstructed by the flexible film 302.

Figure 18:
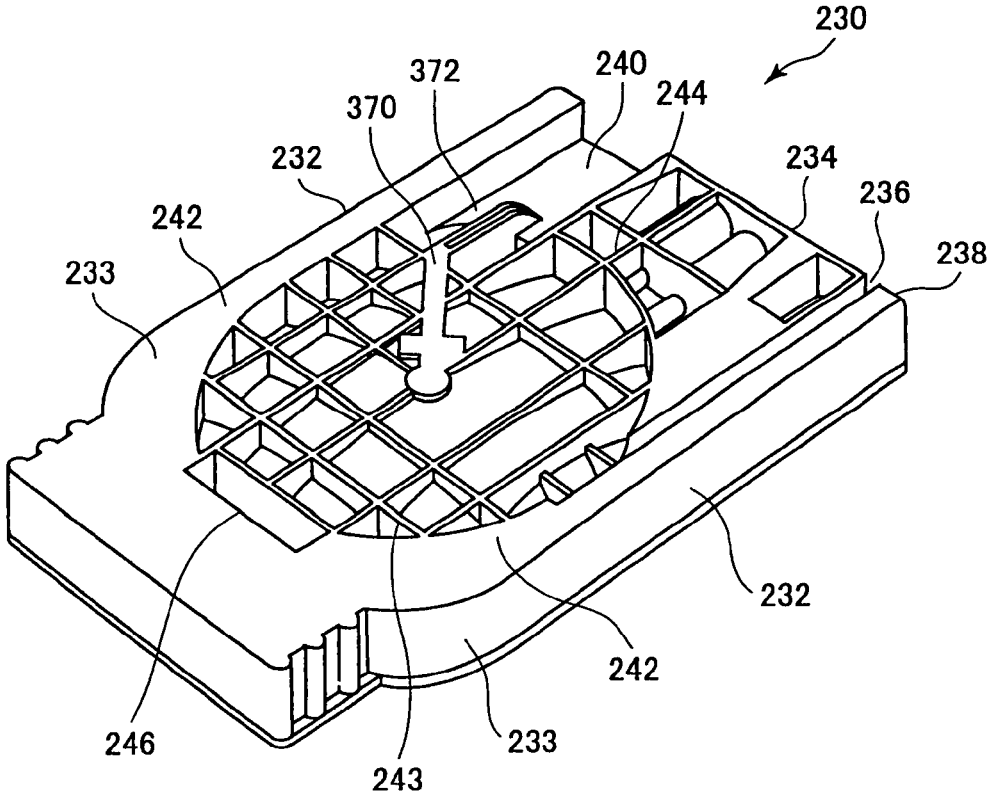
FIG. 18 is an underside view of the main case.
Figure 30:
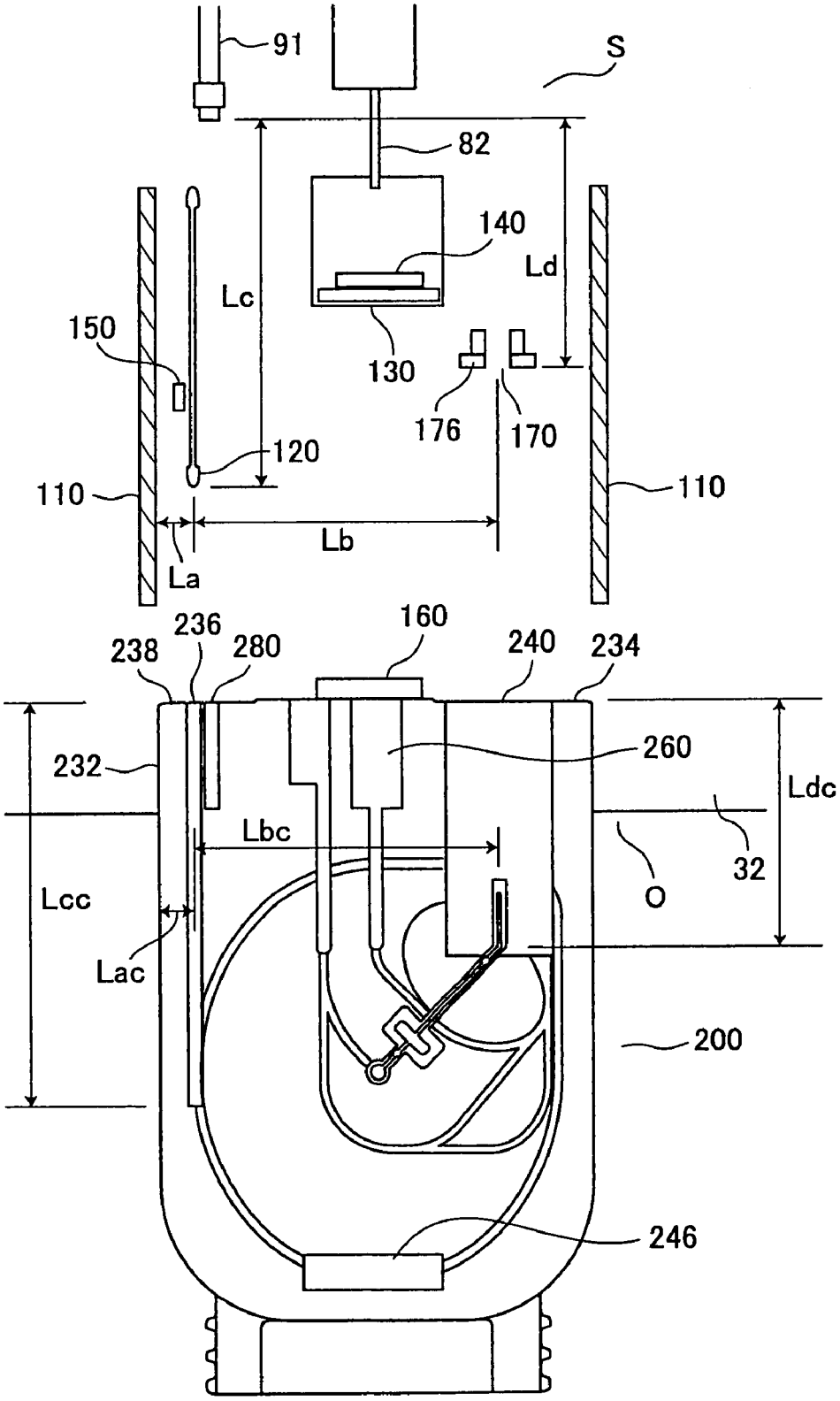
FIG. 30 is a plan view showing a condition wherein a pull-out lock protrusion portion is retracted by an ink cartridge front surface wall when the ink cartridge is inserted into a mounting portion opening of an ink cartridge mounting portion.
Figure 35:
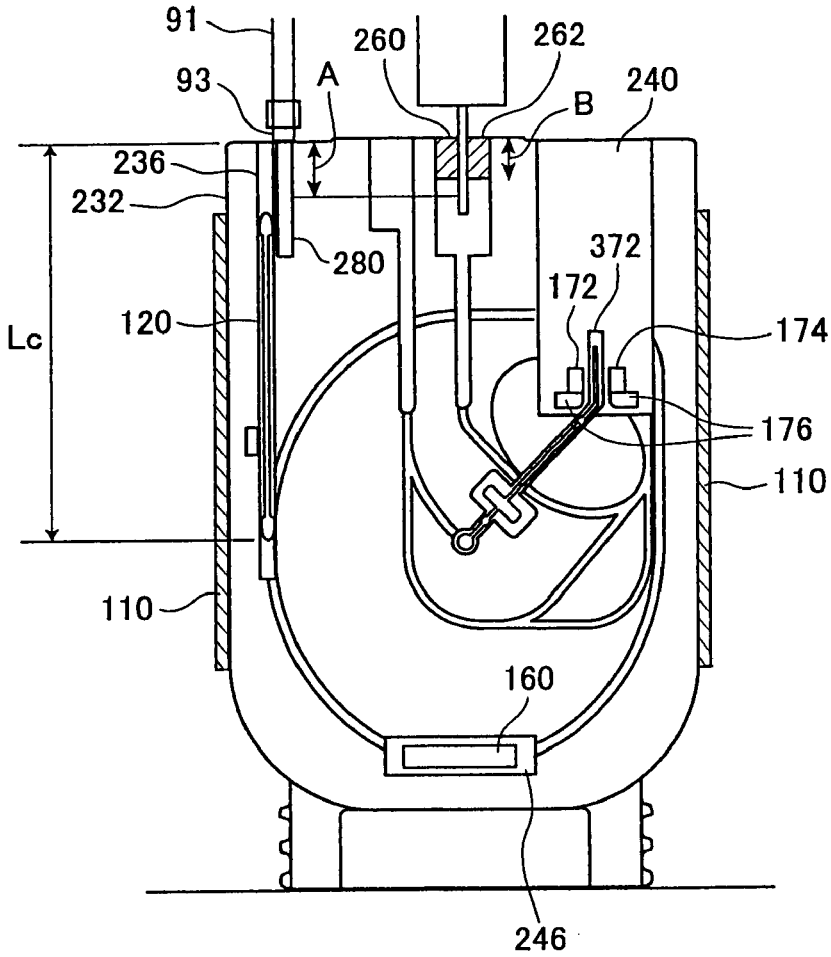
FIG. 35 is a plan view of the condition shown in FIG. 34.

As shown in FIG. 18, the lower surface of the main case 230 includes a flat smooth surface 242 capable of sliding with respect to the ink cartridge mounting portions S. The flat smooth surface 242 is connected by the side walls 232 on both sides. The lower surface of the main case 230 is formed with the guide groove 236 and the sensor accommodation groove 240. As shown in FIG. 30, the distance Lac between the guide groove 236 and the side wall 232 that is nearest in the widthwise direction corresponds to the guide-partition wall intervening distance La in the ink cartridge mounting portions S. As shown in FIG. 35, the guide groove 236 is formed merely with a length Lcc capable of accommodating the guide protrusion walls 120 in the lengthwise direction from the front surface wall 234. More particularly, the guide groove 236 is formed with a length that is at least as long or longer than a length Lc between the positive pressure application members 91 in the ink cartridge mounting portions S and the side end of the front surface opening portion O of the guide protrusion walls 120. For this reason, the guide groove 236 can accommodate the guide protrusion wall 120 when the ink cartridge 200 is mounted in the ink cartridge mounting portion S. As shown in FIG. 30, the distance Lbc between the guide groove 236 and the guide protrusion walls 120 corresponds to a guide-sensor interdistance in the ink cartridge mounting portion S. As shown in FIG. 30, the sensor accommodation groove 240 is formed to merely a length Ldc that corresponds to the distance Ld between the positive pressure application members 91 in the lengthwise direction from the wall and the residual ink detecting photo sensor 170 so that the residual ink detecting photo sensor 170 can be accommodated when the ink cartridge 200 is mounted in the ink cartridge mounting portion S.

A plurality of ribs 243 are formed in the lower surface of the main case 230. The ribs 243 are for supporting the strength of the tub portion 320 from the under surface of the tub portion 320. It should be noted that a bottom central axis rib 244 is formed in the central position in the widthwise direction of the main case 230 so as to extend in the lengthwise direction of the main case 230. The bottom central axis rib 244 continues to retract the pull-out-lock protrusion 160 (FIG. retrieval unit 10) to below the bottom surface when the ink cartridge 200 slides above the bottom surface of the ink cartridge mounting portion S. The ink cartridge 200 will not pull out from the ink cartridge mounting portion S because the pull-out-lock protrusion 160 engages with the leak preventing lock indentation 246 when the ink cartridge 200 is mounted in the ink cartridge mounting portion S.

A sensor lever accommodation portion 370 forms the inner portion of the sensor lever accommodation groove 350. The sensor lever accommodation portion 370 is formed in the lower surface of the main case 230 so as to protrude out from the tub portion 320. The portion (sensor lever accommodation protrusion portion 372) of the sensor lever accommodation portion 370 that corresponds to the base surface 352 of the sensor lever accommodation groove 350 protrudes in the lengthwise direction at the widthwise center of the sensor accommodation groove 240. As shown in FIG. 35, when the ink cartridge 200 is mounted in the ink cartridge mounting portions S and the residual ink detecting photo sensor 170 is housed in the sensor accommodation groove 240, the sensing accommodation protrusion portion is positioned between the infrared light emitting portion 172 and the infrared light receiving portion 174 of the residual ink detecting photo sensor 170. The sensing arm end portion 367 (sensing point) of the sensor lever 360 positioned in the groove portion 354 in the protrusion portion 372 will as a result be positioned between the infrared light emitting portion 172 and the infrared light receiving portion 174. It should be noted that at least the protrusion portion 372 of the main case is made from a material that is transparent to infrared light.

Figure 19:
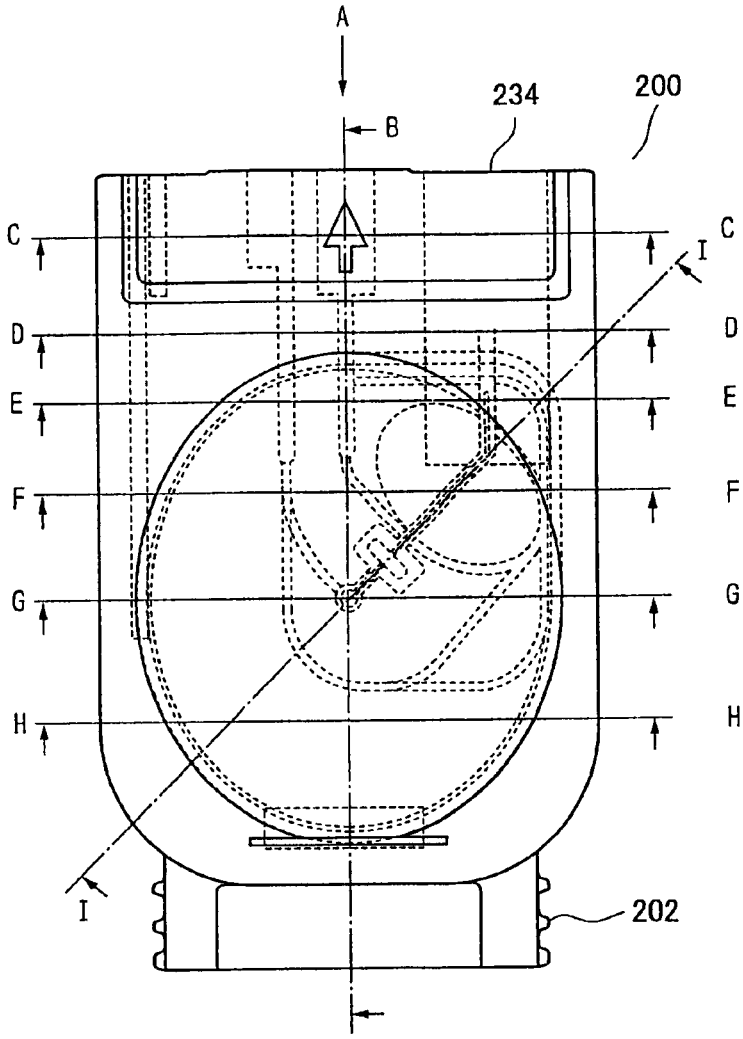
FIG. 19 is a plan view showing the ink cartridge of the present embodiment.
Figure 20:
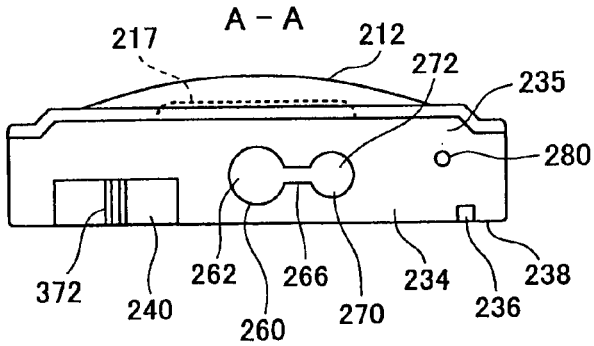
FIG. 20 is a view taken from arrow A of FIG. 19.
Figure 21:
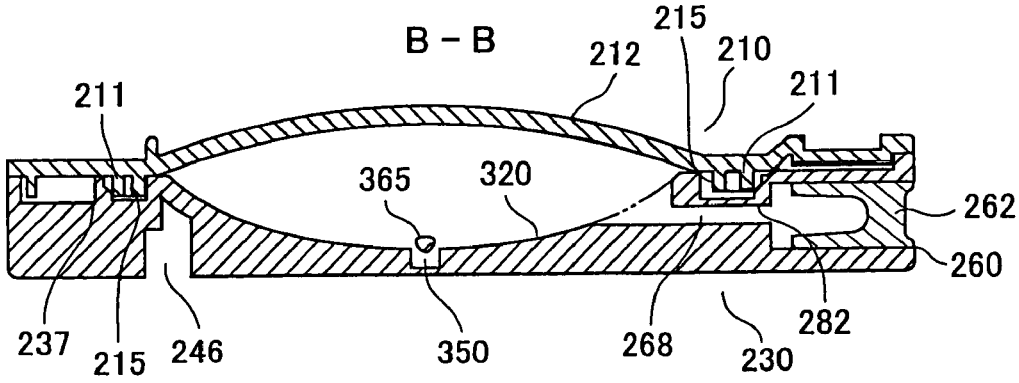
FIG. 21 is a cross-sectional view of the ink cartridge taken along line B—B of FIG. 19.
Figure 22:
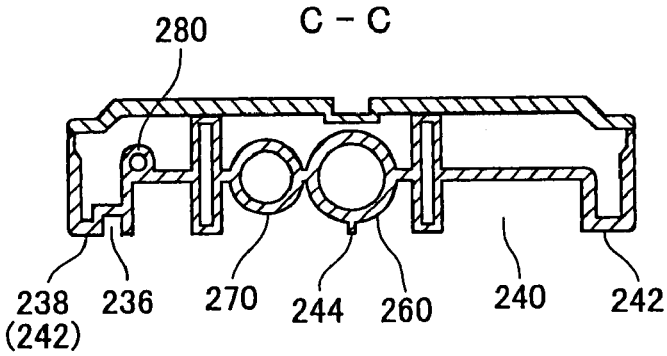
FIG. 22 is a cross-sectional view of the ink cartridge taken along line C—C of FIG. 19.
Figure 23:
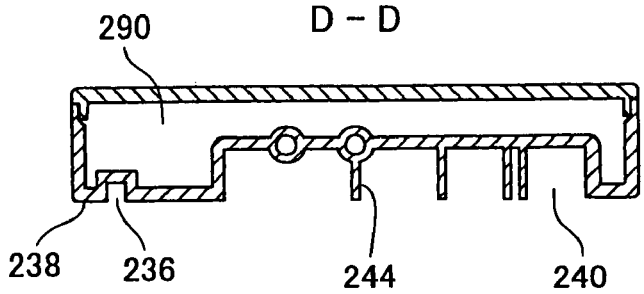
FIG. 23 is a cross-sectional view of the ink cartridge taken along line D—D of FIG. 19.
Figure 24:
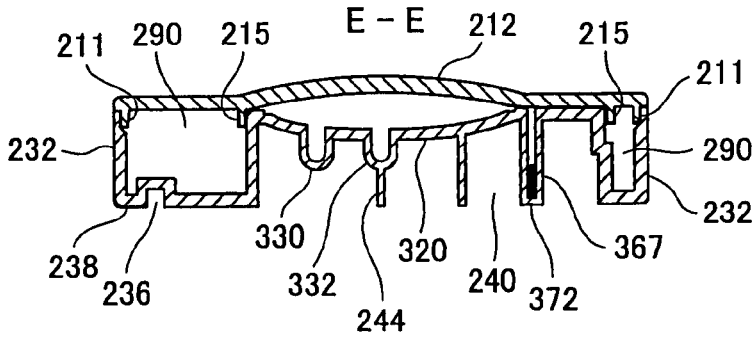
FIG. 24 is a cross-sectional view of the ink cartridge taken along line E—E of FIG. 19.
Figure 25:
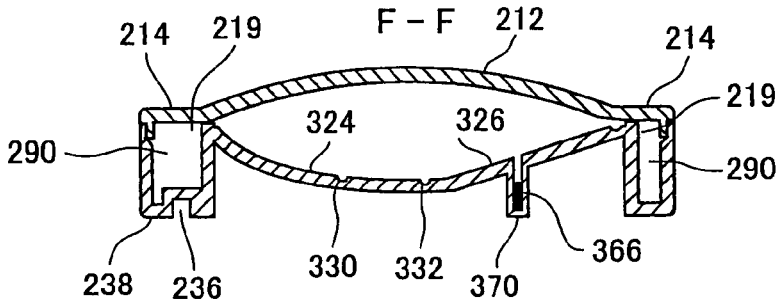
FIG. 25 is a cross-sectional view of the ink cartridge taken along line F—F of FIG. 19.
Figure 26:
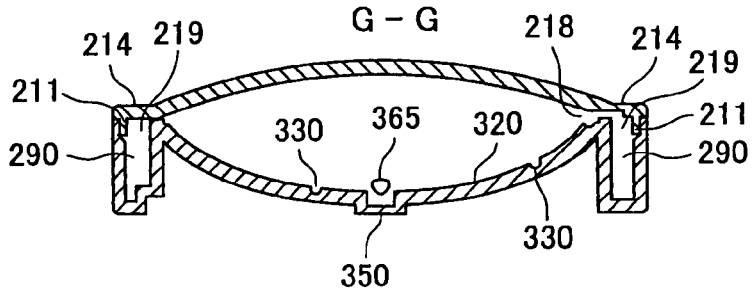
FIG. 26 is a cross-sectional view of the ink cartridge taken along line G—G of FIG. 19.

FIG. 19 is a schematic plan view of the ink cartridge 200 according to the embodiment having the configuration described above. FIG. 19 shows the situation wherein the lid 210 is mounted on the main case 230. Internal configuration is indicated by broken line. FIG. 20 is a view taken from the direction indicated by arrow A of FIG. 19, that is, is a frontal view showing the front surface of the ink cartridge 200. FIGS. 21 to 28 are cross-sectional views taken along lines B—B, C—C, D—D, E—E, F—F, G—G, H—H, and I—I, respectively. It should be noted that the flexible film 302 and the ribs (243, 292) are not indicated in the drawings for purposes of clarity. However, the bottom central axis rib 244 is indicated in some of the drawings.

Figure 27:
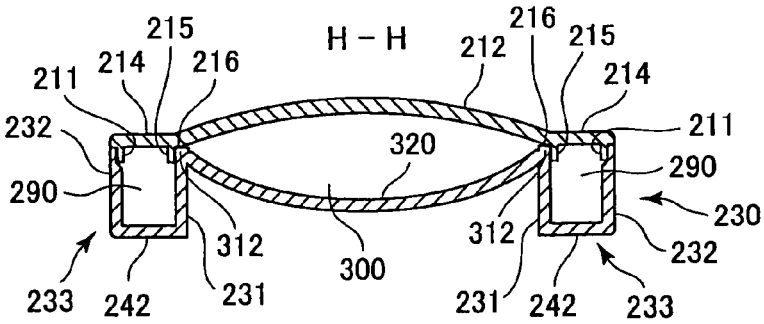
FIG. 27 is a cross-sectional view of the ink cartridge taken along line H—H of FIG. 19.
Figure 28:
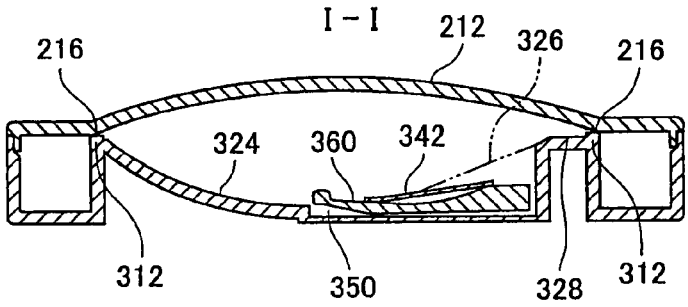
FIG. 28 is a cross-sectional view of the ink cartridge taken along line I—I of FIG. 19.

As shown in FIGS. 15 and 27, a peripheral wall 231 is formed in the main case 230. The peripheral wall 231 extends from the opening peripheral edge 312, which defines the opening of the tub portion 320, integrally and continuously to the bottom surface side (in the depth direction of the tub portion 320) or the main case 230. A peripheral wall portion 233 is formed connected to the peripheral wall 231, the side walls 232, and the flat smooth surface 242. The peripheral wall portion 233 supports the tub portion 320 from the periphery of the tub portion 320. The peripheral wall 231 and the side walls 232 are separated by an interposed space and are connected together by a plurality of wall-like ribs 292. The flat portion 214 of the lid is coupled to the upper end of the peripheral wall portion 233 and serves as the outer peripheral portion in confrontation with the peripheral wall portion 233. Accordingly, the lower surface of the ink accommodation portion 300 is stabilized by the flat smooth surface 242 even when substantially spherically shaped. Attachment to and removal from the multifunction device 1 is simple. Because the flexible film 302 is adhered to the opening peripheral edge 312 and the lid 210 is connected to the upper end of the peripheral wall portion 233, ink can be reliably sealed in without the adhered portion of the flexible film 302 interfering with the lid 210. Because the peripheral wall portion 233 has a two-layered configuration made from the peripheral wall 231 and the side walls 232, and uses a configuration wherein the peripheral wall portion 233 and the peripheral wall 231 are connected by a plurality of ribs 292, the peripheral wall portion 233 can be prevented from deforming even though the ink cartridge 200 is subjected to vacuum pack processes to be described later. Further, as is clear from FIG. 18, the plurality of ribs 243 are formed so as to connect the lower surface of the tub portion 320 and the peripheral wall portion 233. For this reason, the ribs 243 prevent the tub portion 320 and peripheral wall portion 233 from deforming even if the ink cartridge 200 is subjected to the vacuum pack processes to be described later.

Figure 29:
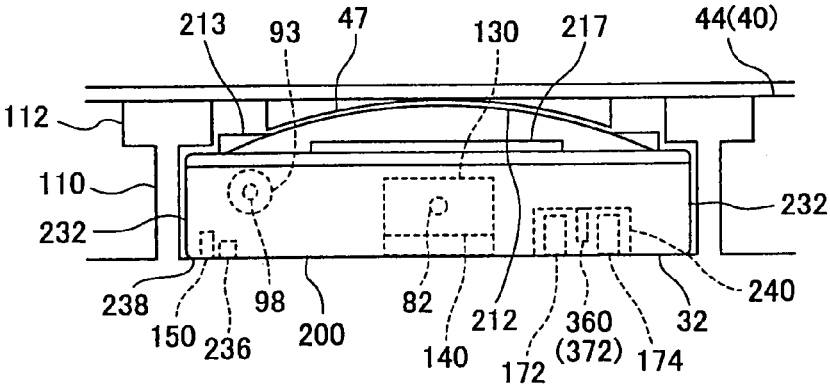
FIG. 29 is a view showing the relationship between bulging portions formed on partition walls of the ink cartridge mounting portion, height of the ink cartridge, and a curved convex wall formed on the ceiling surface of the ink cartridge mounting portion when the ink cartridge is inserted into a mounting portion opening.

The ink cartridge 200 having the above-described configuration has a flat lower surface. As shown in FIG. 29, the upper surface has a curved shape that is higher than the height at both ends (side walls 232) in the widthwise direction. The height at both ends in the widthwise direction (the height from the flat smooth surface 242 to the flat portion 214) is substantially the same as the distance between the base wall 32 and the enlarged portion 112 that is formed on the upper portion of the front surface opening portion O side end of the partition walls 110. Accordingly, the ink cartridge 200 can be inserted into the ink cartridge mounting portions S. Also, the ink cartridge 200 can be prevented from being inserted upside down because the height of the spherical outward curved portion 212 and the protrusion portion 213 is higher than the height at both sides in the widthwise direction and because the curve-shaped protruding walls 47 of the ceiling surface of the mounting portions S is formed following the spherical outward curved portion 212 of the ink cartridge 200.

Because the lower surface of the main case 230 is smooth and formed with the peripheral wall portion 233, which extends in the lengthwise direction, the ink cartridge 200 can be mounted by merely inserting the ink cartridge 200 in the ink cartridge mounting portion S and sliding it over the bottom surface while the pull-out-lock protrusion 160 is in a retracted condition. Moreover, the width of the ink cartridge 200 corresponds to the distance between the partition walls 110 of the ink cartridge mounting portion S, the distance Lac between the guide groove 236 and the side walls 232 nearest in the widthwise direction corresponds to the guide-partition wall intervening distance La in the ink cartridge mounting portion S, and the distance Lbc between the guide groove 236 and the sensor accommodation groove 240 corresponds to the inter-guide-sensor distance Lb in the ink cartridge mounting portion S. Accordingly, by sliding the cartridge so that the guide groove 236 is guided by the guide protrusion walls 120 when the ink cartridge 200 is inserted into the ink cartridge mounting portion S, the residual ink detecting photo sensor 170 is reliably housed in the sensor accommodation groove 240 and the bent end portion 367 in the sensor accommodation groove 240 is inserted between the infrared light emitting portion 172 and is the infrared light receiving portion 174.

It should be noted that as indicated in FIGS. 9 and 30, the position of the end portion of the front surface opening portion O side of the guide protrusion walls 120 in the ink cartridge mounting portion S is positioned at a position nearer the front surface opening portion O than the position of the end portion (sensor guard 176) of the front surface opening portion O side of the residual ink detecting photo sensor 170. The end of the guide groove 236 that is opposite from the front surface wall 234 is positioned farther from the front surface wall 234 than the end of the sensor accommodation groove 240 that is opposite from the front surface wall 234. Accordingly, when the ink cartridge 200 is inserted into the ink cartridge mounting portion S and slid over the holding portion base wall 32, the sensor accommodation groove 240 reaches the residual ink detecting photo sensor 170 after the guide groove 236 accommodates the guide protrusion walls 120. Because the main case 230 reaches the residual ink detecting photo sensor 170 after being positioned in the widthwise direction of the ink cartridge 200 by engagement between guide protrusion walls 120 and the guide groove 236, the bent end portion 367 in the sensor accommodation groove 240 is inserted between the infrared light emitting portion 172 and the infrared light receiving portion 174.

Because the guide protrusion wall 120 is near the lock releasing operation rib 150 in the widthwise direction of the ink cartridge mounting portion S and the guide groove 236 is near the lock release portion 238 in the widthwise direction of the ink cartridge 200, the lock release portion 238 reliably abuts against the lock releasing operation rib 150 and retracts it when the ink cartridge 200 is mounted in the ink cartridge mounting portion S. Moreover, because the spring 114 member presses the ink cartridge 200 downward from above the partition walls 110 in the vicinity of the guide protrusion walls 120, operations for retracting the lock releasing operation rib 150 are more reliable.

As shown in FIGS. 29 and 35, the ink cartridge 200 includes the sensor accommodation groove 240 and the guide groove 236 as openings in the front surface wall 234 and in the underside surface at positions that are disposed on either sides of the ink supply hole 260 as viewed from the front surface wall 234 side. The sensor accommodation groove 240 is for accommodating the residual ink detecting photo sensor 170. The guide groove 236 is for accommodating the guide protrusion walls 120. The sensing arm end portion 367 is inserted between the infrared light emitting portion 172 and the infrared light receiving portion 174 and is movably housed in the protrusion portion 372. Because the protrusion portion 372 protrudes into the sensor accommodation groove 240 and the lock release portion 238 is provided adjacent to the guide groove 236, the ink cartridge 200 can be configured flat and can be smoothly and stably moved across the base wall 32 of the ink cartridge mounting portion S. The ink cartridge 200 can be easily attached and detached. Moreover, the amount of residual ink can be reliably detected by merely mounting the ink cartridge 200 in the ink cartridge mounting portion S.

The ink cartridge 200 of the present embodiment is mounted in the ink cartridge mounting portion S as shown in FIGS. 30 to 35.

Figure 31:
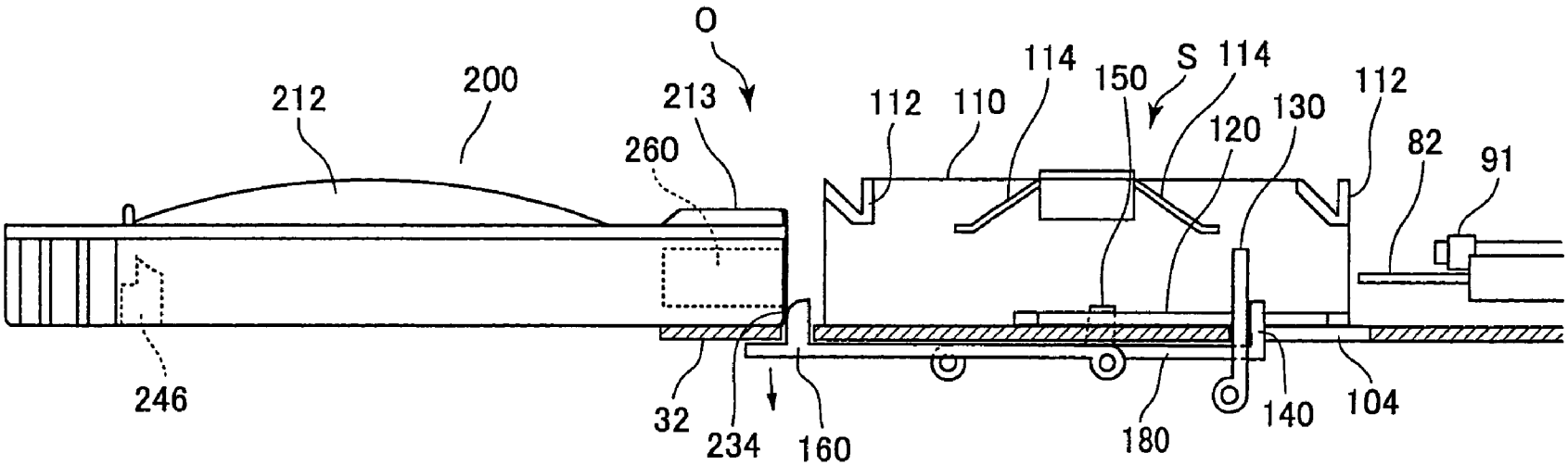
FIG. 31 is a cross-sectional view of the condition shown in FIG. 30.
Figure 32:
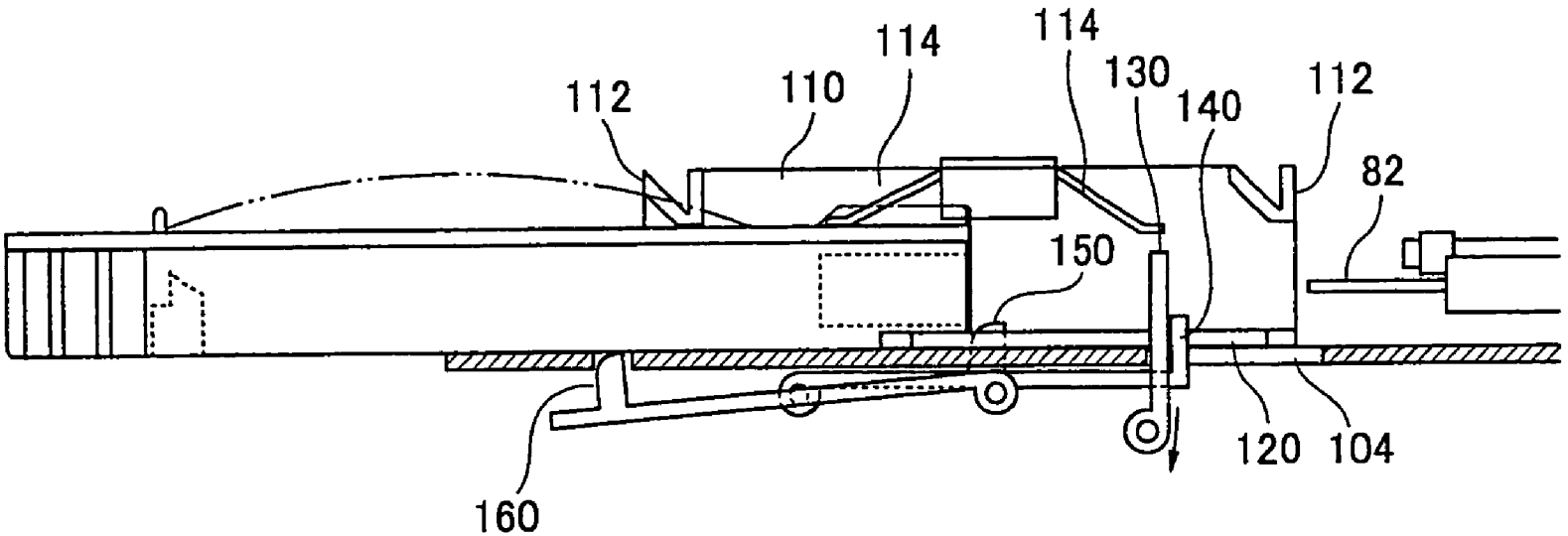
FIG. 32 is a cross-sectional view showing condition wherein a needle protection lock member releases locked condition of a needle protection plate by a lock release portion hitting a needle protection lock release lever when a guide groove of the ink cartridge engages with a guide protrusion wall and the ink cartridge is slid.
Figure 33:
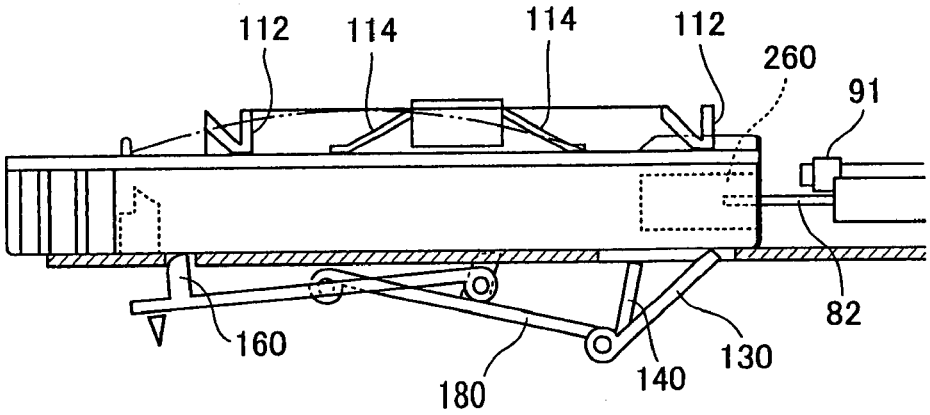
FIG. 33 is a cross-sectional view showing condition wherein an ink introduction hollow needle is inserted into an ink supply hole after the front surface of the ink cartridge presses the needle protection plate and the needle plate retracts after the lock of the needle protection plate is released.
Figure 34:
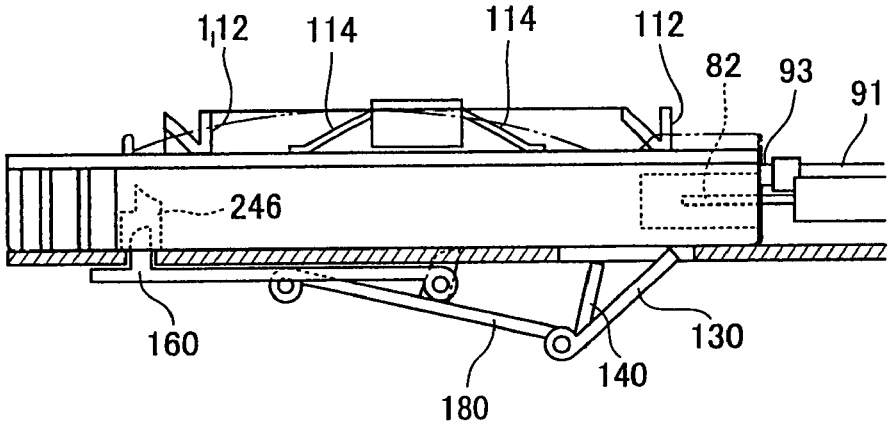
FIG. 34 is a cross-sectional view showing condition wherein the front surface of the ink cartridge abuts a rubber cap of a positive pressure application member in association with engagement of a pull-out holding lock protrusion portion into a pull-out holding lock indentation portion after the ink introduction hollow needle is inserted into an ink supply hole.

The user inserts the ink cartridge 200 into the front surface opening portion O of the ink cartridge mounting portion S and slides the lower surface of the ink cartridge 200 over the cartridge holding portion base wall 32. As a result, first as shown in FIGS. 30 and 31, the front surface wall 234 retracts the pull-out-lock protrusion 160. Afterward, as shown in FIG. 32, the pull-out-lock protrusion 160 continues to be retracted by the bottom central axis rib 244 while the cartridge slides forward. The guide groove 236 engages with the guide protrusion walls 120 and is slid further. When the lock release portion 238 of the front surface wall 234 hits the lock releasing operation rib 150, the lock member 180 releases the lock of the needle protection plates 130 (lowers the pressing plate 140). Afterward, as shown in FIG. 33, the needle protection plate 130 retracts when the front surface wall 234 of the ink cartridge 200 presses the needle protection plates 130. When the ink cartridge 200 is moved further forward and is completely inserted into the ink cartridge mounting portion S, the ink introducing hollow needle 82 pierces the ink supply rubber plug 262 (FIG. 39(*a*)) in the ink supply hole 260. Afterward, as shown in FIGS. 34 and 35, the front surface wall 234 abuts the rubber cap 93 of the positive pressure application members 91. The cartridge is pressed in against the force of the spring 94 of the positive pressure application members 91 until it proceeds a bit further. At this time, it is desirable that the front surface of the cartridge abut against a stopper wall (not shown) so that forward progress of the cartridge is blocked. Afterward, although the cartridge moves back a small bit by the force of the spring 94, the pull-out-lock protrusion 160 engages in the leak preventing lock indentation 246 at the under surface of the cartridge. As a result, the cartridge is locked in place and is prevented from pulling out. In this way, the ink cartridge 200 is mounted in the ink cartridge mounting portion S. Because the front surface wall 234 of the ink cartridge 200 abuts the ring-shaped resilient seal member 93 with a substantially flat portion thereof, the atmosphere connection hole 280 and the positive pressure hole 98 of the ring-shaped resilient seal member 93 are reliably brought into fluid communication without any air leaks.

Because the black ink cartridge has a wider width than the other color ink cartridges, the black ink cartridge cannot be mistakenly inserted into an ink cartridge mounting portion S for a color ink cartridge. On the other hand, the other color ink cartridges can conceivably be mistakenly inserted into the mounting portion for black ink cartridges. However, the widthwise direction distance Lb1 between the guide groove 236 and the sensor accommodation groove 240 in the color ink cartridges is narrower than the widthwise direction distance Lb2 between the guide protrusion wall 120 and the residual ink detecting photo sensor 170 in the housing portion for the black ink cartridge. Accordingly, the front surface of the cartridge will abut against the sensor guards 176 and not proceed any further forward even if the guide groove 236 engages with the guide protrusion wall 120 and the ink cartridge is slid. Even if the width of the color cartridges were large enough to insert between guide protrusion wall 120 in the housing portion for the black cartridge and the partition wall 110 at the side farther from the guide protrusion wall 120, the lock releasing operation rib 150 cannot be retracted unless the guide groove 236 is engaged with the guide protrusion wall 120. Therefore, the needle protection plate 130 cannot be retracted so the front surface of the cartridge abuts against the needle protection plate 130 and the ink introducing hollow needle 82 cannot be inserted into the ink supply hole 260.

When the ink cartridge 200 is mounted in the ink cartridge mounting portion S, the ink introducing hollow needle 82 supplies ink from inside the ink accommodation portion 300 to the buffer tank 84. The ink from the buffer tank 84 is supplied to the ink jet head 70 through the ink-supply tube T in association with recording operations.

Although the positive pressure pump 36 is stopped, the inside of the ink cartridge 200 is applied with atmospheric pressure in the atmosphere chamber 290 through the pump 36, the positive pressure application tubes 92, the positive pressure application members 91, and the atmosphere connection hole 280. For this reason, the flexible film 302 deforms in association with reduction in ink without applying pressure to the ink, and the preformed shape of the flexible film 302 substantially follows the tub portion 320 and comes into intimate contact with the tub portion 320. Therefore, the pressure of the ink supplied to the ink jet head 70 can be maintained fairly fixed and ejection of ink from the ink jet head 70 can be stabilized. The amount of remaining ink can be reduced because the flexible film 302 ends up in intimate contact with the tub portion 320, substantially following the tub portion 320. Furthermore, at least a portion of the tub portion 320 is the curved surface portion 324, whose cross-sectional surface area decreases in association with distance from above (the open side) of the tub portion 320. Therefore, the flexible film 302 can easily follow the tub portion 320 when only a little amount of ink remains. The amount of residual ink can be reduced and pressure of the ink supplied is maintained substantially fixed to the very end.

The ink cartridge mounting portion S in which the ink cartridge 200 is mounted is positioned lower than the ink jet head 70 in the vertical direction. For this reason, (refer to FIG. 3) the difference in pressure head constantly applies a negative pressure on the ink in the nozzles of the piezoelectric ink jet head 70 in the same manner as a general ink jet recording device. However, under normal conditions the surface tension of the meniscus of the ink in the nozzles maintains the ink in the nozzle against the negative pressure. After the operation of the well-known purge unit 78, that is, after covering the nozzles with a cap and sucking ink from the nozzles using the pump, the ink with bubbles in the cap when suction operations by the pump are stopped enter the nozzles by the difference in pressure head. There is a chance that defective ejection can occur later when printing operations are performed by the ink jet head 70. In the present embodiment, the positive pressure pump 36 is operated after purge operations until the cap is opened up. Operation of the positive pressure pump 36 can be started during purge operations as well. As a result, the positive pressure air flow is supplied into the atmosphere chamber 290 in the cartridge.

A positive pressure is applied to the ink through the flexible film 302. As a result, a positive pressure can be applied from the cartridge side to ink in the nozzles of the ink jet head 70 and bubbles can be prevented from being drawn into the nozzles. It should be noted that at this time pressure applied by the positive pressure pump 36 can be a pressure sufficient so that bubbles do not enter the nozzles. Although there is no need to apply a pressure large enough to positively press ink out from the nozzles, such a large pressure can be used.

As the ink cartridge 200 is being mounted in the ink cartridge mounting portion S, the atmosphere connection hole 280 abuts against the positive pressure application members 91 after the ink introducing hollow needle 82 pierces the ink supply rubber plug 262 in the pull-out-lock protrusion 160. (Explained in more detail, as shown in FIG. 35, the distance A in the ink cartridge mounting portion S between the needle hole in the ink introducing hollow needle 82 and the front surface of the rubber cap 93 of the positive pressure application member 91 is larger than the distance B that the ink supply rubber plug 262 blocks the inside of the ink supply hole 260 from the front surface of the ink cartridge 200.) When the ink cartridge 200 is pulled out from the ink cartridge mounting portion S, the ink introducing hollow needle 82 pulls out from the rubber plug 262 inside the ink supply hole ink supply hole 260 after the atmosphere connection hole 280 separates from the positive pressure application members 91. Accordingly, even if the ink cartridge 200 pulls out from the ink cartridge mounting portion S while the positive pressure pump 36 is applying positive pressure to the ink cartridge 200, the atmosphere connection hole 280 would first separate from the positive pressure application members 91 while the ink introducing hollow needle 82 remains in its pierced condition. Therefore, ink can be prevented from leaking out from the ink cartridge 200.

When the ink cartridge 200 is mounted in the ink cartridge mounting portion S, then as shown in FIG. 35 the infrared light emitting portion 172 and the infrared light receiving portion 174 of the residual ink detecting photo sensor 170 are accommodated in the sensor accommodation groove 240 so as to sandwich the protrusion portion 372, which accommodates the sensing arm end portion 367 (sensing point) of the sensor lever 360. Accordingly, the sensing arm end portion 367 (sensing point) of the sensor lever 360 is positioned between the infrared light emitting portion 172 and the infrared light receiving portion 174. By doing this, the ink sensing mechanism for detecting the condition of when the ink cartridge 200 runs out of ink is completed. That is, the sensor portion 170 (light emitting portion 172+light receiving portion 174) of the ink sensing mechanism of the present embodiment is provided in the ink cartridge mounting portion S. The lever (the black resin sensor lever 360) that senses whether the sensor portion 170 is ON or OFF is provided in the ink cartridge 200 so that the ink sensing mechanism can be completed by mounting the ink cartridge 200 to the ink cartridge mounting portion S.

As explained previously, the sensor lever 360 moves the sensing arm end portion 367 (sensing point) vertically in accordance with the amount of residual ink. When a sufficient amount of ink remains, the sensing arm end portion 367 is positioned between the infrared light emitting portion 172 and the infrared light receiving portion 174 and blocks the infrared light. When the ink is almost all gone, the sensing arm end portion 367 pulls out from between the infrared light emitting portion 172 and the infrared light receiving portion 174 so that the infrared light receiving portion 174 receives infrared light. As a result, a person skilled in the art can easily convert presence or absence of ink into an electric signal and control operations of the recording device. The sensor 170 can be used to detect whether the ink cartridge is mounted, and not merely detect presence or absence of ink.

The ink cartridge 200 of the present embodiment is configured only from resin parts. The basic configuration of the ink cartridge 200 is a film pulled over a resin case with ink held in between. That is, a single sheet of film is pulled across the tub portion 320 of the main case 230 and ink is filled in between the main case 230 and the film. By mounting the lid 210 onto the main case 230, the user is prevented from directly touching the film or breaking the film.

Explained in more detail, the main case 230 is made from resin that has a high resistant to dissolving properties of ink. In this example, the main case 230 is made from non-additive type polypropylene (PP) which has no additives included therein. If additives were included in the polypropylene, the ink could dissolve the additives because the main case 230 (the ink-holding portion 310) contacts the ink directly. On the other hand, the lid 210 is made from additive-type polypropylene (PP) with additives added for maintaining strength because the lid 210 does not contact the ink directly. In this way, the main case 230 and the lid 210 can be coupled together using ultrasonic welding because both are made from the same resin material (PP).

In the present embodiment, the ink accommodation portion 300 is defined between the tub portion 320 and the flexible film 302. The ink can be used up completely because no foam is used to hold the ink. Because the ink cartridge 200 is made only from resin without using any foam, no dioxin is generated when the ink cartridge 200 is burned after the ink is used up. Also, there is no need to provide tab portions or a spout as would be required if the ink accommodation portion 300 were a bag shape. Therefore, a large amount of ink can be accommodated in the case with only a small volume. According to the present embodiment, the ink accommodation portion 300 can be prepared with a simple configuration of merely preparing a concave holding vessel and covering it with film. This simple configuration can be easily redesigned as needed.

According to the present embodiment, the flexible film 302 is a two-layer configuration. That is, the flexible film 302 is prepared by adhering together an inner layer made from polypropylene (30 μm thick), which has heat fusing properties, and an outer layer made from nylon, which has heat resistance and shock resistance. The polypropylene (30 μm thick) is a no-additive type with almost no additives included therein. Because the inner layer contacts the ink, the inner layer would dissolve in the ink if the inner layer included additives. However, polypropylene (30 μm thick) is extremely weak against mechanical shock. For this reason, the outer layer of nylon is provided to absorb shock. The two-layer configuration made from the inner layer made from polypropylene (30 μm thick) and the outer layer made from nylon has the property of stretching when heat is applied and is also permeable to air and other gases. As will be described later, this is extremely desirable to be used for the flexible film 302 of the present embodiment.

According to the present embodiment, the double-layer flexible film 302 described above is formed in a manner to be described below to bulge outward when attached to the ink-holding portion 310. The flexible film 302 is made from an inner layer 302*a* made from polypropylene (30 μm thick) and an outer layer 302*b* made from nylon.

Figure 37A:
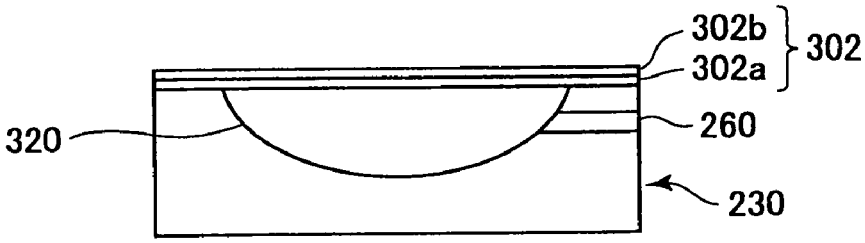
FIG. 37(*a*) is a side view showing processes of a method for attaching a flexible film according to the present embodiment to an opening peripheral portion.
Figure 37B:
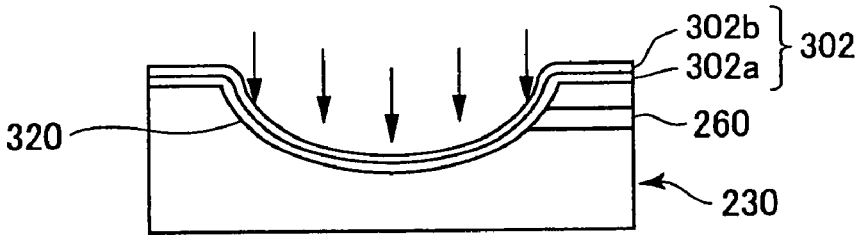

As shown in FIG. 37(*a*), the flexible film 302 is disposed so as to cover the open portion of the tub portion 320 while the flexible film 302 is in a flat condition. Then heat is applied to the opening peripheral edge 312 through the flexible film 302. As a result, only the inner layer 302*a* melts and is heat fused to the opening peripheral edge 312. Next, as shown in FIG. 37(*b*), a vacuum device not shown is connected to the ink supply hole 260, which is in fluid communication with the tub portion 320. The vacuum device is used to exhaust air and other gases from the space between the flexible film 302 and the tub portion 320 to develop a vacuum condition in the space. Atmospheric pressure applied to the flexible film 302 from outside moves the flexible film 302 into intimate contact with the tub portion 320. At the same time that the vacuum is applied, heat is applied to the flexible film 302 overall by an external heat source (not shown) provided above the flexible film 302. As a result, the flexible film 302 plastically deforms into a shape that follows the tub portion 320, As a result, the flexible film 302 is formed so as to cling precisely to the tub portion 320. As a result, the flexible film 302 is formed in a shape that is modeled on the base surface of the tub portion 320. When ink is introduced between the tub portion 320 and the flexible film 302, the flexible film 302 expands in the direction that separates it from the tub portion 320 so that ink with twice the volume of the tub portion 320 can be accommodated. As ink is used up, the flexible film 302 approaches the tub portion 320. When ink is completely used up, the flexible film 302 completely clings to the tub portion 320. Accordingly, ink can be can be completely used up.

Although the nylon of the outer layer 302*b* is positioned at a location that is nearer to the external heat source (not shown) the nylon will not melt because it has heat resistance. On the other hand, the polypropylene layer of the inner layer 302*a* will merely plastically deform without melting because it is located far from the external heat source. Accordingly, the flexible film 302 will not melt because of the external heat source, which would be a potential problem if the flexible film 302 were made from a single layer of polypropylene.

If an attempt were made to press the flexible film 302 by pressure rolling, there would be a potential risk that wrinkles would form in the flexible film 302 and ink and air might leak. However, these problems do not occur when the above-described method is used.

Moreover, the present embodiment uses a method wherein the curved surface portion 324 itself is used as the mold and the flexible film 302 is stretched to transfer the form of the curved surface portion 324 to the flexible film 302. Accordingly, the curved surface portion 324 can be formed in any optional form and the flexible film 302 can be easily formed to follow that optional form. Accordingly, changes in shape of the tub portion 320 can be easily dealt with. The flexible film 302 can be prevented from sticking to the curved surface portion 324 during the above-described heating process by forming the plurality of ink injection groove 330 and the ink supply groove 332 to be described later or by forming graining on the curved surface portion 324.

Further, fewer processes are required than if a plurality of flexible films 302 were pressed into a bulging shape and then attached to the opening peripheral edge 312. Therefore, the risk of foreign objects entering into the ink accommodation portion 300 is reduced. Moreover, simple facilities will suffice because no separate metal mold for a pressing operation is required.

It should be noted that the inner layer 302*a* and the outer layer 302*b* can be made from two types of polypropylene with different characteristics by making the outer layer 302*b* from additive type polypropylene, which is difficult to melt, instead of nylon, and the inner layer 302*a* from non-additive type polypropylene.

Figure 38:
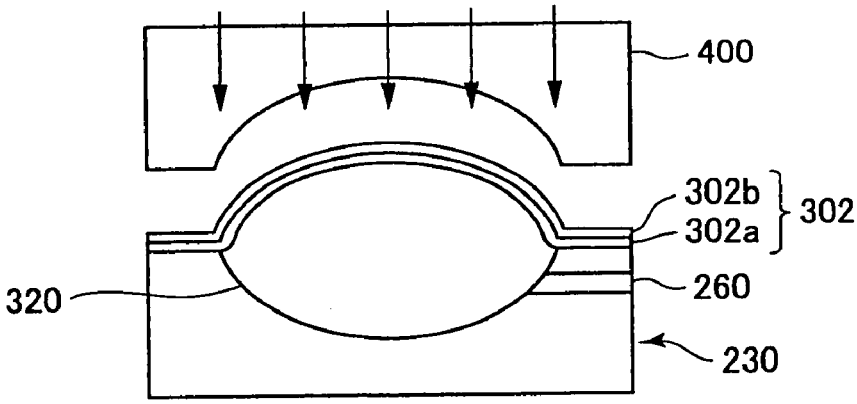
FIG. 38 is a view showing a modification of the process for producing the bulging shape in flexible film.

As shown in FIG. 38, a mold 400 can be provided on the tub portion 320. The mold 400 is provided separately and has a concave shape that is symmetric with the shape of the tub portion 320. In this case, after the flexible film 302 is heat fused to the opening peripheral edge 312 in a flat condition, pressurized air is pushed in between the flexible film 302 and the tub portion 320 through the ink supply hole 260 while heating up the mold 400. As a result, the flexible film 302 expands and the indented shape of the mold 400 is transferred to the flexible film 302. It should be noted that pressure in the space between the flexible film 302 and the mold 400 can be reduced instead of increasing the pressure inside the internal space between the flexible film 302 and the tub portion 320 by pushing air into the space.

Next, the method of injecting ink in between (ink accommodation portion 300) the tub portion 320 and the flexible film 302 formed in the bulging shape will be explained below with reference to FIGS. 39(*a*) and 39(*b*).

Figure 39A:
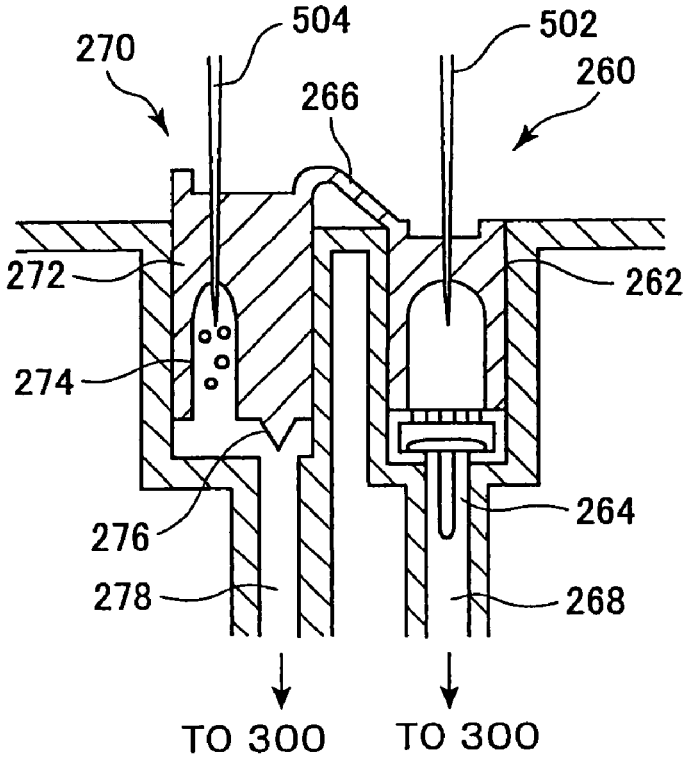
FIG. 39(*a*) is a cross-sectional view showing processes of fitting a rubber plug with a back-flow prevention valve completely into an ink supply hole and a rubber plug for ink injection partially into an ink injection hole, and removing air from an ink accommodation portion and injecting ink.
Figure 39B:
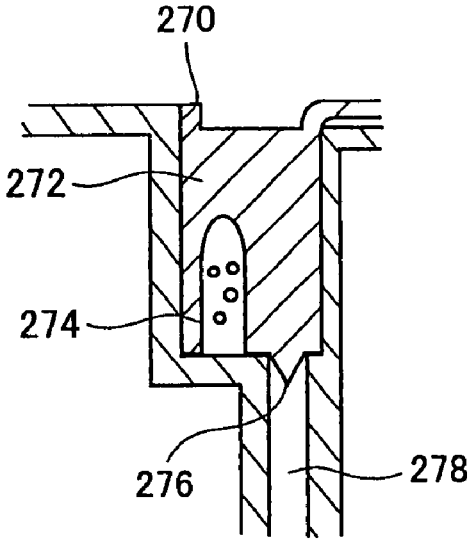

As shown in FIG. 39(*a*), a back-flow prevention valve 264 and the ink supply rubber plug 262 (silicone rubber bush) are provided inside the ink supply hole 260. An ink injection rubber plug 272 (silicone rubber bush) is provided inside the ink injection hole 270. The ink injection rubber plug 272 is connected to the ink supply rubber plug 262 by a link portion 266. An ink injection needle insertion indentation 274 and a plug peak 276 are formed in the ink injection rubber plug 272 at mutually offset positions. Although the rubber plugs 262, 272 are pierced by needles in a manner to be described later, the rubber plugs 262, 272 have the quality of closing up the pierced portion by their own resilience after the needles are pulled out.

First, as shown in FIG. 39(*a*), the ink supply rubber plug 262 and the ink injection rubber plug 272 are engaged in the ink supply hole 260 and the ink injection hole 270. The ink injection rubber plug 272 is fitted partially in the ink injection hole 270 to the condition wherein the plug peak 276 is separated from the ink injection connection pathway 278. While the front surface wall 234 of the main case 230 is in a posture facing vertically upward, an air-removing hollow needle 502 pierces the ink supply rubber plug 262 and an ink injection needle 504 pierces the ink injection rubber plug 272 until the needles 502, 504 are exposed in the internal indentation portions of the corresponding rubber plugs. The air-removing hollow needle 502 is in fluid communication with an air removing vacuum pump not shown and the ink injection needle 504 is in fluid communication with an ink pump. Air is drawn from inside the ink accommodation portion 300 through the ink supply hole 260 to establish a vacuum inside the ink accommodation portion 300. Then, the ink pump is operated to inject ink into the ink injection hole 270. Because the ink injection needle insertion indentation 274 is so narrow, it is impossible to remove all air remaining in the ink injection needle insertion indentation 274 regardless of how high a vacuum is established. Moreover, when air mixes in the ink accommodation portion 300 there is a danger that the air will bulge out and cause a false detection in the residual amount or obstruct supply of ink to the head. For this reason, the ink injection rubber plug 272 is pressed completely into the ink injection hole 270 after ink injection is completed. As shown in FIG. 39(*b*), this results in the plug peak 276 completely blocking up the ink injection connection pathway 278. Accordingly, the slight amount of air remaining inside the ink injection needle insertion indentation 274 is prevented from entering inside the ink accommodation portion 300.

As shown in FIG. 15, the ink injection groove 330 is in fluid communication with the ink injection hole 270 (the ink injection connection pathway 278) and is formed to suitably follow the curved surface portion 324 so that ink flows around the tub portion 320. When ink is injected, the ink follows the ink injection groove 330 and enters the tub portion 320. Therefore, air removal is enhanced. An air removal/ink supply groove 332 is in fluid communication with the ink supply hole 260 (the ink supply connection pathway 268), is formed to suitably follow the curved surface portion 324, and moreover is in fluid communication with ink injection groove 330. Therefore, air is more easily removed during air removal. That is, even if the flexible film 302 clings intimately to the curved surface portion 324 during air removal, air can be removed from the entire ink accommodation portion 300 because an air-removal space is opened by the air removal/ink supply groove 332. It should be noted that any valley-shaped surface can enhance the ability to remove air from the ink accommodation portion 300. For example, instead of or in addition to the air removal/ink supply groove 332, the tub portion 320 can be formed with a grained surface, wherein valleys are formed between the grains of the grain surface. The valleys are in fluid communication with the ink injection groove 330 and so enhance air removal. Also, the encompassing edge 322 or bumps can be extended around the lowest position of the curved surface portion 324, that is, the semispherical pivot 365 so that ink flow can be positively controlled when ink is supplied to the ink jet head. For example, ink can be easily drawn from the lower position even if only a little ink remains and the force at which the flexible film 302 and the curved surface portion 324 cling to each other can be reduced so that an increase in back pressure can be prevented.

Figure 36:
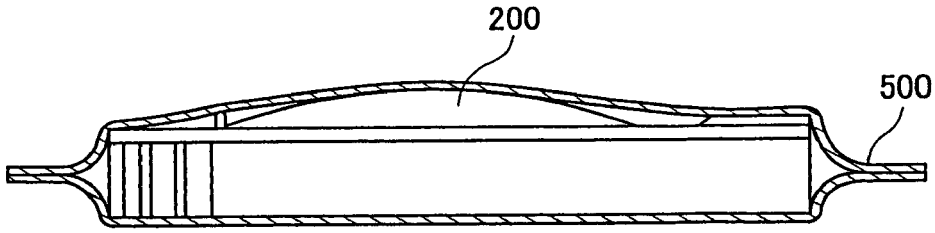
FIG. 36 is a cross-sectional view showing the ink cartridge in a vacuum packaged condition.

After ink is introduced into the ink accommodation portion 300, the lid 210 is mounted onto the main case 230 and the ink cartridge 200 is completed. Afterward, the ink cartridge 200 is packaged into a vacuum pack. That is, as shown in FIG. 36, the entire ink cartridge 200 is encompassed by a sheet 500 of resin film material and then exhausted to a vacuum condition. Because the ink jet head 70 ejects ink using pressure waves, any bubbles in the ink absorb pressure so that ink may not be properly ejected. The bubbles form and grow over time from air dissolved in the ink. Therefore, the ink cartridge 200 is vacuum packaged in order to restrict the amount of dissolved air in the ink filling the ink cartridge 200.

The ink injected into the ink accommodation portion 300 already has air removed to a certain extent. That is, the amount of air component of the ink is about 30 to 35% of the saturation amount. The ink accommodation portion 300 is filled with this ink and the entire ink cartridge 200 is encompassed within the film material. When a vacuum condition is then established within the film material, the air in the ink passes through the flexible film 302, which is formed from polypropylene and nylon, and the wall of the main case, which is prepared from a resin made from polypropylene, and is drawn inside the vacuum package. Air is further removed from the ink in the ink cartridge. After a few days elapse, the air component of the ink in the ink cartridge can drop to about 20% of a saturation condition. Accordingly, ink with a high level of air removal can be provided to users by providing the ink cartridge to users in a vacuum packaged condition.

When the ink cartridge 200 is mounted in the ink cartridge mounting portion S, the ink introducing hollow needle 82 is inserted into the ink supply rubber plug 262 of the ink supply hole 260. The ink introducing hollow needle 82 is in fluid communication with the ink jet head 70 through the buffer tank 84 and the ink-supply tube T. Air that is dissolved in the ink grows with time into bubbles and clings to the inner walls of buffer tank 84 and the ink-supply tube T. The bubbles can grow even larger during to changes in temperature and the like. The back-flow prevention valve 264 in the ink supply hole 260 is designed to block the ink supply hole 260 even if a slight external pressure is applied. Accordingly, the back-flow prevention valve 264 will close even when bubbles grow in the buffer tank 84 and the ink-supply tube T so that a slight pressure is applied to the back-flow prevention valve 264. On the other hand, the back-flow prevention valve 264 moves freely with respect to the pull of ink by the piezoelectric ink jet head 70. For this reason, although the back-flow prevention valve 264 can supply any amount of ink, the back-flow prevention valve 264 closes from pressure applied by bubbles so that bubbles can be prevented from entering into the ink accommodation portion 300 of the ink cartridge. Accordingly, problems, such as bubbles entering into the ink cartridge and bubbles entering from the ink cartridge into the head and causing defective ejections, can be prevented.

In the present embodiment, the ink injection hole 270 and the ink supply hole 260 are provided separately so that they can be provided so as to open aligned in the left-right direction at the front surface of the ink cartridge Only a single hole is provided in the front surface of the ink cartridge. If vacuum operations, ink injection, and ink supply where all performed through this hole, then the same rubber plug mounted in the hole would need to be pierced by needles three times. The hole diameter itself would need to be enlarged to insure that the needles pierced three different positions. According to the present invention, each hole can have a small diameter because the holes for ink injection and ink supply are divided separately. The ink cartridge can be formed thin because the holes are aligned in the left-right direction.

So that the ink supply hole 260 can also be used to create a vacuum during ink injection, the position where the air-removing hollow needle 502 pierces the ink supply rubber plug 262 should be different than the position where the ink introducing hollow needle 82 pierces the ink supply rubber plug 262 when the ink cartridge 200 is mounted in the ink cartridge mounting portion S. According to the present embodiment, as shown in FIG. 20 the ink supply hole 260 is formed in the front surface wall 234 in the substantial height wise and widthwise direction center. Because the protrusion portion 235 is formed in the approximate center in the widthwise direction of the front surface wall 234, the height (thickness) of the ink cartridge 200 is greater at the protrusion portion 235 than at the widthwise ends. Therefore, the ink supply hole 260 can be formed with a larger diameter and the ink supply rubber plug 262 can be formed with a larger diameter. The air-removing hollow needle 502 can easily be inserted into a position of the ink supply rubber plug 262 that differs from the position pierced by the ink introducing hollow needle 82.

The ink cartridge 200 according to the present embodiment is sealed in a vacuum package. At this time, pressure is applied that pushes the main case and the lid 210 together. In order to resist this pressure, according to the present embodiment the spherical outward curved portion 212 of the lid 210 and the tub portion 320 are formed in an approximately curved shape and a configuration that is reinforced by ribs is used.

Figure 40:
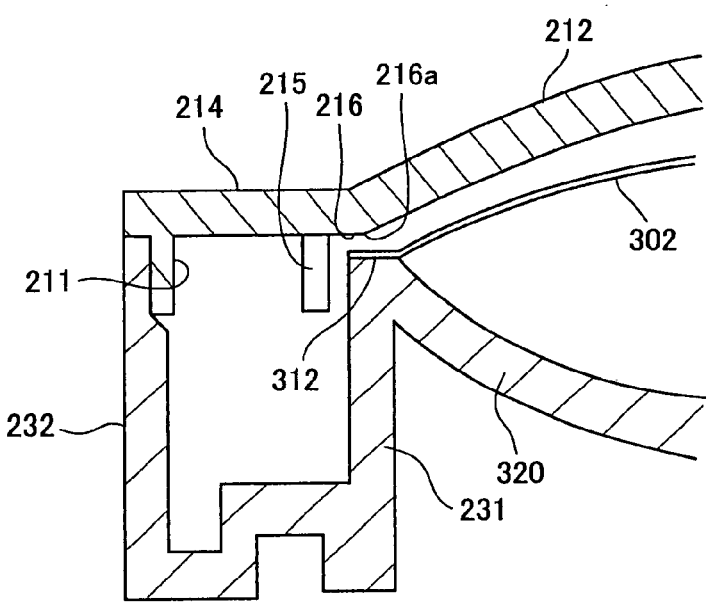
FIG. 40 is a cross-sectional view showing positional relationship of an edge (ink accommodation peripheral portion) of a spherical surface shape at the outer side of a curved portion of the lid, the inner edge of the opening peripheral portion, and the flexible film.

As shown in FIG. 40, according to the present embodiment the spherical outward curved portion 212 of the lid 210 is formed so that the ink accommodation periphery portion 216 at the periphery of the spherical outward curved portion 212 is positioned slightly outside from the internal edge of the opening peripheral edge 312 of the main case side. That is, an inner peripheral edge portion 216*a* of the ink accommodation periphery portion 216 confronts the intermediate portion of the outer edge and the inner edge of the opening peripheral edge 312. If the inner peripheral edge portion 216*a* were positioned to the inside of the inner periphery of the opening peripheral edge 312, there is a danger that the inner peripheral edge portion 216*a* would abut against and damage the flexible film 302 when the lid 210 and the tub portion 320 approach each other under the force from the vacuum pack. However, according to the present embodiment, the lid 210 abuts the position slightly outside from the inner edge of the opening peripheral edge 312, that is, from above the opening peripheral edge 312. The flexible film 302 is firmly welded onto the opening peripheral edge 312 and integrated with the resin of the main case 230. Accordingly, the ink accommodation periphery portion 216 of the lid 210 will not damage the flexible film 302 even if it directly abuts the flexible film 302 on the opening peripheral edge 312.

Next, ink cartridges according to first through twelfth modifications of the embodiment will be described with reference to FIGS. 41 to 53(*b*).

Figure 41:
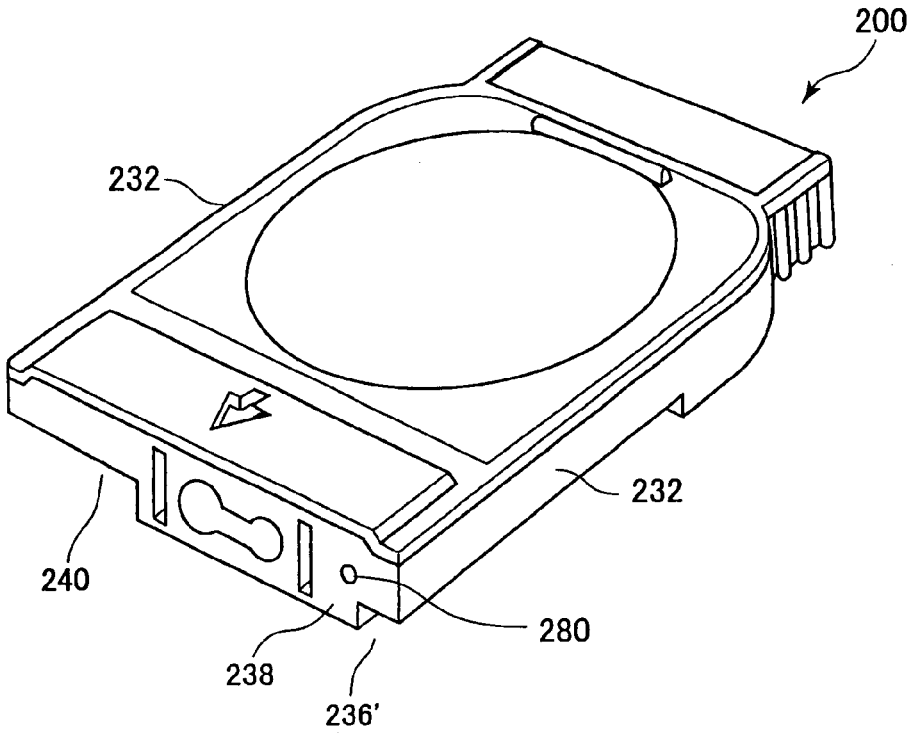
FIG. 41 is a perspective view showing an ink cartridge according to a first modification of the embodiment, wherein a guide groove and a sensor accommodation groove are open to the side walls.
Figure 42:
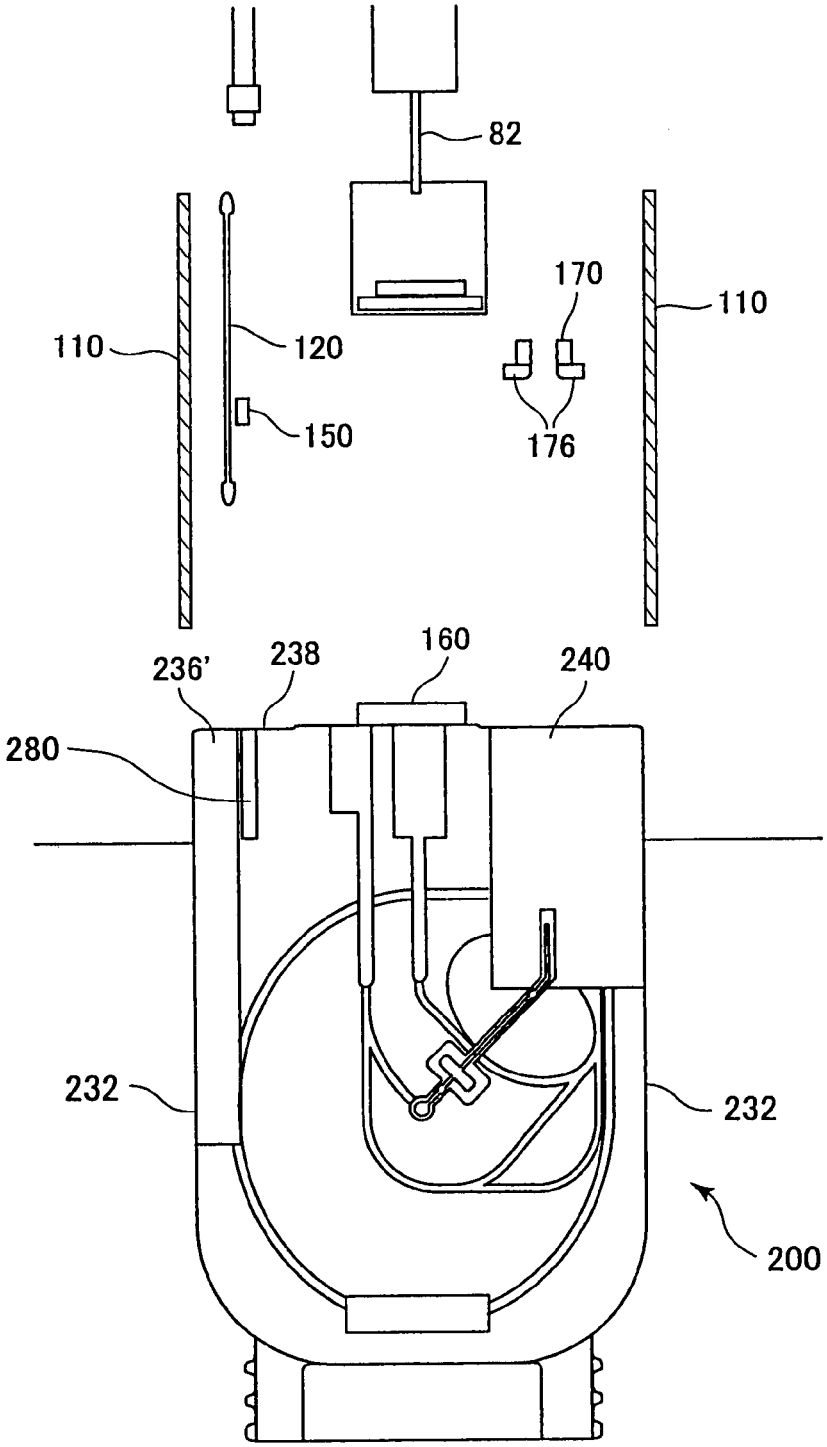
FIG. 42 is a plan view showing a recording device modified for use with the ink cartridge of FIG. 41, wherein the position of the needle protection lock release lover in the ink cartridge mounting portion is changed in correspondence with the modified ink cartridge.

FIG. 41 shows an ink cartridge 200 according to a first modification of the embodiment, wherein the guide groove 236 and the sensor accommodation groove 240 are shaped open to the side walls 232. In this case, the ink cartridge 200 is guided by sliding the guide groove notch indentation portion 236' to follow the side surface that corresponds to the guide protrusion wall 120. FIG. 42 shows configuration of the recording device 1 modified for the ink cartridge 200 of FIG. 41. The lock releasing operation rib 150 is provided near the guide protrusion wall 120 to the side at which the ink introducing hollow needle 82 is disposed. The portion of the front surface wall 234 of the ink cartridge 200 that corresponds to the position below the atmosphere connection hole 280 functions as the lock release portion 238.

Figure 43A:
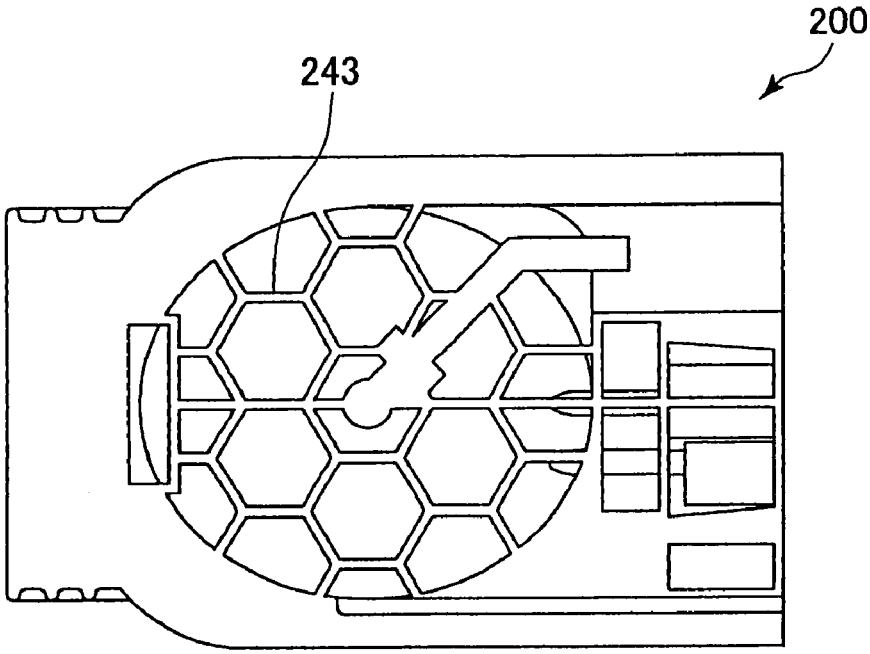
FIG. 43(*a*) is a plan view showing an ink cartridge according to a second modification of the embodiment.
Figure 43B:
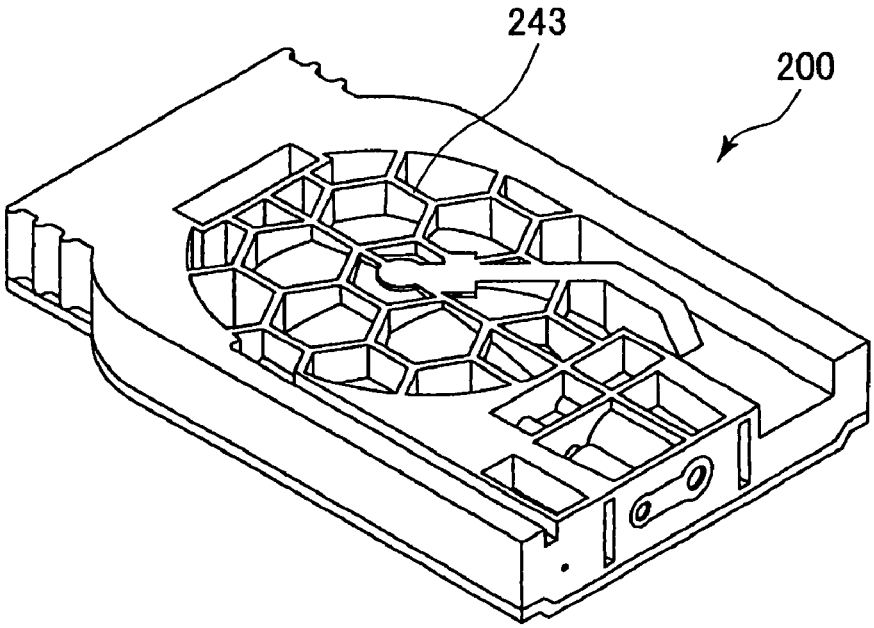

FIGS. 43(*a*) and 43(*b*) show an ink cartridge 200 according to a second modification of the embodiment, wherein the plurality of ribs 243 are arranged in a tortoise shell configuration.

Figure 44A:
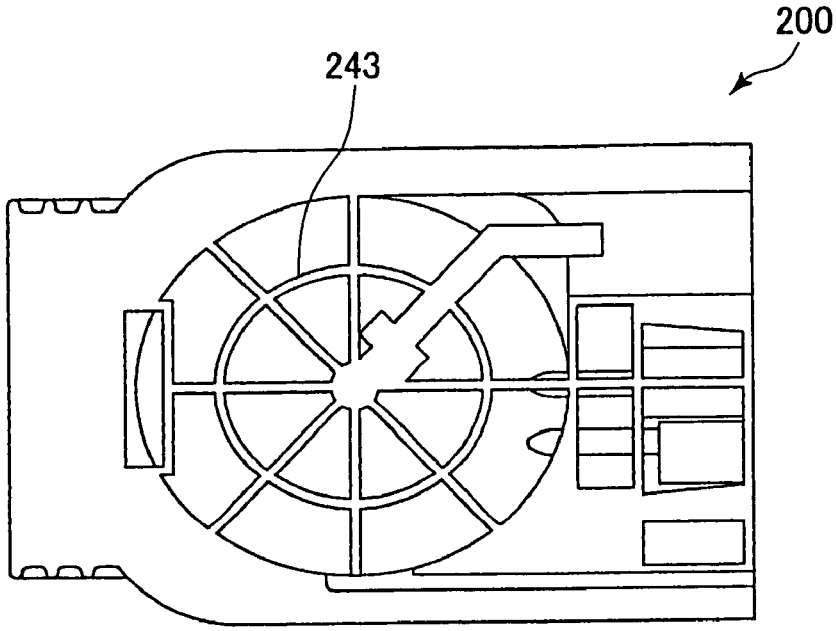
FIG. 44(*a*) is a plan view showing an ink cartridge according to a third modification of the embodiment.
Figure 44B:
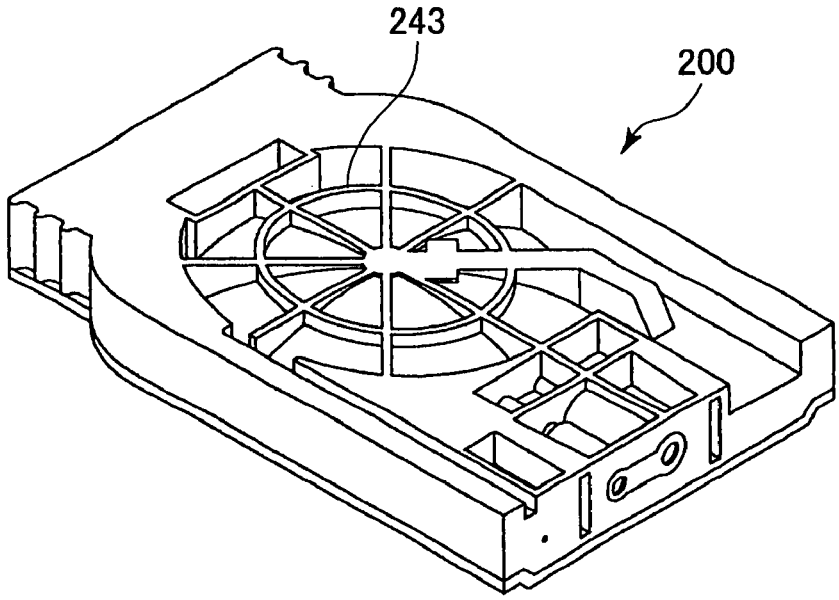

FIGS. 44(*a*) and 44(*b*) show an ink cartridge 200 according to a third modification of the embodiment, wherein the plurality of ribs 243 are arranged in a circle concentric with the encompassing edge 322.

Figure 45A:
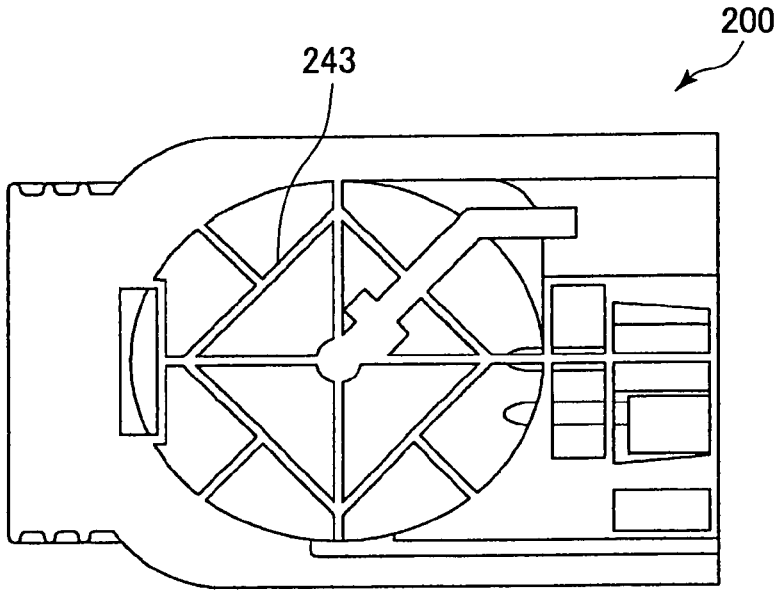
FIG. 45(*a*) is a plan view showing an ink cartridge according to a fourth modification of the embodiment.
Figure 45B:
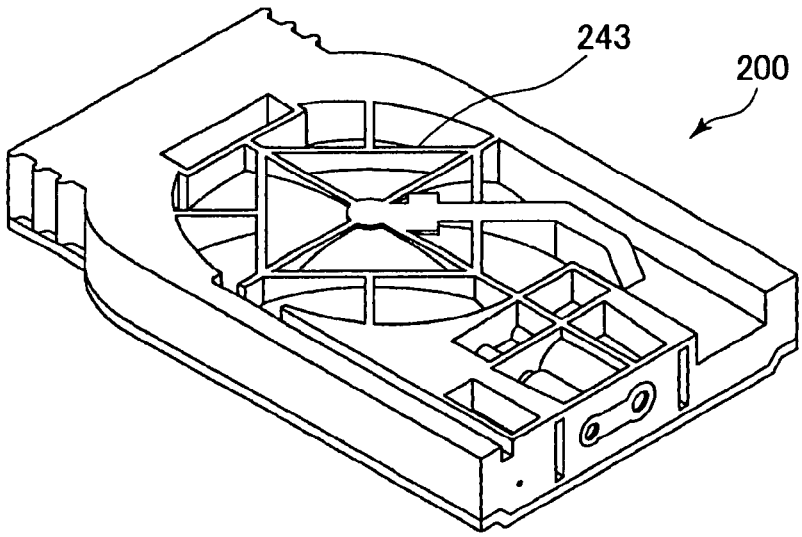
Figure 46A:
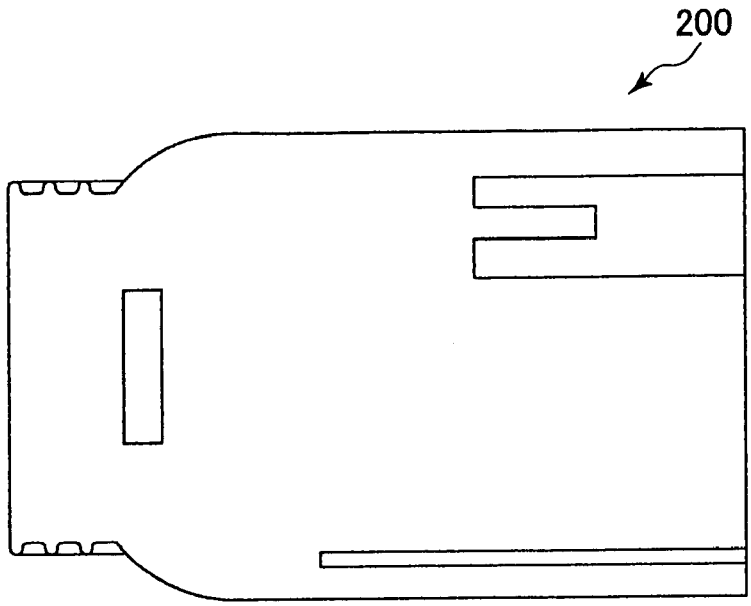
FIG. 46(*a*) is a plan view showing an ink cartridge according to a fifth modification of the embodiment.
Figure 46B:
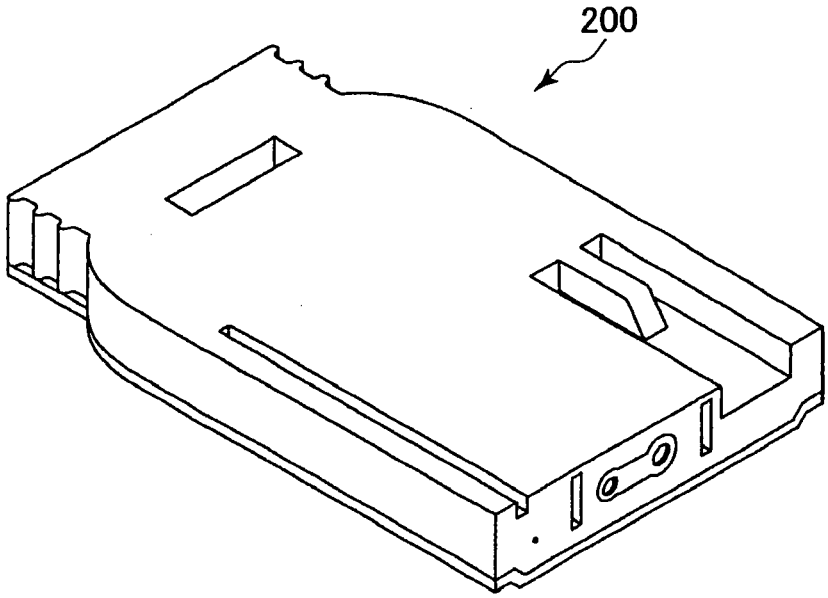

FIGS. 45(*a*) and 45(*b*) show an ink cartridge 200 according to a fourth modification of the embodiment, wherein the plurality of ribs 243 are arranged in a diamond shape;

FIGS. 46(*a*) and 46(*b*) show an ink cartridge 200 according to a fifth modification of the embodiment, wherein the lower surface of the ink cartridge 200 is smooth with no ribs.

Figure 47A:
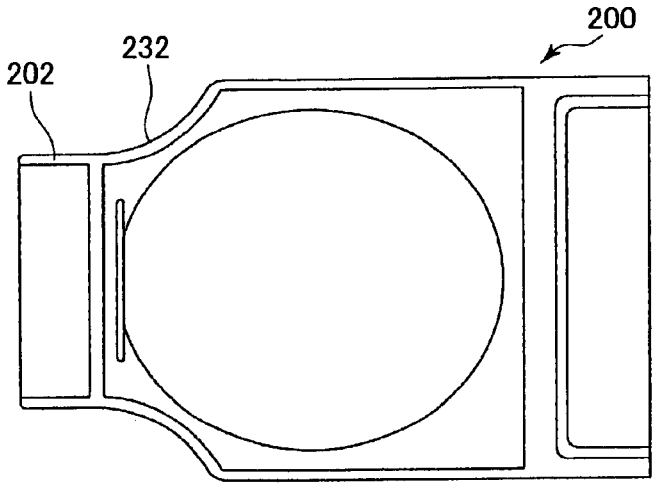
FIG. 47(*a*) is a plan view showing an ink cartridge according to a sixth modification of the embodiment.
Figure 47B:
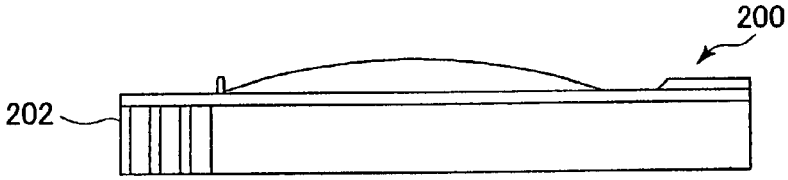

FIGS. 47(*a*) and 47(*b*) show an ink cartridge 200 according to a sixth modification of the embodiment, wherein the grasping portion 202 and the side walls 232 are shaped differently than in the embodiment.

Figure 48A:
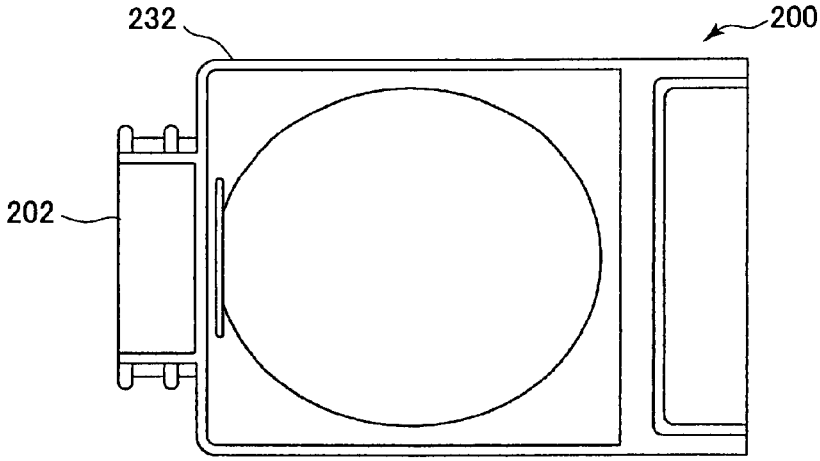
FIG. 48(*a*) is a plan view showing an ink cartridge according to a seventh modification of the embodiment.
Figure 48B:
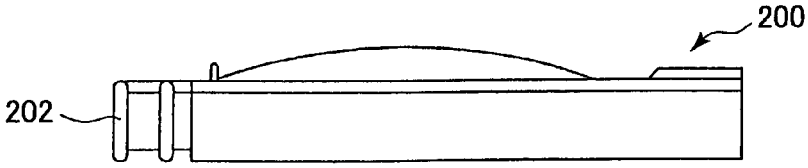

FIGS. 48(*a*) and 48(*b*) show an ink cartridge 200 according to a seventh modification of the embodiment, wherein the grasping portion 202 and the side walls 232 are shaped differently than in the embodiment.

Figure 49A:
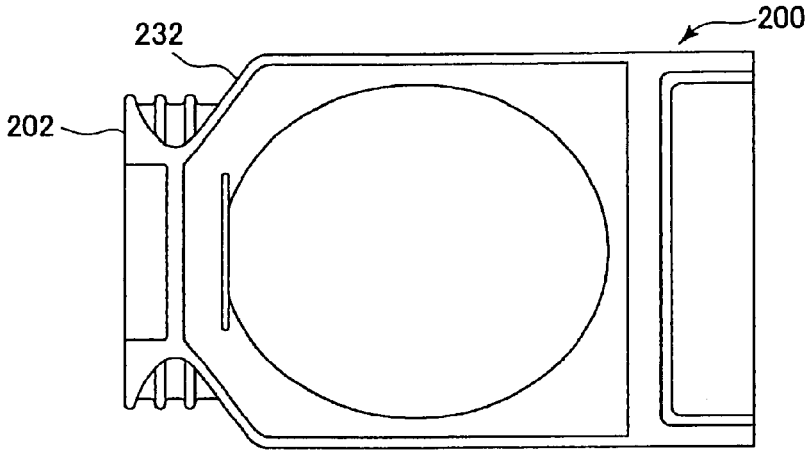
FIG. 49(*a*) is a plan view showing an ink cartridge according to an eighth modification of the embodiment.
Figure 49B:
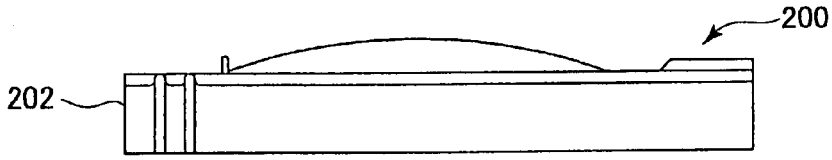

FIGS. 49(*a*) and 49(*b*) show an ink cartridge 200 according to an eighth modification of the embodiment, wherein the grasping portion 202 and the side walls 232 are shaped differently than in the embodiment.

Figure 50A:
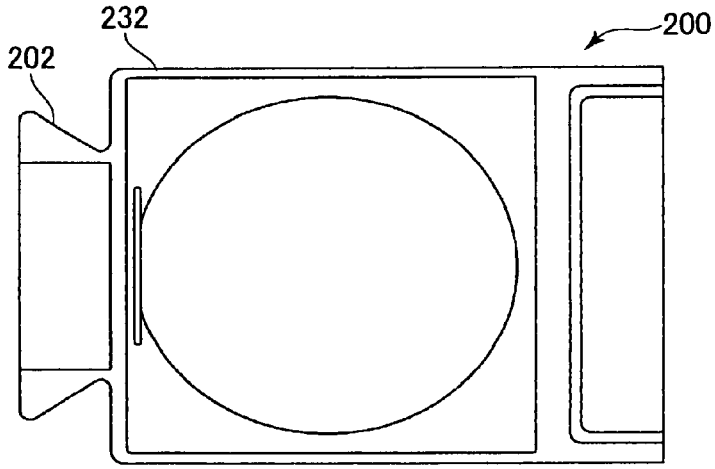
FIG. 50(*a*) is a plan view showing an ink cartridge according to a ninth modification of the embodiment.
Figure 50B:
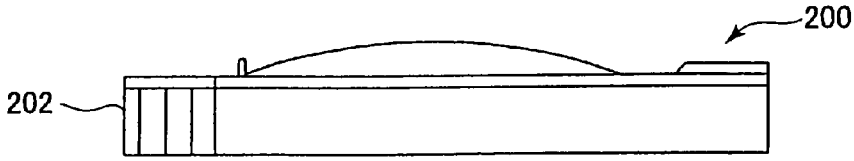

FIGS. 50(*a*) and 50(*b*) show an ink cartridge 200 according to a ninth modification of the embodiment, wherein the grasping portion 202 and the side walls 232 are shaped differently than in the embodiment.

Figure 51A:
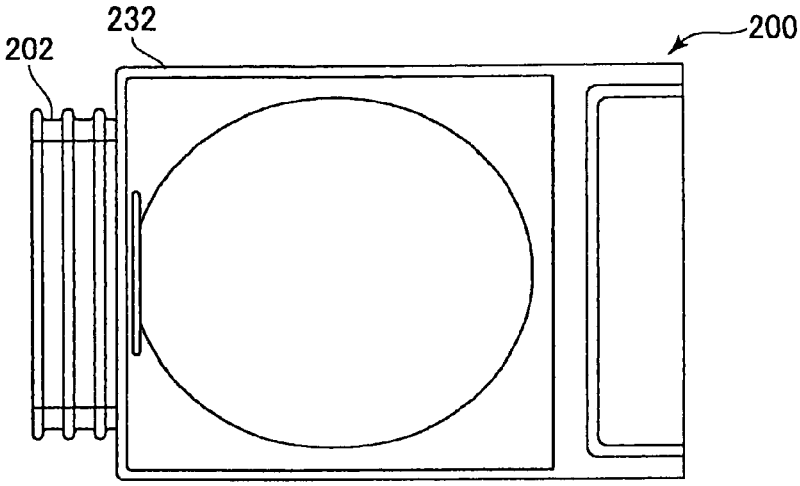
FIG. 51(*a*) is a plan view showing an ink cartridge according to a tenth modification of the embodiment.
Figure 51B:
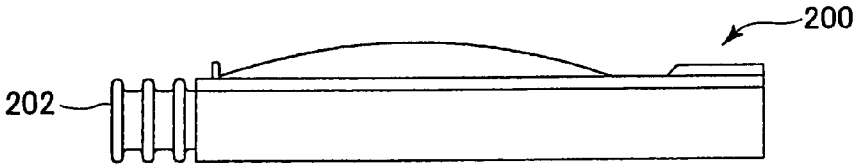

FIGS. 51(*a*) and 51(*b*) show an ink cartridge 200 according to a tenth modification of the embodiment, wherein the grasping portion 202 and the side walls 232 are shaped differently than in the embodiment.

Figure 52A:
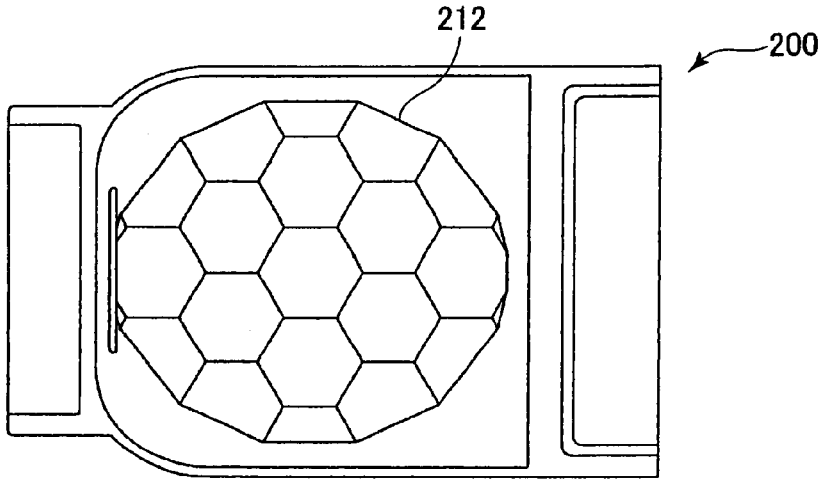
FIG. 52(*a*) is a plan view showing an ink cartridge according to an eleventh modification of the embodiment.
Figure 52B:
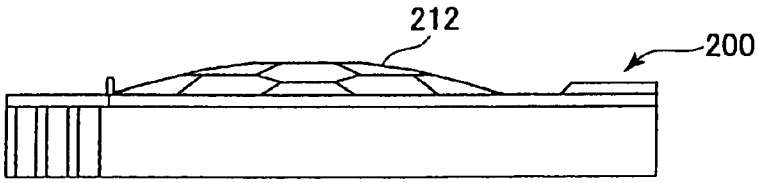

FIGS. 52(*a*) and 52(*b*) show an ink cartridge 200 according to an eleventh modification of the embodiment, wherein the portion 212 has a tortoise shell pattern instead of a spherical outward curved shape.

Figure 53A:
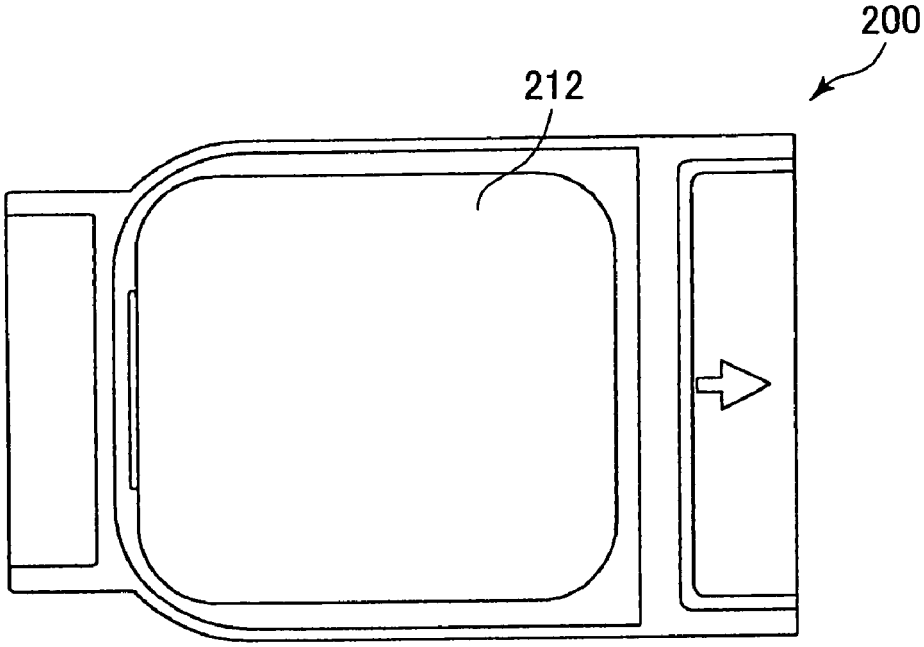
FIG. 53(*a*) is a plan view showing an ink cartridge according to a twelfth modification of the embodiment.
Figure 53B:
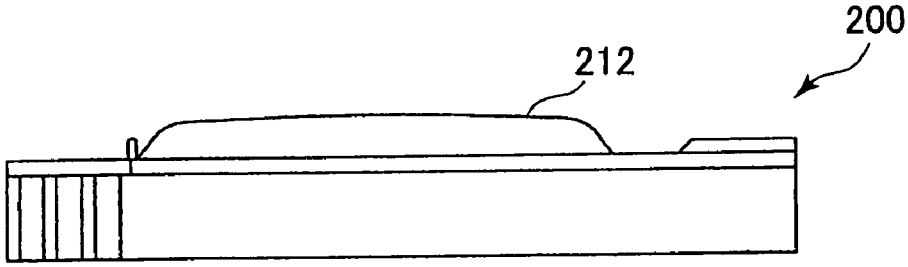

FIGS. 53(*a*) and 53(*b*) show an ink cartridge 200 according to a twelfth modification of the embodiment, wherein the portion 212 has a square shape instead of a spherical outward curved shape.

While the invention has been described in detail with reference to a specific embodiment and modifications thereof, it would be apparent to those skilled in the art that various changes and modifications may be made therein without departing from the spirit of the invention, the scope of which is defined by the attached claims.

For example, the configurations of the needle protection plate 130, the lock member 180, and the leak preventing lock member 190 are not limited to those shown in FIG. 11.

What is claimed is:

1. An ink cartridge comprising:

an ink-holding portion including a rigid indented surface portion and a flexible film, the indented surface portion having an open side at one side thereof, the flexible film covering the open side of the indented surface portion, ink being accommodated between the indented surface portion and the flexible film;

a rigid upper surface positioned opposite from the indented surface portion with respect to the flexible film, the upper surface being formed with a substantial semispherical shape that bulges in a direction away from the indented surface portion;

a main case including the indented surface portion of the ink-holding portion and attached with the flexible film so that the open side of the indented surface portion is covered; and a lid provided as a separate member from the main case and including the upper surface, the upper surface having a curved portion at a position that confronts the indented surface portion with the flexible film located therebetween, the curved portion being curved in the substantial semispherical shape in a direction extending away from the indented surface portion;

wherein:

the indented surface portion of the main case is formed from a wall that is curved in a substantial semispherical shape in a direction away from the curved portion of the lid;

the main case has a peripheral wall that extends from an upper edge thereof in a depthwise direction of the ink-holding portion to a lower edge thereof to encompass the ink-holding portion, the lower edge of the peripheral wall substantially defining an outer peripheral edge portion of a lower surface of the main case; and the lid has an outer peripheral portion that confronts the peripheral wall and that is coupled with the upper edge of the peripheral wall.

2. An ink cartridge as claimed in claim 1, wherein the main case has a main case open side peripheral edge portion that encompasses the open side of the ink-holding portion, the main case opening peripheral edge portion having an inner edge that defines a boundary between the open side and the indented surface portion of the ink-holding portion, the flexible film being attached to the main case open side peripheral edge portion so as to cover the open side of the ink-holding portion, the lid having a lid opening peripheral portion that encompasses the curved portion, the lid opening peripheral portion being formed at a position confronting a region to the outside of the inner edge of the main case open side peripheral edge portion.

3. An ink cartridge as claimed in claim 1, wherein the main case has a plurality of ribs that connect the peripheral wall of the main case to a lower surface of the wall.

4. An ink cartridge as claimed in claim 1, wherein:

the ink-holding portion includes an encompassing edge portion that defines the open side of the indented surface portion, the flexible film being attached to the encompassing edge portion; and the peripheral wall of the main case includes:

a first peripheral wall that extends in the depthwise direction of the ink-holding portion and that is formed integrally with the encompassing edge portion that defines the open side of the indented surface portion;

a second peripheral wall positioned on an opposite side of the first peripheral wall than the ink-holding portion with a space interposed between the first and second peripheral walls; and a plurality of walls that connected the first and second peripheral walls together.

5. An ink cartridge as claimed in claim 1, wherein the main case is formed with:

an ink supply hole for drawing ink from the ink-holding portion to outside of the ink cartridge; and an atmosphere connection pathway that connects a space between the lid and the flexible film with outside of the ink cartridge in order to apply atmospheric pressure from outside of the ink-holding portion to the flexible film.

6. An ink cartridge as claimed in claim 4, wherein:

the main case includes a wall portion that defines an ink supply hole and an atmosphere connection hole, the ink supply hole being for removing ink from the indented surface portion of the ink-holding portion to outside of the ink cartridge, the atmosphere connection hole connecting a space between the lid and the flexible film with outside of the ink cartridge in order to apply atmospheric pressure from outside of the ink-holding portion to the flexible film; and the lid is formed with, at least at one position that confronts the main case open side peripheral edge portion, a groove for bringing the space defined between the curved portion of the lid and the flexible film into fluid communication with the atmosphere connection hole.

7. An ink cartridge as claimed in claim 1, wherein the flexible film is formed from:

an inner layer that has heat fusing properties and contacts the upper edge of the peripheral wall of the main case; and an outer layer that has heat resistance and shock resistance and that confronts the curved portion of the lid.

8. An ink cartridge as claim in claim 7, wherein the outer layer is formed from an additive type polypropylene that has heat resistance and shock resistance and the inner layer is formed from a non-additive type polypropylene.

9. An ink cartridge as claimed in claim 1, wherein the flexible film has gas permeability.

10. An ink cartridge comprising:

an ink-holding portion including a rigid indented surface portion and a flexible film, the indented surface portion having an open side at one side thereof, the flexible film covering the open side of the indented surface portion, ink being accommodated between the indented surface portion and the flexible film:

a rigid upper surface positioned opposite from the indented surface portion with respect to the flexible film, the upper surface being formed with a substantial semispherical shape that bulges in a direction away from the indented surface portion:

a main case including the ink-holding portion and formed from a resin; and a lid including the upper surface and formed from a resin that is different from the resin of the main case.

11. An ink cartridge as claimed in claim 10, wherein at least the main case is formed from a resin having high resistance to ink.

12. An ink cartridge comprising:

an ink-holding portion including a rigid indented surface portion and a flexible film, the indented surface portion having an open side at one side thereof, the flexible film covering the open side of the indented surface portion, ink being accommodated between the indented surface portion and the flexible film;

a rigid upper surface positioned opposite from the indented surface portion with respect to the flexible film, the upper surface being formed with a substantial semispherical shape that bulges in a direction away from the indented surface portion; and a lid including an outer surface and an inner surface opposite the outer surface, wherein the upper surface is located on at least one of the inner surface or the outer surface.

13. An ink cartridge as claimed in claim 12, wherein the upper surface is located on the inner surface of the lid.

14. An ink cartridge comprising:

an ink-holding portion including a rigid indented surface portion and a flexible film, the indented surface portion having an open side at one side thereof, the flexible film covering the open side of the indented surface portion, ink being accommodated between the indented surface portion and the flexible film;

a rigid upper surface positioned opposite from the indented surface portion with respect to the flexible film, the upper surface being formed with a substantial semispherical shape that bulges in a direction away from the indented surface portion;

a main case including the indented surface portion of the ink-holding portion and attached with the flexible film so that the open side of the indented surface portion is covered; and a lid provided as a separate member from the main case and including the upper surface, the upper surface having a curved portion at a position that confronts the indented surface portion with the flexible film located therebetween, the curved portion being curved in the substantial semispherical shape in a direction extending away from the indented surface portion;

wherein the main case is formed with:

an ink supply hole for drawing ink from the ink-holding portion to outside of the ink cartridge; and an atmosphere connection pathway that connects a space between the lid and the flexible film with outside of the ink cartridge in order to apply atmospheric pressure from outside of the ink-holding portion to the flexible film.

* * * * *